US008025618B2

(12) United States Patent
Walsh et al.

(10) Patent No.: US 8,025,618 B2
(45) Date of Patent: Sep. 27, 2011

(54) PACKAGES, BLANKS FOR MAKING PACKAGES AND ASSOCIATED METHODS AND APPARATUS

(75) Inventors: Joseph C. Walsh, Boulder, CO (US); Robert L. Conatser, Longmont, CO (US); Raymond S. Kastanek, Longmont, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/318,437

(22) Filed: Dec. 13, 2002

(65) Prior Publication Data

US 2003/0144121 A1 Jul. 31, 2003

Related U.S. Application Data

(60) Provisional application No. 60/341,152, filed on Dec. 14, 2001, provisional application No. 60/360,598, filed on Feb. 28, 2002.

(51) Int. Cl.
*B31F 1/00* (2006.01)

(52) U.S. Cl. ..... 493/381; 493/335; 493/355; 493/362

(58) Field of Classification Search ..... 493/334, 493/335, 361, 355, 364, 365, 369, 379, 380, 493/381, 362

See application file for complete search history.

(56) References Cited

U.S. PATENT DOCUMENTS

| | | | | |
|---|---|---|---|---|
| 1,145,668 | A | | 7/1915 | Brown |
| 1,762,703 | A | | 6/1930 | Smith |
| 1,844,952 | A | | 2/1932 | Freedman et al. |
| 1,869,751 | A | | 8/1932 | Iacobitti |
| 1,911,215 | A | | 5/1933 | Walter |
| 2,005,924 | A | | 6/1935 | Wilson |
| 2,006,203 | A | | 6/1935 | Leslie |
| 2,098,818 | A | | 11/1937 | Andrews |
| 2,343,222 | A | | 2/1944 | Nelson |
| 2,346,134 | A | | 4/1944 | Kirkland et al. |
| 2,348,377 | A | | 5/1944 | Goodyear |
| 2,407,781 | A | | 9/1946 | Guyer |
| 2,502,117 | A | * | 3/1950 | Anderson ..... 493/18 |
| 2,542,298 | A | * | 2/1951 | Zinn, Jr. ..... 493/63 |

(Continued)

FOREIGN PATENT DOCUMENTS

DE 1091851 10/1960

(Continued)

OTHER PUBLICATIONS

Decision of Rejection for JP 2003-552532, mailed May 20, 2011 and Translation.

*Primary Examiner* — Christopher Harmon
(74) *Attorney, Agent, or Firm* — Womble Carlyle Sandridge & Rice, PLLC

(57) ABSTRACT

Disclosed herein, for example, are methods and apparatus for forming carton blanks. In one such method, a first web of material and a second web of material may be provided. At least one line of disruption may be formed in one of the webs of material. A combined section may be formed that includes a section of the first web of material and a section of the second web of material. Thereafter, a carton blank may be formed by separating the combined section from the first web of material and the second web of material. Also disclosed herein, for example, are various carton blanks and cartons.

28 Claims, 40 Drawing Sheets

U.S. PATENT DOCUMENTS 2,576,594 A 11/1951 Goldstein
2,701,679 A 2/1955 Goldstein
2,706,076 A 4/1955 Guyer
2,775,393 A 12/1956 Rugg
2,778,557 A 1/1957 Moore
2,848,151 A 8/1958 O'Neil
2,934,251 A 4/1960 Kramer
2,944,726 A 7/1960 McCauley
2,993,632 A 7/1961 De Feo
3,048,324 A 8/1962 Anderson
3,116,866 A 1/1964 Boran
3,137,437 A 6/1964 Svenson
3,159,326 A 12/1964 Stonebanks
3,184,136 A 5/1965 Forbes, Jr.
3,414,182 A 12/1968 Fobiano
3,417,911 A 12/1968 Hennessey
3,640,447 A 2/1972 Forbes, Jr. et al.
3,768,719 A 10/1973 Johnson
3,831,836 A 8/1974 Ellison et al.
3,891,137 A 6/1975 Ellison et al.
3,905,646 A 9/1975 Brackmann et al.
3,951,333 A 4/1976 Forbes, Jr. et al.
3,981,430 A 9/1976 Keim
4,015,768 A 4/1977 McLennan
4,027,794 A 6/1977 Olson
4,046,307 A 9/1977 Booth et al.
4,095,735 A 6/1978 Stone
4,141,485 A 2/1979 Lambert
4,165,030 A 8/1979 Bunger et al.
4,168,003 A 9/1979 Wysocki
4,194,677 A 3/1980 Wysocki
4,308,956 A 1/1982 Steinke et al.
4,341,338 A 7/1982 Arnold
4,345,393 A 8/1982 Price et al.
4,371,109 A 2/1983 Tanner et al.
4,458,810 A 7/1984 Mahoney
4,548,318 A 10/1985 Boyle
4,608,038 A * 8/1986 Virta et al. ..... 493/29
4,768,703 A 9/1988 Sosler et al.
4,781,317 A 11/1988 Ditto
4,909,395 A 3/1990 Weissman
4,913,292 A 4/1990 Field
4,946,540 A * 8/1990 Mitchard ..... 156/556
4,948,033 A 8/1990 Halsell, II et al.
4,989,735 A 2/1991 O'Brien
5,012,959 A 5/1991 Gordon
5,050,742 A * 9/1991 Muckenfuhs ..... 206/494
5,069,359 A 12/1991 Liebel
5,071,010 A 12/1991 Carufel/Zeman
5,083,667 A 1/1992 Holder
5,092,516 A 3/1992 Kastanek
5,125,568 A 6/1992 Bauer
5,129,875 A * 7/1992 Chaygneaud-Dupuy ..... 493/335
5,141,150 A 8/1992 Plaessmann
5,222,660 A 6/1993 Koss
5,238,181 A 8/1993 Mahler
5,251,808 A 10/1993 Rudd
5,285,956 A 2/1994 Piepho
5,289,939 A * 3/1994 Gordon et al. ..... 229/5.82
5,328,091 A 7/1994 Koss
5,373,960 A 12/1994 Gunn et al.
5,429,297 A 7/1995 Walsh
5,450,680 A 9/1995 Bromberg
5,544,806 A 8/1996 Anderson et al.
5,551,938 A * 9/1996 Stone ..... 493/96
5,584,430 A 12/1996 Mulry
5,588,585 A 12/1996 McClure
5,599,267 A 2/1997 Dupuy
5,601,521 A * 2/1997 Plamas Xapelli ..... 493/346
5,632,404 A 5/1997 Walsh
5,678,755 A 10/1997 Block
5,757,930 A 5/1998 Seidemann et al.
5,775,576 A 7/1998 Stone
5,794,811 A 8/1998 Walsh
5,810,250 A 9/1998 Stone et al.
5,826,783 A * 10/1998 Stout ..... 229/120.32
5,857,614 A 1/1999 Walsh
5,893,513 A 4/1999 Stone et al.
5,967,374 A 10/1999 Baker
6,015,084 A * 1/2000 Mathieu et al. ..... 229/122.32
6,027,018 A 2/2000 Yocum
6,059,182 A * 5/2000 Wein ..... 229/219
6,110,095 A * 8/2000 Finke et al. ..... 493/463
6,131,729 A 10/2000 Eckermann et al.
6,145,736 A * 11/2000 Ours et al. ..... 229/117.3
6,158,653 A 12/2000 Kanter et al.
6,189,777 B1 2/2001 Hutchinson et al.
6,221,192 B1 4/2001 Walsh
6,230,881 B1 5/2001 Collura
6,332,488 B1 * 12/2001 Walsh ..... 156/516
6,435,402 B1 8/2002 Hengami
6,631,803 B2 * 10/2003 Rhodes et al. ..... 206/427
6,889,892 B2 5/2005 Walsh et al.
6,948,293 B1 * 9/2005 Eckermann et al. ..... 53/246
2001/0048022 A1 * 12/2001 Zoeckler ..... 229/199
2002/0055429 A1 5/2002 Walsh
2002/0060240 A1 5/2002 Walsh et al.
2005/0103681 A1 5/2005 Aubry et al.

FOREIGN PATENT DOCUMENTS

DE 89 08 393 U1 9/1989
EP 0 079 155 A2 5/1983
EP 0 542 449 A1 5/1993
FR 648.629 12/1928
FR 2 686 316 7/1993
GB 2 275 913 A 9/1994
GB 2 379 923 A 3/2003
JP 44-25911 10/1969
JP 59-69132 5/1984
JP 62-31018 2/1987
WO WO 92/01606 A1 2/1992
WO WO 97/27114 7/1997
WO WO 02/11516 A1 2/2002
WO WO 03/051622 A 6/2003

* cited by examiner

PACKAGES, BLANKS FOR MAKING PACKAGES AND ASSOCIATED METHODS AND APPARATUS

This application claims the benefit of U.S. Provisional Application Ser. No. 60/341,152, filed Dec. 14, 2001 and the benefit of U.S. Provisional Application Ser. No. 60/360,598, filed on Feb. 28, 2002, both of which are hereby specifically incorporated by reference for all that is disclosed therein.

BACKGROUND

Products are commonly packaged in boxes, containers or cartons which may, for example, be formed from a paperboard material. Examples of such boxes, containers or cartons include cereal boxes, milk cartons, butter and margarine boxes and beer and soft drink secondary packaging (e.g., cartons enclosing a plurality of beer or softdrink cans or bottles). For explanatory purposes, the simple term "carton" may be used throughout this description to refer to the general type of boxes, containers or cartons described above.

The process of forming this type of carton typically begins by printing a continuous web of material, e.g., paperboard material, with the particular graphics desired for the package in question. The paperboard material may, for example, have a thickness of between about 0.001 and about 0.040 inch. Before printing, the paperboard material may, for example, be of a brown or grey color. Alternatively, the paperboard material may be bleached or coated so as to exhibit a generally white color. A typical web of paperboard material may, for example, have a length of between about 10,000 and about 30,000 feet and may be wound into a roll format.

To print a web of material, the web of material may be mounted on a reel at one end of a web printing machine. Such a web printing machine typically includes various printing stations, each of the printing stations being adapted to apply a different pattern and color of ink to the web. Each printing station may employ an ink application method such as a gravure or a flexographic method, as is well-known in the web printing industry. As can be appreciated, this type of printing machine will typically have a number of active printing stations equal to the number of graphics colors to be applied to the web. A drying station may also be located after each of the printing stations such that each color pattern will be dried before that portion of the web enters the next printing station.

The end of the web of material may then be threaded through the web printing machine and thereafter rewound onto an output reel at the opposite end of the printing machine. In this manner, the entire web may be fed through the printing machine. Within the printing machine, the graphics for the desired package are repeatedly printed along the web.

After printing is completed, the printed web may be removed from the output reel of the printing machine and transferred to a cutting and scoring machine. Alternatively, the printed web may be cut and scored in-line with the printing machine before being rewound onto the output reel. The cutting and scoring machine cuts the web into a plurality of carton blanks, each of which is registered with the graphics printed in the printing machine. Examples of cutting and scoring machines are generally disclosed in U.S. Pat. No. 4,781,317 and U.S. Pat. No. 4,757,930, both of which are hereby specifically incorporated by reference for all that is disclosed therein. Depending on the design of the particular carton blank, the blank may also be folded or partially folded and glued after completion of the cutting and scoring operation.

The carton blanks may then be shipped to the product filling location. At this filling location, the carton blanks are erected and the desired product inserted. Any necessary final gluing, depending on the type of carton, may also be accomplished at this time. Examples of carton blanks and of cartons formed therefrom are disclosed in U.S. Pat. No. 5,092,516 and U.S. Pat. No. 5,632,404, both of which are hereby specifically incorporated by reference for all that is disclosed therein.

SUMMARY

Disclosed herein, for example, are methods for forming cartons and carton blanks. In one such method, a first web of material and a second web of material may be provided. At least one line of disruption may be formed in one of the webs of material. A combined section may be formed that includes a section of the first web of material and a section of the second web of material. Thereafter, a carton blank may be formed by separating the combined section from the first web of material and the second web of material.

Also disclosed herein, for example, are various carton blanks and cartons that may be made from the various methods disclosed herein.

Also disclosed herein is a basket carrier including at least one first outer wall; at least one second outer wall extending substantially parallel to the at least one first outer wall; at least one inner wall located between the at least one first outer wall and the at least one second outer wall and extending substantially parallel to the at least one first outer wall and the at least one second outer wall; a plurality of compartments and at least one divider wall separating two of the plurality of compartments and extending between the at least one first outer wall and the at least one inner wall. The at least one divider wall may be integrally formed with at least a portion of the at least one first divider wall.

The at least one first outer wall may further include at least a first layer of material and a second layer of material. The second layer of material may further be at least partially adhered to the first layer of material. The at least one divider wall may further be formed from the second layer of material but not from the first layer of material. The first layer of material may further include a layer of paperboard material. The second layer of material may further include a layer of paperboard material. The at least one divider wall may further be attached to the at least one inner wall.

Also disclosed herein is a method of making a basket carrier. The method may include providing a carton blank, at least a portion of which includes a first layer of material and a second layer of material; providing, within the portion, a panel defined by a cut line and a fold line formed in the first layer of material and creating an opening in the first layer of material by folding the panel away from the first layer of material and the second layer of material about the fold line. The opening may be covered by a section of the second layer of material.

The first layer of material may further include a layer of paperboard material. The second layer of material may further include a layer of paperboard material. The step of providing a carton blank may further include providing a second portion of the carton blank including the first layer of material but not the second layer of material and providing a third portion of the carton blank including the second layer of material but not the first layer of material. The method may further include adhering the second portion to the third portion.

Also disclosed herein is a carton blank including a unitary sheet having a predetermined thickness extending substantially throughout the unitary sheet. The unitary sheet may include at least a first layer and a second layer having at least portions thereof secured together. The unitary sheet may have a plurality of cut and fold lines formed in at least one of the first and second layers so that the unitary sheet may be formed into a carton. The first layer may have at least one perforated line formed therein so that at least one opening can be formed therein. The second layer may have at least one perforated line formed therein so that at least one opening can be formed therein. The at least one opening in the first layer may have a configuration that differs at least in size from the configuration of the at least one opening in the second layer. The at least one perforated line in the first layer and the at least one perforated line in the second layer being located in the unitary sheet so that an opening may be formed in the carton formed from the unitary sheet.

The cut and fold lines may define a plurality of sidewall panels, a plurality of top and bottom wall panels and at least one glue panel and the plurality of sidewall panels may include at least two spaced apart relatively large sidewall panels and two spaced apart relatively small sidewall panels.

The at least one perforated line and the at least one perforated line in the first and second layers may be located in the at least two spaced apart relatively large sidewall panels of the first and second layers that are secured together.

The at least one perforated line in the first layer may be located in the first layer of one of the at least two spaced apart relatively small sidewall panels; and the at least one perforated line in the second layer may have portions located in one of the at least two spaced apart relatively small sidewall panels and other portions thereof located in the second layer of each of the spaced apart two relatively large sidewall panels. The carton blank may further include an additional fold line located in the one of the at least two spaced apart relatively small sidewall panels and the additional fold line may extend in a direction that is substantially perpendicular to the fold lines between the one of the at least two spaced apart relatively small sidewall panels and the at least two spaced apart relatively large sidewall panels and another additional fold line may be located in the one of the at least two spaced apart relatively small sidewall panels and parallel to but spaced from the additional fold line and the at least one perforated line in the first layer of the one of the at least two spaced apart relatively small sidewall panels having portions terminating in the additional fold line and the another additional fold line so that, when the at least one perforated line in the first layer is broken, a pivotal tab is formed. Each of the first and second layers may have an outside border; the outside borders may be substantially identical and each of the first and second layers may have a substantially uniform thickness throughout the extent thereof; the substantially uniform thickness of the first layer differs from the substantially uniform thickness of the second layer; and the first layer and the second layer may be formed from different materials. The carton blank may further include a plurality of fold lines in one of the first and second layers forming a plurality of sidewall panels; the other of the first and second layers having at least one cut line in a superposed relationship with at least one of the plurality of fold lines; the at least one cut line extending only partially through the other of the first and second layers; the other of the first and second layers having at least two additional cut lines parallel to but spaced from the at least one cut line; the at least two additional cut lines extending only partially through the other of the first and second layers; and the first and second layers being not secured together between the at least two additional cut lines. One of the at least two additional cut lines may be spaced from the at least one cut line in one direction and the other of the at least two additional cut lines may be spaced from the at least one cut line in a direction opposite to the one direction.

Also disclosed herein is a carton blank having a unitary sheet having a predetermined thickness extending substantially throughout the unitary sheet. The unitary sheet may include at least a first layer and a second layer having at least portions thereof secured together by laminating the first and second layers together. The unitary sheet may have a plurality of cut and fold lines formed in at least one of the first and second layers prior to the lamination of the first and second layers together. The first layer may have at least one perforated line formed therein so that at least one opening can be formed therein. The second layer may have at least one area containing indicia printed thereon. The at least one opening in the first layer and the one area in the second layer may be located so that, when the one opening is formed in the first layer, the indicia on the one area of the second layer is visible.

The at least one perforated line may have at least two spaced apart end portions and a fold line may extend between the at least two spaced apart end portions.

Also disclosed herein is a closed carton having a plurality of sidewall panels with adjacent sidewall panels connected by a fold line, a glue panel connected to one of the sidewall panels, a top panel connected to each of the sidewall panels by a fold line and a bottom panel connected to each of the sidewall panels by a fold line and formed from a unitary sheet having a predetermined thickness extending throughout the unitary sheet and including at least a first and a second layer secured together and the closed carton having materials contained therein which materials are to be removed from the closed carton. The closed carton may include at least one perforated line located in the first layer of at least one of the sidewall panels and at least one perforated line located in the second layer of the at least one of the sidewall panels. The at least one perforated lines of the first and second layers may have differing configurations. The first layer may be the outer layer so that an outwardly directed force may be applied to the first layer to break the at least one perforated line in the first layer and the at least one perforated line in the second layer to form an opening in the carton for the removal of at least some of the materials contained therein.

The at least one perforated line in the first layer may have end portions that terminate in a fold line between the at least one of the sidewall panels and an adjacent one of the sidewall panels. The at least one perforated line in the second layer may have end portions that terminate in a fold line between the at least one of the sidewall panels and an adjacent sidewall panel. The carton may further include at least two oppositely facing relatively large sidewall panels and at least two oppositely facing relatively small sidewall panels. The at least one perforated line in the first and second layers may be in the oppositely facing relatively large sidewall panels. The carton may further include at least two oppositely facing relatively large sidewall panels and at least two oppositely facing relatively small sidewall panels. The at least one perforated line in the first layer may located in one of the at least two oppositely facing relatively short sidewall panels. The at least one perforated line in the second layer may have at least portions thereof located in the one of the at least two oppositely facing relatively short sidewall panels and other portions thereof located in portions of the two oppositely facing relatively large sidewall panels of the second layer and forming wing portions for a pour spout. The carton may further include another fold line in each of the first and second layers in superposed relationship and located in the one of the at least two spaced apart relatively small sidewall panels. The another fold lines may extend in a direction that is substantially perpendicular to the fold lines between the one of the at least two space apart relatively small sidewall panels and the at least two spaced apart relatively large sidewall panels. The at least one perforated line in the first layer of the one of the at least two spaced apart relatively small sidewall panels may have end portions terminating in the another fold line so that, when the at least one perforated line in the first layer is broken, a pivotal tab is formed. The at least one perforated line in the second layer of the one of the at least two spaced apart relatively small sidewall panels may have end portions terminating in the another fold line so that, when the at least one perforated line in the second layer is broken, a pour spout having a pivotal central body portion and two wing portions is formed. The tab portion and the central body portion may be secured together for simultaneous pivotal movement.

Also disclosed herein is a carton assembly including at least one first layer of material and at least one second layer of material that is discrete from the first layer of material. The carton assembly may have at least a first carton blank condition and a second erected carton condition. In the first carton blank condition, the first layer of material and the second layer of material may be substantially flat and the first layer of material may be parallel to and directly adjacent the second layer of material. In the second erected carton condition the first layer of material and the second layer of material may be formed into an erected carton; and at least one corner post is formed within the erected carton, the at least one corner post including at least a portion of the first layer of material and a portion of the second layer of material.

The second layer of material may be at least partially adhered to the first layer of material. The first layer of material may include a layer of paperboard material. The second layer of material may include a layer of paperboard material. A portion of the first layer of material may be spaced from a portion of the second layer of material in the corner post. The erected carton may be an enclosed erected carton having at least a top wall portion, a bottom wall portion and a plurality of side wall portions extending therebetween. The top wall portion, the bottom wall portion and the side wall portions may all be integrally formed from at least the second layer of material. The top wall portion and the bottom wall portion may include the second layer of material but not the first layer of material. The side wall portions may be formed from both the first layer of material and the second layer of material. The first layer of material may have a first thickness, the second layer of material may have a second thickness and the first thickness may be different from the second thickness. The first layer of material may have a first material composition, the second layer of material may have a second material composition and first material composition may be different from the second material composition. The first layer of material may include a first surface and an oppositely disposed second surface thereon. The at least one first cut line may extend into the first layer of material from the first surface but may not reach the second surface. At least one second cut line may extend into the first layer of material from the second surface but may not reach the first surface. The at least one first cut line and at least one the second cut line may be in the corner post. The at least one second cut line may include at least two second cut lines.

Also disclosed herein is a method including providing a carton blank having at least one substantially flat first layer of material and at least one substantially flat second layer of material that is discrete from the first layer of material and that is parallel to and directly adjacent the first layer of material. The method may further include forming at least one corner post including at least a portion of the first layer of material and a portion of the second layer of material by erecting the carton blank into an erected carton.

The second layer of material may be at least partially adhered to the first layer of material. The first layer of material may include a layer of paperboard material. The second layer of material may include a layer of paperboard material. A portion of the first layer of material may be spaced from a portion of the second layer of material in the corner post. The erected carton may be an enclosed erected carton having at least a top wall portion, a bottom wall portion and a plurality of side wall portions extending therebetween. The top wall portion, the bottom wall portion and the side wall portions may all be integrally formed from at least the second layer of material. The top wall portion and the bottom wall portion may include the second layer of material but not the first layer of material. The side wall portions may be formed from both the first layer of material and the second layer of material. The first layer of material may have a first thickness, the second layer of material may have a second thickness and the first thickness may be different from the second thickness. The first layer of material may have a first material composition, the second layer of material may have a second material composition and the first material composition may be different from the second material composition. The first layer of material may include a first surface and an oppositely disposed second surface thereon. The at least one first cut line may extend into the first layer of material from the first surface but may not reach the second surface. The at least one second cut line may extend into the first layer of material from the second surface but may not reach the first surface. The at least one first cut line and at least one the second cut line may be in the corner post. The at least one second cut line include at least two second cut lines.

Also disclosed herein is a carton assembly including at least a first layer and a second layer discrete from the first layer. The first layer may have at least one first portion and the second layer may have at least one second portion. The carton assembly may have at least a first condition and a second condition. In the first condition, the first portion of the first layer may substantially flat the first portion of the second layer may be substantially flat and the second portion may be parallel to and directly adjacent the first portion. In the second condition, the first portion may form at least one first corner, the second portion may form at least one second corner the first portion may be spaced from the second portion.

The first corner and the second corner may extend in opposite directions. The second layer of material may be at least partially adhered to the first layer of material. The first layer of material may include a layer of paperboard material. The second layer of material may include a layer of paperboard material. The first layer may have a first thickness, the second layer may have a second thickness and the first thickness may be different from the second thickness. The first layer may have a first material composition, the second layer may have a second material composition and aid first material composition may be different from the second material composition.

Also disclosed herein is a method including providing at least a first layer of material and a discreet second layer of material, forming the first layer of material and the second layer of material into a substantially flat carton blank in which a first portion of the first layer of material is parallel and directly adjacent a second portion of the second layer of material and causing the first portion to form a first corner and the second section to form a second corner by erecting the carton blank into an erected carton. The step of causing the first portion to form a first corner and the second section to form a second corner may include causing the first portion and the second portion to move away from one another.

The step of forming the first layer of material and the second layer of material into a substantially flat carton blank may include at least partially adhering the first layer of material to the second layer of material. The first layer of material may include a layer of paperboard material. The second layer of material may include a layer of paperboard material. The step of providing at least a first layer of material and a discreet second layer of material may include providing the first layer of material having a first thickness and the second layer of material having a second thickness. The first thickness may be different from the second thickness. The step of providing at least a first layer of material and a discreet second layer of material may include providing the first layer of material having a first material composition and the second layer of material having a second material composition. The first material composition may be different from the second material composition.

Also disclosed herein is a carton assembly including at least one first layer at least one second layer. The carton assembly may have at least a first carton blank condition and a second erected carton condition. In the first carton blank condition, the first layer and the second layer may be substantially flat and the first layer may be parallel to and directly adjacent the second layer. In the second erected carton condition, the first layer and the second layer may be formed into an enclosed erected carton having at least a top wall portion, a bottom wall portion and a plurality of side wall portions extending therebetween, at least one corner post may be formed within the erected carton, the at least one corner post being formed from at least a portion of the first layer and a portion of the second layer and the top wall portion, the bottom wall portion and the side wall portions may all be integrally formed from at least the second layer.

The top wall portion and the bottom wall portion may include the second layer but not the first layer. The side wall portions may be formed from both the first layer and the second layer. The second layer may be at least partially adhered to the first layer. The first layer may include a layer of paperboard material. The second layer may include a layer of paperboard material. The first layer may have a first thickness, the second layer may have a second thickness and the first thickness may be different from the second thickness. The first layer may have a first material composition, the second layer may have a second material composition and the first material composition may be different from the second material composition.

DETAILED DESCRIPTION

Figure 1:
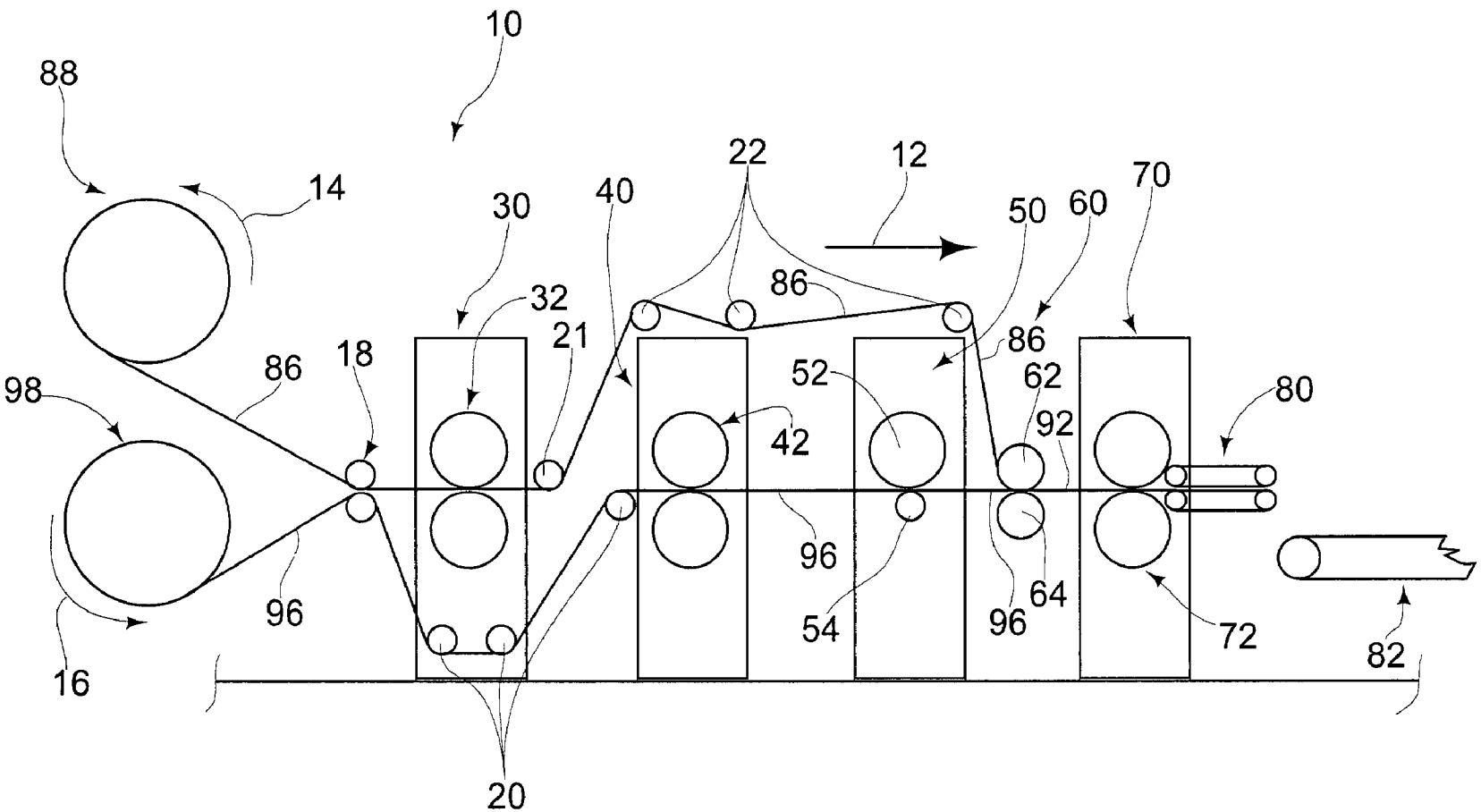
FIG. 1 is a schematic illustration of an exemplary production line.

FIG. 1 schematically illustrates an exemplary production line 10 for producing carton blanks. Generally, production line 10 may be configured to produce carton blanks formed from a plurality (e.g., two) of layers of material. As will be explained in more detail herein, production line 10 may further be configured to allow different cut and/or fold line patterns (such as those made by lines of disruption) to be formed in each of the layers of material in order to optimize the design of the carton blanks formed thereon.

With reference to FIG. 1, production line 10 may include a rotatable first supply roll 88 containing a spirally wound quantity of a first web of material 86 and a rotatable second supply roll 98 containing a spirally wound quantity of a second web of material 96.

Production line 10 may also include a first disrupting station 30, a second disrupting station 40, an adhesive application station 50, a laminating station 60 and a third disrupting station 70, as shown. A first set (e.g., a pair) of guide rollers 18 may be provided between the supply rolls 88, 98 and the first disrupting station 30. A second set of guide rollers 20 may be provided between the first set of guide rollers 18 and the second disrupting station 40. A third set of guide rollers 21, 22 may be provided between the first disrupting station 30 and the laminating station 60, as shown. An exit conveyor 80 may be provided adjacent the third disrupting station 70 and an accumulating conveyor 82 may be located adjacent the exit conveyor 80, as shown.

First disrupting station 30 may include a first disrupting mechanism 32. First disrupting mechanism 32 may be any conventional mechanism for forming one or more lines of disruption in the material (e.g., the web of first material 86).

Second disrupting station 40 may include a second disrupting mechanism 42. Second disrupting mechanism 42 may be any conventional mechanism for forming one or more lines of disruption in the material (e.g., the web of second material 96).

Third disrupting station 70 may include a third disrupting mechanism 72. Third disrupting mechanism 72 may be any conventional mechanism for forming one or more lines of disruption in the material (e.g., the combined web 92 of first material 86 and web of second material 96).

For purposes of the description presented herein, the term "line of disruption" means either a cut line or a fold line formed in the material (or a combination of at least one cut line and at least one fold line). Further, the term "cut line" means either a through cut line (i.e., a cut line extending completely through the material) or a partial cut line (i.e., a cut line beginning at one surface of the material and extending into the material but not reaching the opposite surface of the material). The term "fold line" means a weakened line provided in the material for the purpose of facilitating a folding of the material about the weakened line. The term "fold line" includes, for example, a score line formed with a conventional blunt scoring knife which creates a crushed portion in the material along the desired line of weakness. The term "fold line" also includes, for example, a weakened line formed as a combination of one or more score lines (as discussed above) and one or more cut-through portions in a conventional manner. The term "fold line" also includes, for example, a line of weakness formed in the material by any process for the purpose of facilitating a folding of the material about the line of weakness. The term "line" as used herein includes not only linear lines, but also other types of lines as well, e.g., curved, curvilinear or angularly displaced lines.

Referring again to FIG. 1, first disrupting mechanism 32, second disrupting mechanism 42, and third disrupting mechanism 72 may, for example, be conventional reciprocating cutting and scoring mechanisms. Alternatively, these disrupting mechanisms may be conventional rotary die cutting and scoring mechanisms in which the material is fed between a pair of rollers, as schematically illustrated in FIG. 1. First, second and third disrupting mechanisms 32, 42, 72 may, for example, each be a conventional rotary die cutting and scoring mechanism of the type manufactured and marketed by Bernal. The disrupting stations 30, 40, 70 may be substantially similar to those described in U.S. Pat. Nos. 4,781,317 and 4,757,930 and other machines well documented in literature.

Adhesive application station 50 may include an adhesive application mechanism 52 and a guide roller 54 as schematically illustrated in FIG. 1. Adhesive application mechanism 52 may be any mechanism capable of applying adhesive to material passing through the station 50 (e.g., the web of second material 96). Adhesive application mechanism may, for example, be a conventional gravure adhesive application device that is capable of applying adhesive in a pre-determined pattern.

Laminating station 60 may include a pair of rollers 62, 64, as schematically illustrated in FIG. 1, between which multiple layers of material (e.g., the first web of material 86 and the second web of material 96) may pass.

Exit conveyor 80 may be any device capable of taking individual carton blanks from the third disrupting station 70 and feeding them sequentially onto the accumulating conveyor 82. Exit conveyor 80 and accumulating conveyor 82 may, for example, be conventional conveying devices as will be understood by persons skilled in the carton blank manufacturing art.

During operation, the first web of material 86 and the second web of material 96 may move through the production line 10 in a direction indicated by the arrow 12. The first web of material 86 may be unwound from the supply roll 88 as the supply roll 88 rotates in the direction indicated by an arrow 14. In a similar manner, the second web of material 96 may be unwound from the supply roll 98 as the supply roll 98 rotates in the direction indicated by an arrow 16.

After leaving the supply rolls 88, 98, both the first and second webs of material may pass between the first set of guide rollers 18. Thereafter, the first web of material 86 may enter the first disrupting station 30. Within the first disrupting station 30, at least one line of disruption is formed in a repetitive pattern in the first web of material 86. After leaving the first disrupting station 30, the first web of material 86 may bypass the second disrupting station 40 and the adhesive application station 50, via the third set of guide rollers 21, 22, and enter the laminating station 60.

After leaving the first set of guide rollers 18, the second web of material 96 may bypass the first disrupting station 30, via the second set of guide rollers 20, and enter the second disrupting station 40. Within the second disrupting station 40, at least one line of disruption is formed in a repetitive pattern in the second web of material 96. After leaving the second disrupting station 40, the second web of material may enter the adhesive application station 50 where adhesive may be applied, for example, in a specific pattern to the upper surface (as viewed in FIG. 1) of the second web of material 96. After leaving the adhesive application station 50, the second web of material may enter the laminating station 60.

As can appreciated from FIG. 1, the first web of material 86 and the second web of material 96 may meet at the laminating station 60. Within the laminating station 60, both webs of material pass between the rollers 62 and 64. Pressure applied by the rollers 62 and 64 facilitates adhesion between the first web of material 86 and the second web of material 96 (due to the adhesive previously applied to the second web of material 96 in the adhesive application station 50) and results in a combined web of material 92 exiting the laminating station 60.

After exiting the laminating station 60, the combined web of material 92 may enter the third disrupting station 70. Within the third disrupting station 70, the combined web of material 92 may be cut into individual carton blanks and at least one additional line of disruption may also be formed in the combined web of material 92 in a manner that will be described herein.

The individual carton blanks exiting the third disrupting station 70 may be conveyed by the exit conveyor 80 and stacked on the accumulation conveyor 82 where they may then be placed into use or stored for later use as may be desired.

As can be appreciated, the production line 10 allows the formation of carton blanks having multiple layers of material. Further, because a separate disrupting station is provided for each layer, each layer may have a pattern of one or more lines of disruption that is different from the pattern formed in another layer. This arrangement facilitates the design of many types of carton blanks as will be explained in more detail herein.

As can further be appreciated, the ability to form carton blanks having multiple layers of material allows, for example, a relatively more expensive material to be used for one of the layers of the blank (such as an outer layer that would usually be visible to a consumer of a carton formed from the carton blank) and a relatively less expensive material to be used for another layer (such as an inner layer that usually would not be visible to a consumer). Therefore, this inner layer could be formed from a relatively less expensive material that may also provide additional strength to the carton but which may have a less aesthetically pleasing appearance. Accordingly, the ability to form carton blanks having multiple layers of material also allows the overall material cost for a carton to be relatively reduced.

As discussed above, the outer and inner layers of the blank may have differing material compositions. The outer and inner layers may further have different thicknesses if desired. For example, the first web of material 86 may be thinner than the second web of material 96.

It is noted that the specific configuration of the production line 10 illustrated in FIG. 1, and described above, is provided for exemplary purposes only. In practice, the production line 10 could have alternate configurations, as will be readily appreciated by those skilled in the carton blank making art. It is noted, for example, that although supply rolls 88, 98 of previously manufactured material are illustrated in FIG. 1, the production line 10 could instead be part of a larger production facility in which material would be fed directly into the production line 10 from a previous manufacturing step (e.g., plastic extrusion or paperboard manufacture, printing, prelamination of a layer such as clay board, etc.) rather than from supply rolls. It is further noted that, although the production line 10 has been described herein in association with only two webs of material, it could readily be adapted to function with three or more webs of material simply by adding additional stations such as disrupting stations, adhesive application stations and guide rolls as needed.

Figure 2:
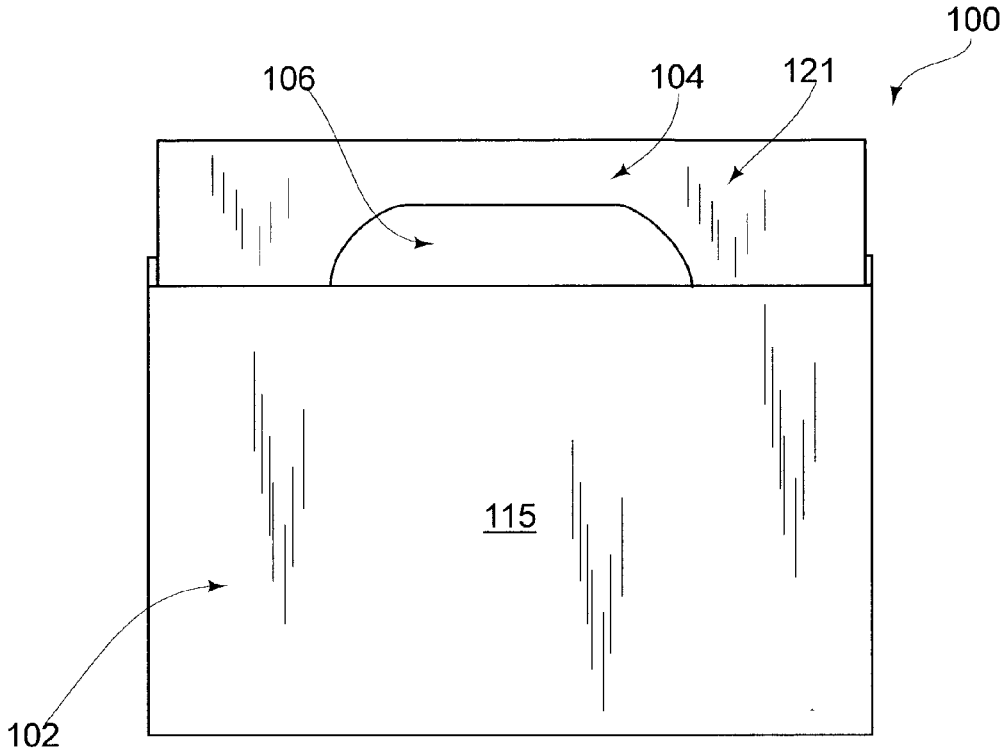
FIG. 2 is an elevational view of an exemplary carton.
Figure 3:
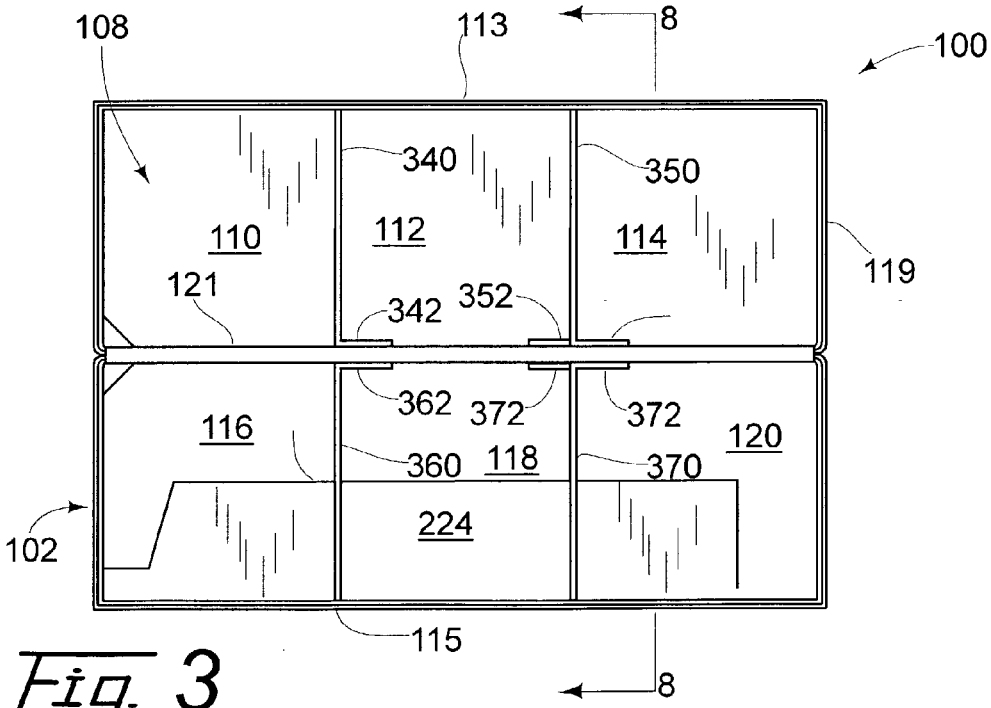
FIG. 3 is a top plan view of the carton of FIG. 2.

One exemplary type of carton that may be manufactured with the production line 10 described above is a basket carrier. FIGS. 2 and 3 illustrate an exemplary basket carrier 100 in an erected condition. Referring to FIG. 2, basket carrier 100 may generally include a body portion 102 and a handle portion 104. The body portion 102 may include a pair of substantially parallel outer side walls 113, 115, FIG. 3. Body portion 102 may further include a pair of substantially parallel outer end walls 117, 119 which may be substantially perpendicular to the outer side walls 113, 115. An inner wall 121 may be located in between the outer side walls 113, 115 and may be substantially parallel thereto. Handle portion 104 may form the upper part of the inner wall 121 and may include an opening 106 to facilitate engagement by a human hand when carrying the basket carrier 100.

Referring to FIG. 3, the body portion 102 of the basket carrier 100 may include a plurality of compartments or pockets 108, such as the individual pockets 110, 112, 114, 116, 118, 120, as shown. The pockets may be used to house items to be carried by basket carrier, e.g., beverage bottles or cans, in a conventional manner. The pockets 108 may be separated by a plurality of divider walls or sections 340, 350, 360, 370. As can be seen from FIG. 2 (and as will be explained in further detail herein), the outer side walls 113, 115 may each be formed form a plurality (e.g., two) of material layers. Each of the divider sections 340, 350, 360, 370 may, for example, be integrally formed from only one of the layers of the outer side walls 113, 115.

Figure 4:
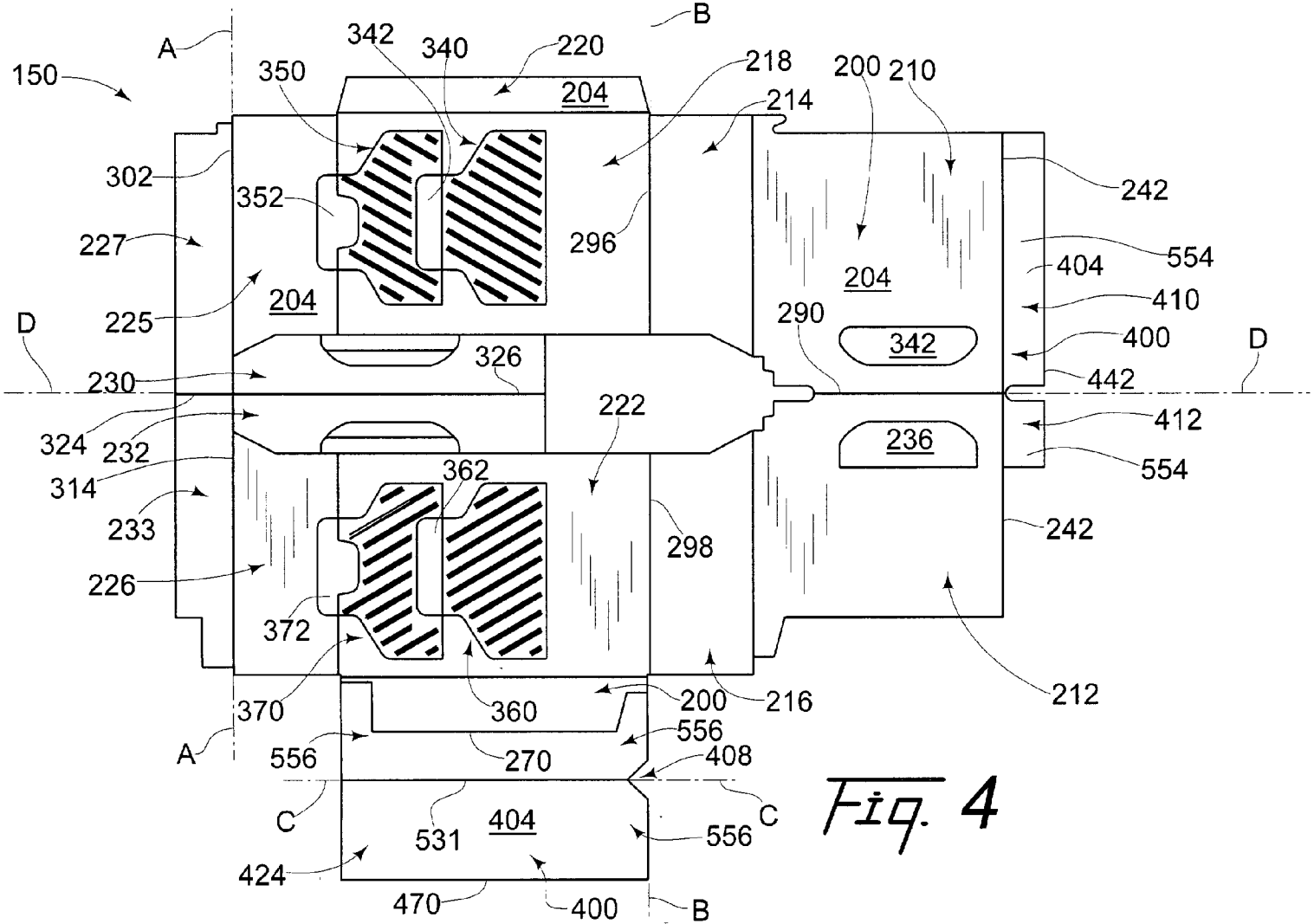
FIG. 4 is a plan view of a blank that may be used in the manufacture of the carton of FIGS. 2 and 3, viewed from an interior surface thereof.
Figure 5:
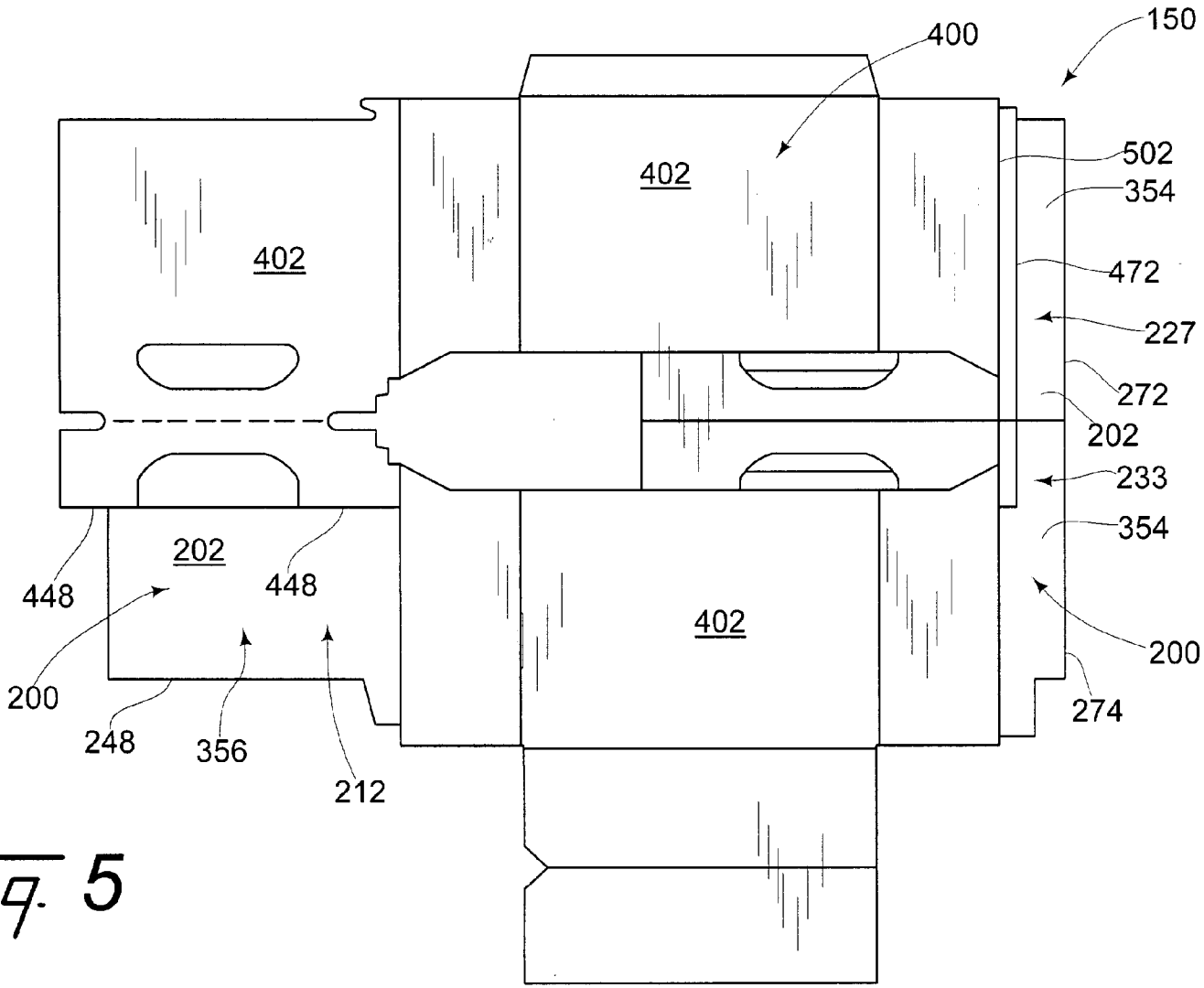
FIG. 5 is a plan view of the blank of FIG. 4, viewed from an exterior surface thereof.

FIGS. 4 and 5 illustrate a blank 150 from which the basket carrier 100 may be erected. The blank 150 may be constructed from a plurality of layers of material, e.g., paperboard material. The blank 150 may, for example, be constructed of two layers of material, e.g., an inner layer 200 and an outer layer 400. Inner layer 200 is illustrated individually in FIG. 6. Outer layer 400 is illustrated individually in FIG. 7.

Inner layer 200 may, for example, be formed from a relatively rigid paperboard material such as virgin kraft, recycled or SBS ("solid bleached sulfite") material and may have a thickness, for example, of between about 0.004 and 0.015 inch. Alternatively, inner layer 200 may be formed from any relatively rigid material such as a thick film plastic material.

Figure 6:
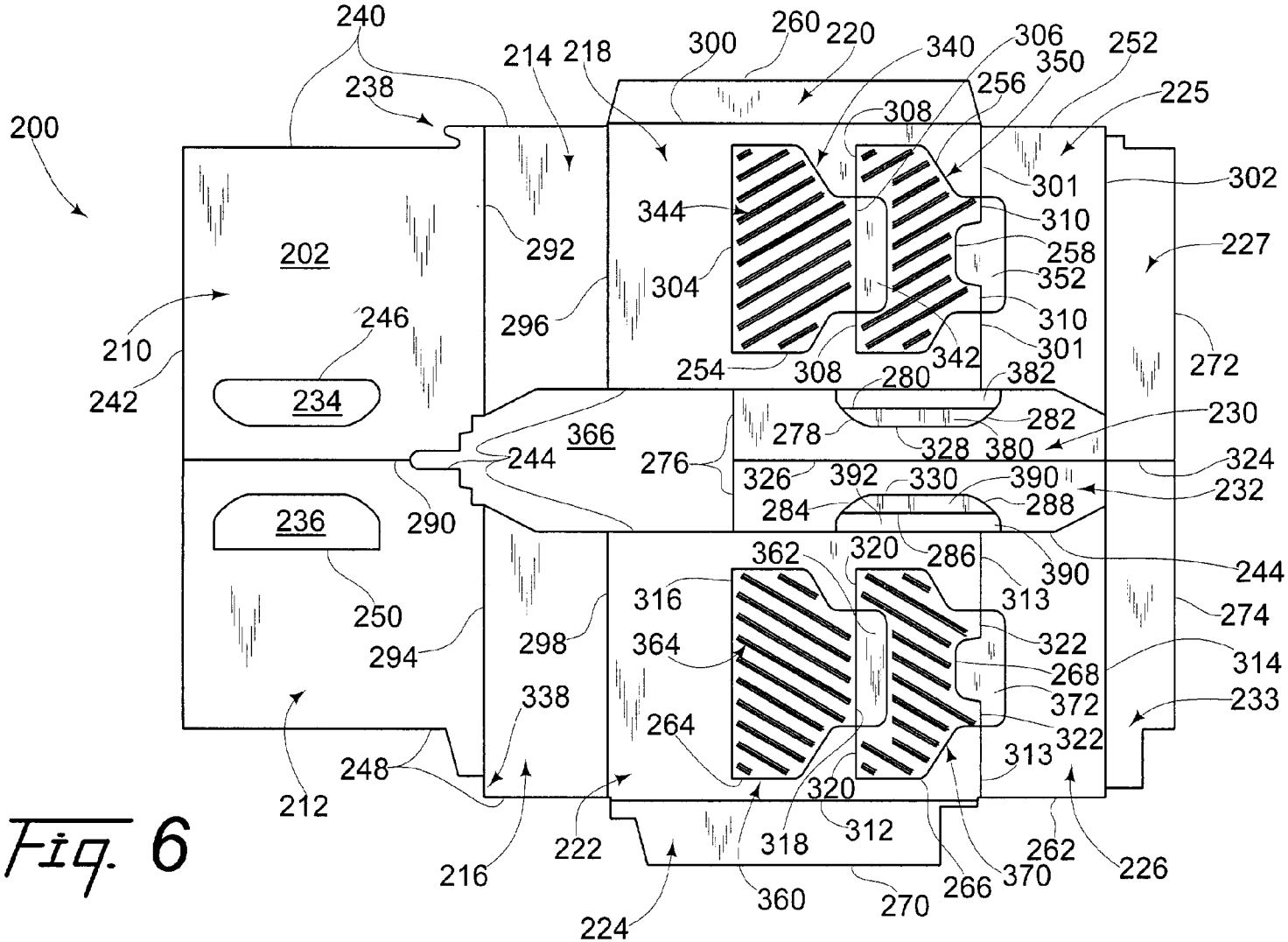
FIG. 6 is a plan view of an inner layer of the blank of FIGS. 4 and 5, viewed from the exterior surface thereof.

Referring now to FIG. 6, inner layer 200 may include an outer surface 202 and an oppositely disposed inner surface 204, FIG. 4. The inner layer 200 may also include suitable graphics thereon, if desired. With further reference to FIG. 6, a first inner panel 210 may generally be bounded by an inner cut line 240, an inner cut line 242, an inner cut line 244, an inner fold line 290 and an inner fold line 292. A first inner handle opening 234 may be defined within the first inner panel 210 by an inner cut line 246. Inner cut line 240 may include a catch section 238 in the first inner panel 210.

A second inner panel 212 may generally be bounded by an inner cut line 248, inner cut line 242, inner cut line 244, inner fold line 290 and an inner fold line 294. A second inner handle opening 236 may be defined within the second inner panel 212 by an inner cut line 250.

A third inner panel 214 may generally be bounded by the inner cut line 240, the inner fold line 292, the inner cut line 244 and an inner fold line 296.

A fourth inner panel 216 may generally be bounded by the inner cut line 248, the inner fold line 294, the inner cut line 244 and an inner fold line 298. Inner cut line 248 may include a notch portion 338 in the second inner panel 212 and extending between the first inner panel 212 and the fourth inner panel 216.

A fifth inner panel 218 may generally be bounded by an inner fold line 300, the inner fold line 296, the inner cut line 244, an inner fold line 301 and an inner cut line 256. Fifth inner panel 218 may include first and second divider sections 340, 350 as shown. Divider section 340 may be defined by an inner fold line 304 and an inner cut line 254 which may extend to both ends of the inner fold line 304. Divider section 340 may include a tab section 342 separated from the remainder of the divider section 340 by an inner fold line 306. Each of the divider sections 340, 350 may include a plurality of score lines formed therein, such as the score lines 344 referenced in the divider section 340.

Divider section 350 may be defined by a pair of inner fold lines 308, the inner cut line 254 extending therebetween and the inner cut line 256 which may extend to the outer edges of the pair of inner fold lines 308. Divider section 350 may include a tab section 352 separated from the remainder of the divider section 350 by a pair of inner fold lines 310 and an inner cut line 258 extending therebetween as shown.

A sixth inner panel 220 may be generally bounded by the inner fold line 300 and an inner cut line 260 extending to the inner fold line 300 at both ends thereof.

A seventh inner panel 222 may generally be bounded by an inner fold line 312, the inner fold line 298, the inner cut line 244, an inner fold line 313 and an inner cut line 266. Seventh inner panel 222 may include third and fourth divider sections 360, 370, as shown. Third and fourth divider sections 360, 370 may be substantially identical to the first and second divider sections 340, 350 previously described.

Specifically, divider section 360 may be defined by an inner fold line 316 and an inner cut line 264 which may extend to both ends of the inner fold line 316. Divider section 360 may include a tab section 362 separated from the remainder of the divider section 360 by an inner fold line 318. Each of the divider sections 360, 370 may include a plurality of score lines formed therein, such as the score lines 364 referenced in the divider section 360.

Divider section 370 may be defined by a pair of inner fold lines 320, the inner cut line 264 extending therebetween and the inner cut line 266 which may extend to the outer edges of the pair of inner fold lines 320. Divider section 370 may include a tab section 372 separated from the remainder of the divider section 370 by a pair of inner fold lines 322 and an inner cut line 268 extending therebetween.

An eighth inner panel 224 may be generally bounded by the inner fold line 312 and an inner cut line 270 extending to the inner fold line 312 at both ends thereof.

A ninth inner panel 225 may be generally bounded by the inner fold line 301, the inner cut line 256, an inner cut line 252, an inner fold line 302 and the inner cut line 244.

A tenth inner panel 226 may be generally bounded by the fold line 313, the inner cut line 266, an inner cut line 262, a fold line 314 and the inner cut line 244.

An eleventh inner panel 227 may be generally bounded by the inner fold line 302, the inner cut line 252, an inner cut line 272 and an inner fold line 324.

A twelfth inner panel 230 may be generally bounded by an inner cut line 276, the inner cut line 244, the inner fold line 302 and an inner fold line 326. Twelfth inner panel 230 may include a tab portion 380 generally defined by an inner fold line 328, an inner cut line 278, an inner cut line 280 and an inner cut line 282. An opening 382 may be defined by the inner cut line 280, the inner cut line 278, the inner cut line 244 and the inner cut line 282.

An opening 366 may be defined by the inner cut line 244 and the inner cut line 276.

A thirteenth inner panel 232 may be generally bounded by the inner cut line 276, the inner cut line 244, the inner fold line 314 and the inner fold line 326. Thirteenth inner panel 232 may include a tab portion 390 generally defined by an inner fold line 330, an inner cut line 284, an inner cut line 286 and an inner cut line 288. An opening 392 may be defined by the inner cut line 286, the inner cut line 284, the inner cut line 244 and the inner cut line 288.

A fourteenth inner panel 233 may be generally bounded by the inner fold line 314, the inner fold line 324 an inner cut line 274 and the inner cut line 262.

Outer layer 400 may, for example, be formed from a relatively rigid paperboard material such as virgin kraft, recycled or SBS ("solid bleached sulfite") material and may have a thickness, for example, of between about 0.004 and 0.015 inch. Alternatively, outer layer 200 may be formed from any relatively rigid material such as a thick film plastic material.

Figure 7:
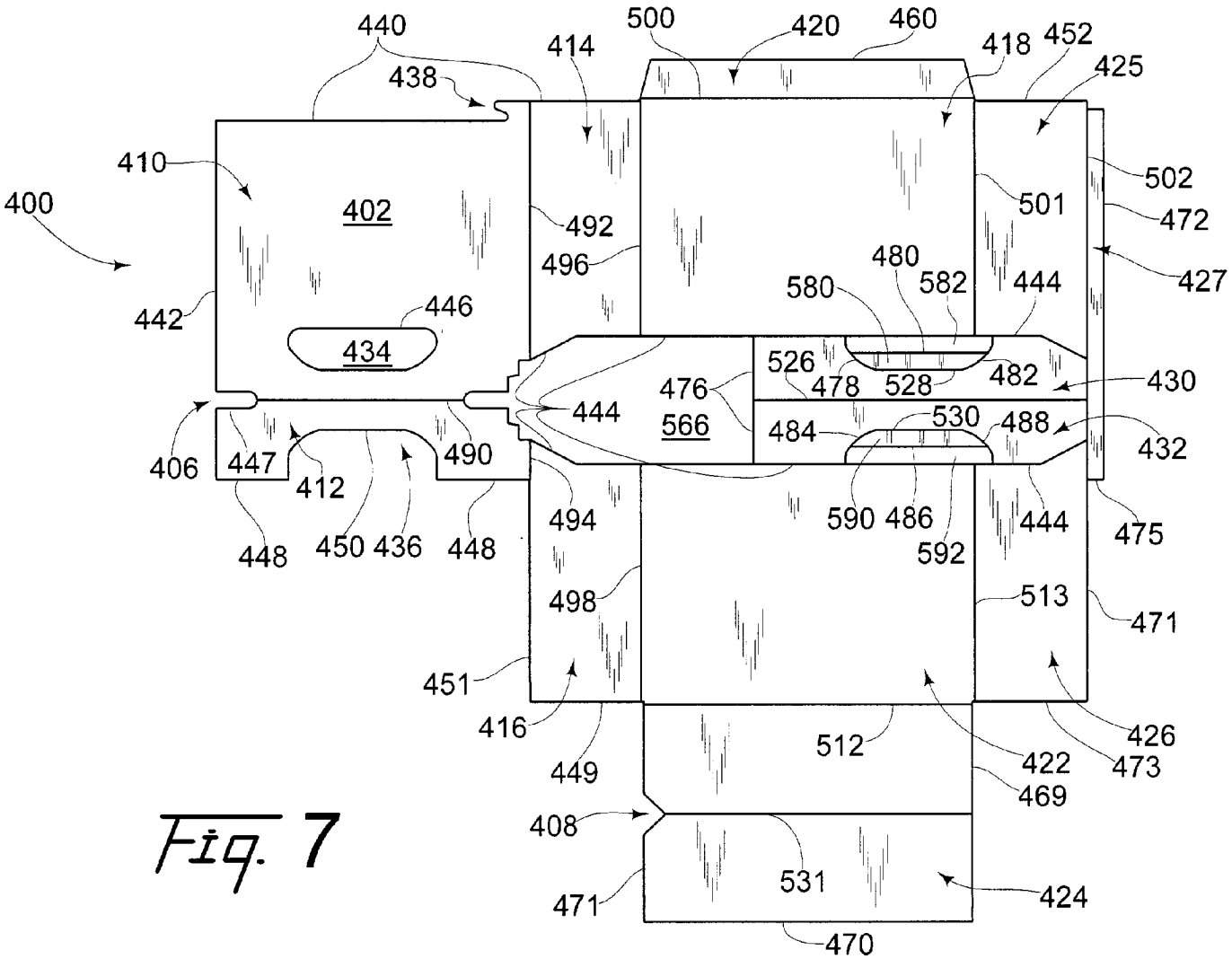
FIG. 7 is a plan view of an outer layer of the blank of FIGS. 4 and 5, viewed from the exterior surface thereof.

With reference to FIG. 7, outer layer 400 may include an outer surface 402 and an oppositely disposed inner surface 404, FIG. 4. The outer surface 402 may include suitable graphics thereon, if desired, since the outer surface 402 of the outer layer 400 will make up at least the majority of the exterior surface of the assembled basket carrier 100, as will be discussed in further detail herein. Such graphics may include text and/or images and may be applied using any conventional means, such as a printing press. Alternatively, outer layer 400 may be a laminated structure having, for example, a paperboard layer as described above and a plastic film layer laminated thereto in a conventional manner. In this case, the film layer may be provided with graphics. Examples of plastic film laminated blanks and cartons made therefrom are disclosed, for example, in U.S. Pat. No. 5,794,811 and U.S. Pat. No. 5,857,614, both of which are hereby specifically incorporated by reference for all that is disclosed therein.

With further reference to FIG. 7, a first outer panel 410 may generally be bounded by an outer cut line 440, an outer cut line 442, an outer cut line 444, an outer fold line 490 and an outer fold line 492. A first outer handle opening 434 may be defined within the first outer panel 410 by an outer cut line 446. Outer cut line 440 may include a catch section 438 in the first outer panel 410.

A second outer panel 412 may generally be bounded by an outer cut line 448, outer cut line 442, outer cut line 444, outer fold line 490 and an outer fold line 494. A second outer handle opening 436 may be defined within the second outer panel 412 by an outer cut line 450. Outer cut line 442 may include a generally U-shaped notch 406 defined by a generally U-shaped outer cut line 447 located between the first outer panel 410 and the second outer panel 412.

A third outer panel 414 may generally be bounded by the outer cut line 440, the outer fold line 492, the outer cut line 444 and an outer fold line 496.

A fourth outer panel 416 may generally be bounded by an outer cut line 449, an outer cut line 451, the outer fold line 494, the outer cut line 444 and an outer fold line 498.

A fifth outer panel 418 may generally be bounded by the outer fold line 496, an outer fold line 500, an outer fold line 501 and the outer cut line 444.

A sixth outer panel 420 may be generally bounded by the outer fold line 500 and an outer cut line 460 extending to the outer fold line 500 at both ends thereof.

A seventh outer panel 422 may generally be bounded by an outer fold line 512, the outer fold line 498, the outer cut line 444, and an outer fold line 513.

An eighth outer panel 424 may be generally bounded by the outer fold line 512 an outer cut line 469, an outer cut line 470 and an outer cut line 471, as shown. Outer cut line 471 may include a notch portion 408 therein. An outer fold line 531 may extend from the notch 408 to the outer cut line 469 as shown.

A ninth outer panel 425 may be generally bounded by the outer fold line 501, an outer cut line 452, an outer fold line 502 and the outer cut line 444.

A tenth outer panel 426 may be generally bounded by the outer fold line 513, the outer cut line 444, the outer fold line 502 an outer cut line 471 and an outer cut line 473.

An eleventh outer panel 427 may be generally bounded by the outer fold line 502, the outer cut line 452, an outer cut line 472 and an outer cut line 475.

A twelfth outer panel 430 may be generally bounded by an outer cut line 476, the outer cut line 444, the outer fold line 502 and an outer fold line 526. Twelfth outer panel 430 may include a tab portion 580 generally defined by an outer fold line 528, an outer cut line 478, an outer cut line 480 and an outer cut line 482. An opening 582 may be defined by the outer cut line 480, the outer cut line 478, the outer cut line 444 and the outer cut line 482.

An opening 566 may be defined by the outer cut line 444 and the outer cut line 476.

A thirteenth outer panel 432 may be generally bounded by the outer cut line 476, the outer cut line 444, the outer fold line 502 and the outer fold line 526. Thirteenth outer panel 432 may include a tab portion 590 generally defined by an outer fold line 530, an outer cut line 484, an outer cut line 486 and an outer cut line 488. An opening 592 may be defined by the outer cut line 486, the outer cut line 484, the outer cut line 444 and the outer cut line 488.

As previously discussed, FIGS. 4 and 5 illustrate the inner layer 200 and the outer layer 400 assembled into a multi-layer blank 150. More specifically, FIG. 4 illustrates the blank 150 as viewed from the inner surface thereof, i.e., the surface that will make up the majority of the interior surface of the basket carrier 100, FIGS. 2 and 3. FIG. 5, on the other hand, illustrates the blank 150 as viewed from the outer surface thereof, i.e., the surface that will make up the exterior surfaces of the basket carrier 100.

In the assembled condition illustrated in FIGS. 4 and 5, the inner layer 200 may be superposed with the outer layer 400 in an aligned manner. Specifically, for example, the inner layer fold lines 290, 292, 296, 298, 300, 301, 302, 312, 326, 328, 330 (FIG. 6) may be aligned with the outer layer fold lines 490, 492, 496, 498, 500, 501, 502, 512, 526, 528, 530, respectively (FIG. 7). Further, the inner layer cut lines 240, 244, 246, 250, 260, 276, 278, 280, 282, 284, 286 and 288 (FIG. 6) may be aligned with the outer layer cut lines 440, 444, 446, 450, 460, 476, 478, 480, 482,-484, 486 and 488, respectively (FIG. 7). The inner layer fold line 294 may be aligned with the outer layer cut line 451 and the inner layer fold line 314 may be aligned with the outer layer cut line 471.

Although in most areas, the blank 150 has a two-layer configuration, in selected areas of the blank, only a single layer may exist, as will now be discussed. Referring, for example, to FIG. 4, it can be seen that, because the inner layer cut line 242 is not aligned with the outer layer cut line 442, a portion 554 of the outer layer 400 extends beyond the inner layer 200. Specifically, the portion 554 includes a part of the outer layer first panel 410 and a part of the outer layer second panel 412. Accordingly, in the area of the portion 554, the blank 150 may be a one layer structure composed of part of the outer layer 400.

In a similar manner, with reference again to FIG. 4, it can be seen that, because the inner layer cut line 270 is not aligned with the outer layer cut line 470, a portion 556 of the outer layer 400 extends beyond the inner layer 200. Specifically, the portion 556 may be composed of a part of the outer layer eighth panel 424. Accordingly, in the area of the portion 556, the blank 150 may be a one layer structure composed of part of the outer layer 400. Accordingly, the outer layer 400 may extend beyond the inner layer 200, for example, in the areas 554 and 556.

The inner layer 200 may also extend beyond the outer layer 400 in some areas of the carton blank 150. Referring, for example, to FIG. 5, it can be seen that, because the outer layer cut line 472 is not aligned with the inner layer cut lines 272, 274, a portion 354 of the inner layer 200 extends beyond the outer layer 400. Specifically, the portion 354 includes a part of the inner layer eleventh panel 227 and a part of the inner layer fourteenth panel 233. Accordingly, in the area of the portion 354, the blank 150 may be a one layer structure composed of part of the inner layer 200.

In a similar manner, with reference again to FIG. 5, it can be seen that, because the inner layer cut line 248 is not aligned with the outer layer cut line 448, a portion 356 of the inner layer 200 extends beyond the outer layer 400. Specifically, the portion 356 is composed of a part of the inner layer second panel 212. In the area of the portion 356, thus, the blank 150 may be a one layer structure composed of part of the inner layer 200. Accordingly, the inner layer 200 may extend beyond the outer layer 400, for example, in the areas 354 and 356.

To form the carton blank 150, the inner layer 200 and outer layer 400 may be secured to one another by any conventional mechanism. The layers 200, 400 may, for example, be attached using an adhesive such as glue. The layers 200, 400 further may be laminated to one another by applying an adhesive pattern to either the inner surface 404 of the outer layer 400 or to the outer surface 202 of the inner layer 200 or to both. Such adhesive may, for example, be applied to substantially the entire area of the surfaces discussed with the exception of the non-overlap areas, e.g., 354, 356, FIG. 5 and 554, 556, FIG. 4, as discussed above. Adhesive may also be omitted from the areas defined by the divider sections 340, 350, 360, 370, FIGS. 4 and 6, for reasons that will be discussed herein. It is noted that the terminology "laminate", "laminated" or the like, as used herein, is intended to mean bonding two or more layers together such that the layers substantially act like a single layer.

Having described the blank 150, various methods for manufacturing the blank will now be discussed. The blank inner layer 200 and outer layer 400 may, for example, each be made by a conventional blanking process in which the desired lines of disruption, as illustrated in the drawings and discussed above, may be made. Thereafter, the two layers 200, 400 may be laminated together using, for example, a conventional pick and place machine or a folder-gluer machine or the layers may be aligned and laminated by hand.

Alternatively, the blank 150 may be manufactured in a relatively more efficient manner using the production line 10 illustrated in FIG. 1. Specifically, for example, the supply roll 88 may contain the desired material from which the outer layer 400 (FIG. 7) is formed and the supply roll 98 may contain the desired material from which the inner layer 200 (FIG. 6) is formed. With further reference to FIG. 1, the first web of material 86 may be unwound from the supply roll 88 and fed into the first disrupting station 30. In the first disrupting station 30, some of the lines of disruption illustrated in FIG. 7 may be applied, as will be further described herein. The second web of material 96 may be unwound from the supply roll 98 and fed into the second disrupting station 40. In the second disrupting station 40, some of the lines of disruption illustrated in FIG. 6 may be applied, as will be further described herein. Thereafter, adhesive may be selectively applied to the web of material 96 in the adhesive application station 50. The webs 86 and 96 may then be joined together in the laminating station 60. Thereafter, the combined web of material 92 may enter the third disrupting station 70. The third disrupting station may apply to the combined web 92 the lines of disruption illustrated in FIGS. 6 and 7 that were not previously applied in the stations 30 and 40. Further, the combined web 92 may be separated into individual carton blanks, such as the blank 150, FIGS. 4 and 5, in the third disrupting station 70.

Figure 9:
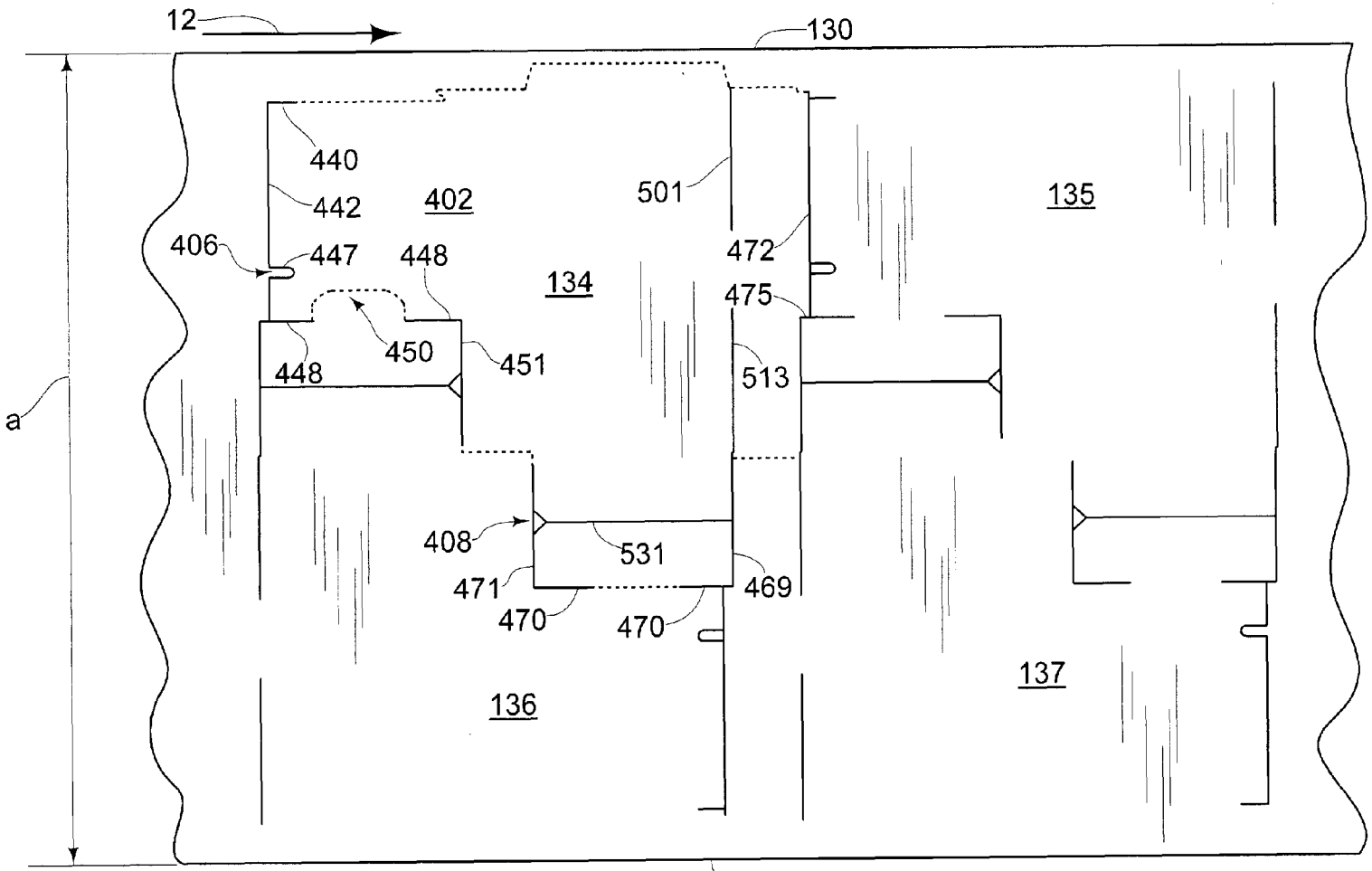
FIG. 9 is a schematic plan illustration showing a line of disruption pattern that may be applied by a disrupting station in the production line of FIG. 1; the dashed lines are representative of the blank ans are provided for illustrative purposes only.

FIG. 9 illustrates a portion of the web of material 86 and the lines of disruption that may be made therein by the first disrupting station 30. As previously discussed, the first disrupting station 30 may apply some of the outer lines of disruption to the web 86 as depicted in FIG. 7. The remaining lines of disruption may be added by the third disrupting station 70 as will be explained in further detail herein.

Referring again to FIG. 9, web 86 may have a first edge 130, a second edge 132 and a width "a" extending therebetween. The arrow 12 indicates the direction of movement of the web 86 through the production line 10. Web 86 may include two disruption patterns across the width "a" of the web, with four such disruption patterns 134, 135, 136, 137 being illustrated in FIG. 9. It is to be understood, of course, that, although only four disruption patterns are illustrated in FIG. 9, the disruption patterns will continue to repeat along the length of the web 86. It is noted that dashed lines are provided in FIG. 9 in order to generally indicate the outer boundaries of the eventual completed blank. It is to be understood that these dashed lines do not signify any structure with respect to FIG. 9, but are merely provided for purposes of visual interpretation and referencing.

The lines of disruption applied to the web 86 by the first disrupting station 30 will be described only with respect to the disruption pattern 134 since the remaining disruption patterns may be substantially identical thereto. With reference to FIGS. 7 and 9, the first disrupting station may apply the outer fold lines 501, 513 and 531 to the web 86. The first disrupting station may also apply the outer cut lines 442, 447, 448, 469, 472, 475 and a portion of the outer cut lines 440, 451, 470 and 471 to the web 86.

Figure 10:
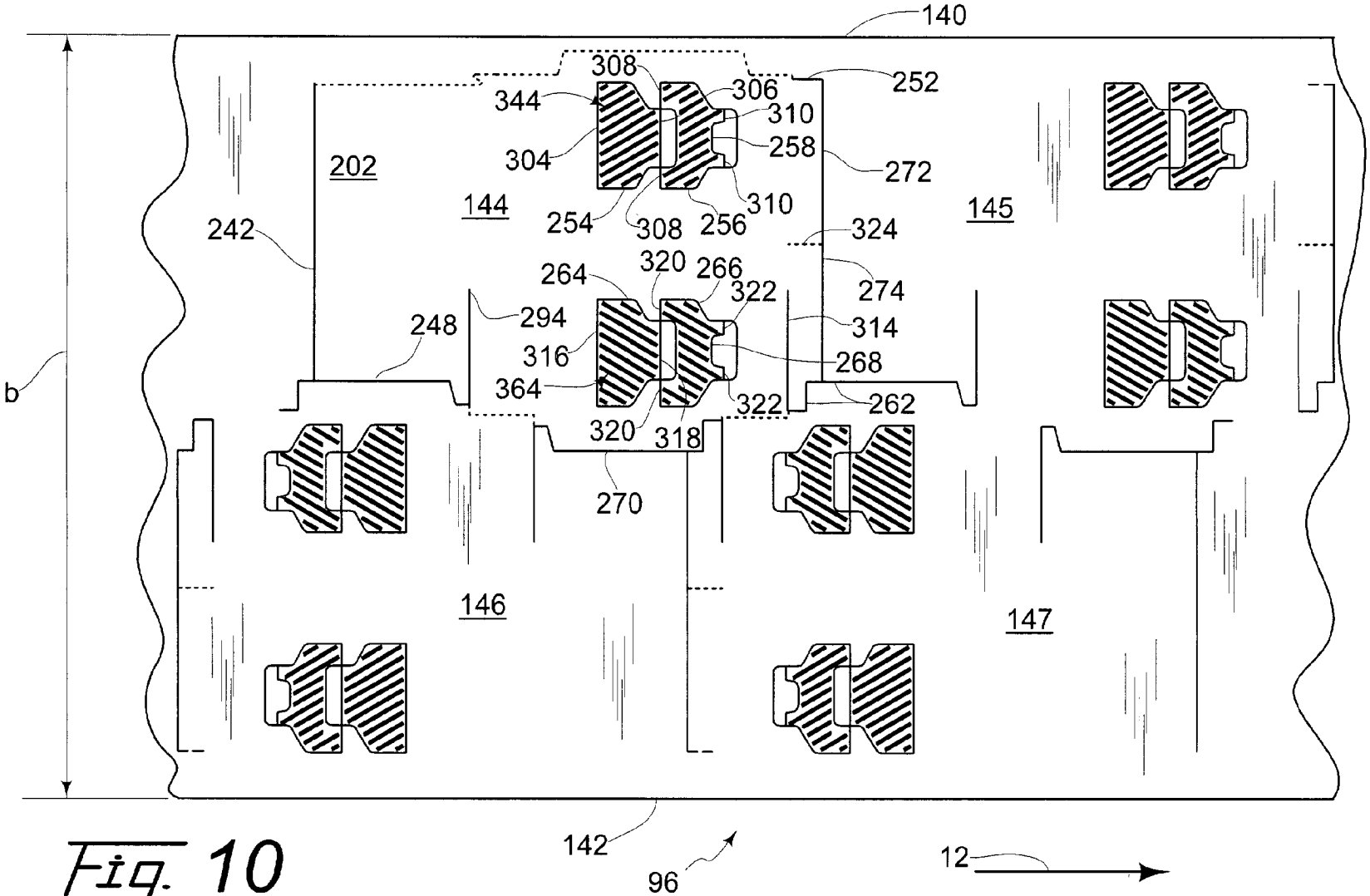
FIG. 10 is a schematic plan illustration showing a line of disruption pattern that may be applied by another disrupting station in the production line of FIG. 1; the dashed lines are representative of the blank ans are provided for illustrative purposes only.

FIG. 10 illustrates a portion of the web of material 96 and the lines of disruption that may be made therein by the second disrupting station 40. As previously discussed, the second disrupting station 40 may apply some of the inner lines of disruption depicted in FIG. 6 to the web 96. The remaining lines of disruption may be added by the third disrupting station 70 as will be explained in further detail herein.

Referring again to FIG. 10, web 96 may have a first edge 140, a second edge 142 and a width "b" extending therebetween. The arrow 12 indicates the direction of movement of the web 96 through the production line 10. Web 96 may include two disruption patterns across the width "b" of the web, with four such disruption patterns 144, 145, 146, 147 being illustrated in FIG. 10. It is to be understood, of course, that, although only four disruption patterns are illustrated in FIG. 10, the disruption patterns will continue to repeat along the length of the web 96. It is noted that dashed lines are provided in FIG. 10 in order to generally indicate the outer boundaries of the eventual completed blank. It is to be understood that these dashed lines do not signify any structure with respect to FIG. 10, but are merely provided for purposes of visual interpretation and referencing.

The lines of disruption applied to the web 96 by the second disrupting station 40 will be described only with respect to the disruption pattern 144 since the remaining disruption patterns may be substantially identical thereto. With reference to FIGS. 6 and 10, the second disrupting station 40 may apply the inner fold lines 304, 306, 308, 310, 316, 318, 320, 322, 324 and a portion of the inner fold lines 294, 314 to the web 96. The second disrupting station 40 may also apply the inner cut lines 242, 254, 256, 258, 264, 266, 268, 272, 274 and a portion of the inner cut lines 248, 252, 262 and 270 to the web 96. The second disrupting station may also apply the score lines 344, 364 to the web 96.

Figure 11:
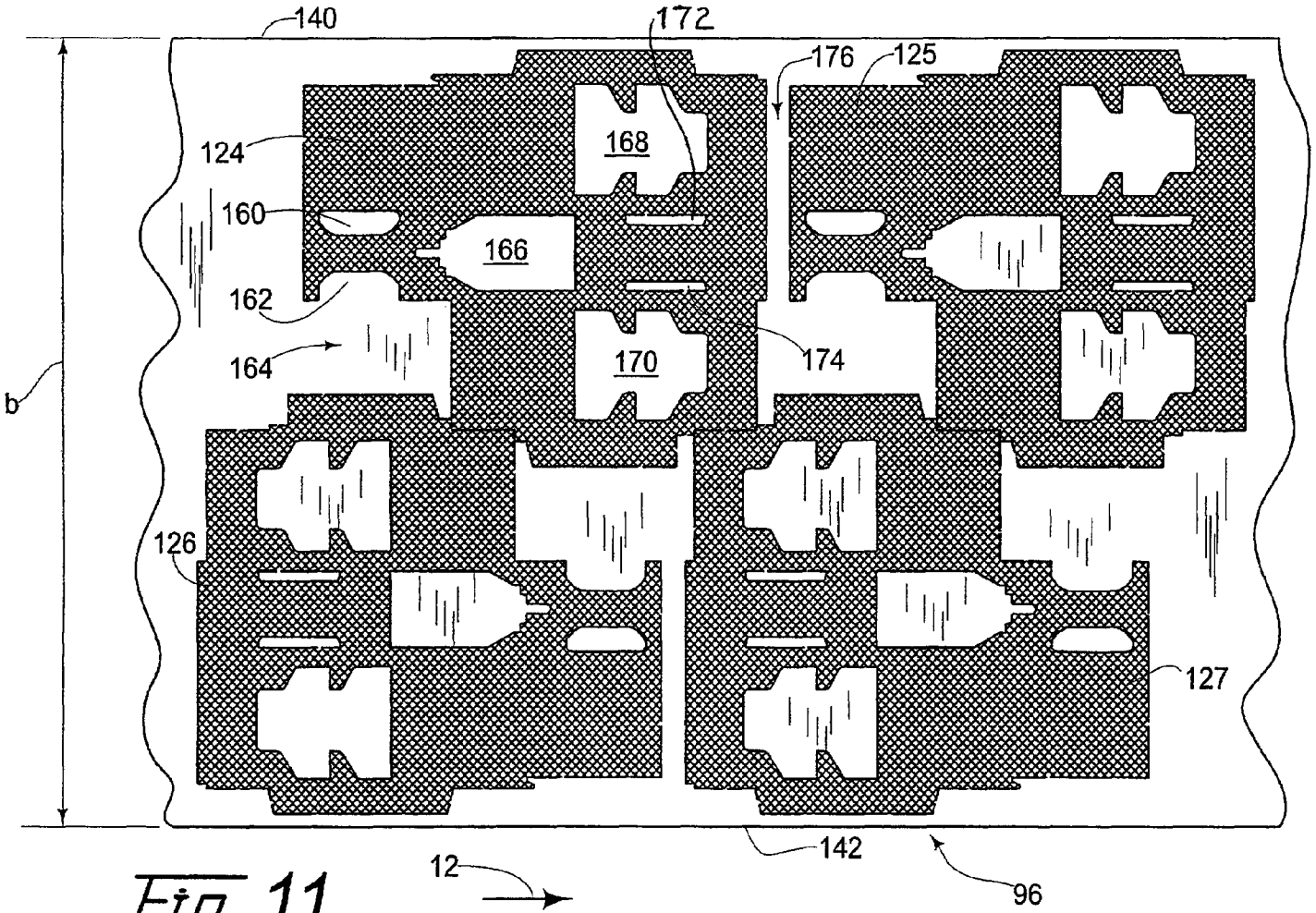
FIG. 11 is a schematic plan illustration showing an adhesive pattern that may be applied by an adhesive application station in the production line of FIG. 1.

After leaving the second station 40, the web 96 may enter the adhesive application station 50, FIG. 1. Within the station 50, adhesive may be applied to the outer surface 202 of the web of material 96 in a predetermined pattern. FIG. 11 schematically illustrates a portion of the web of material 96 and the adhesive pattern that is applied thereto by the adhesive application station 50. It is noted that the lines of disruption previously applied to the web 96 by the second disrupting station 40 (as discussed above) are not shown in FIG. 11, for purposes of illustrative clarity. It is noted that the adhesive is described above as being applied to the web of material 96 for descriptive purposes only. Alternatively, the adhesive could be applied instead to the web of material 86 or to both of the webs of material 86 and 96.

Referring again to FIG. 11, web 96 may include four adhesive patterns 124, 125, 126, 127 that generally correspond to the four disruption patterns 144, 145, 146, 147 depicted in FIG. 10. It is noted that, in a similar manner to FIGS. 9 and 10, only four patterns are illustrated in FIG. 11, it being understood that the adhesive patterns will continue to repeat along the length of the web 96. The adhesive pattern 124 may include an adhesive area, generally depicted by the cross-hatched pattern in FIG. 11, and various non-adhesive areas where no adhesive is applied. Specifically, non-adhesive area 160 generally corresponds to the handle openings 234, 434, FIGS. 6 and 7. Non adhesive area 162 generally corresponds to the handle openings 236, 436. Non adhesive area 164 generally corresponds to the single layer portion 356, FIG. 5. Non adhesive area 166 generally corresponds to the openings 366, 566, FIGS. 6 and 7. Non adhesive area 168 generally corresponds to the divider sections 340, 350, FIG. 6 and the non adhesive area 170 to the divider sections 360, 370. Non adhesive area 172 generally corresponds to the openings 382, 582, FIGS. 6 and 7, and the non adhesive area 174 to the openings 392, 592. Non adhesive area 176 generally corresponds to both the single layer portion 354, FIG. 5 and the single layer portion 554, FIG. 6.

After adhesive has been applied in the adhesive application station 50, the two webs 86, 96 may be joined together in the laminating station 60, FIG. 1, to form a combined web of material 92. After leaving the laminating station 60, the combined web of material 92 may enter the third disrupting station 70. As previously described, the third disrupting station may apply the lines of disruption to the combined web 92 as illustrated in FIGS. 6 and 7 that were not previously applied in the stations 30 and 40. Specifically, the third disrupting station 70 may apply the lines of disruption that are common to both the inner and outer layers 200, 400, FIGS. 6 and 7. Further, the combined web 92 may be separated into individual carton blanks, such as the blank 150, FIGS. 4 and 5, in the third disrupting station 70.

Figure 12:
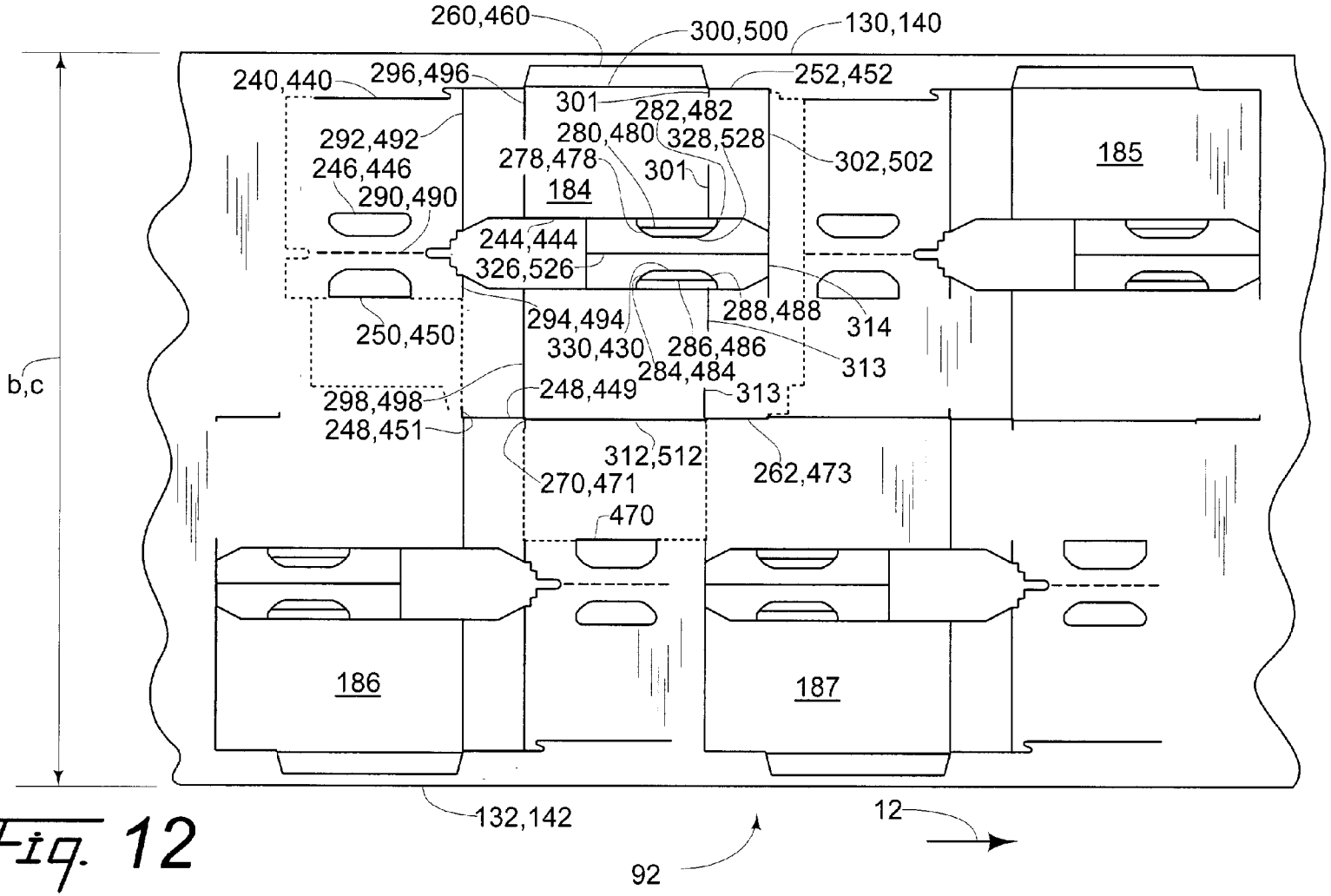
FIG. 12 is a schematic plan illustration showing a line of disruption pattern that may be applied by another disrupting station in the production line of FIG. 1; the dashed lines are representative of the blank ans are provided for illustrative purposes only.

FIG. 12 schematically illustrates a portion of the combined web of material 92 and the lines of disruption that may be applied thereto by the third disrupting station 70. It is noted that the lines of disruption previously applied to the webs 86 and 96 by the first and second disrupting stations 30 and 40, respectively (as discussed above) are not shown in FIG. 12, for purposes of illustrative clarity. Accordingly, only the lines of disruption actually added by the third disrupting station 70 are shown in FIG. 12. It is further noted that dashed lines are provided in FIG. 12 in order to generally indicate the outer boundaries of the completed blank. These dashed lines are provided for purposes of visual interpretation and referencing only.

With continued reference to FIG. 12, the web 92 may include two disruption patterns across the width "b,c" of the web 92, with four such disruption patterns 184, 185, 186, 187 being illustrated in FIG. 12. It is to be understood, of course, that, although only four disruption patterns are illustrated in FIG. 12, the disruption patterns will continue to repeat along the length of the web 92.

The lines of disruption applied to the web 92 by the third disrupting station 70 will be described only with respect to the disruption pattern 184 since the remaining disruption patterns may be substantially identical thereto.

With reference to FIGS. 6, 7 and 12, the third disrupting station 70 may apply the inner fold lines 290, 292, 296, 298, 300, 301, 302, 312, 313, 326, 328 and 330 and a portion of the inner fold lines 294, 314. The third disrupting station 70 may also apply the outer fold lines 490, 492, 494, 496, 498, 500, 502, 512, 526, 528 and 530. Third disrupting station 70 may also apply the inner cut lines 240, 244, 246, 250, 260, 276, 278, 280, 282, 284, 286, 288 and a portion of the inner cut lines 248, 252, 262, 270. Third disrupting station 70 may also apply the outer cut lines 444, 446, 450, 460, 473, 476, 478, 480, 482, 484, 486, 488 and a portion of the outer cut lines 440, 451, 449, 470 and 471.

After the combined web 92 leaves the third disrupting station 70, the completed individual blanks, such as the blank 150, may be separated from the web since, at this point, all of the lines of disruption have been applied.

Figure 13:
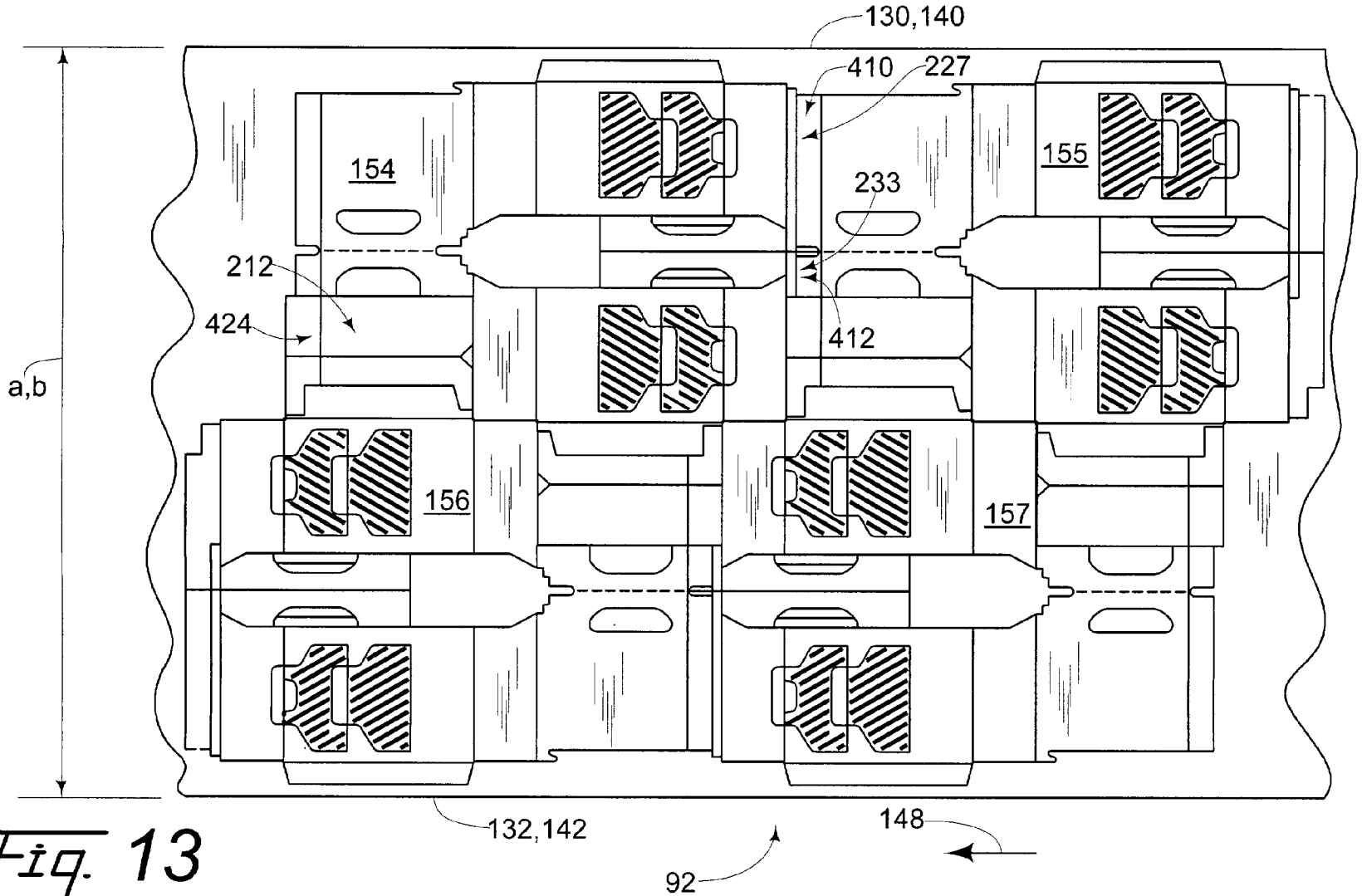
FIG. 13 is a schematic plan illustration showing a composite of the line of disruption patterns of FIGS. 9, 10 and 12.

FIG. 13 is a schematic illustration showing all of the lines of disruption applied by the first, second and third disrupting stations 30, 50, 70, as described above, but before the blanks have been separated from the web. It is noted that some of the lines of disruption shown in FIG. 13 would not normally be visible since many of the lines of disruption formed in the web 96 would be hidden by portions of the overlying web 86. All of the lines are shown in FIG. 13, however, for the purpose of facilitating illustration of the manner in which the blanks may be nested within the web 92, as will now be described in more detail.

With reference to FIG. 13, the web 92 may include two blanks across the width "b,c" of the web, with four such blanks 154, 155, 156, 157 being illustrated in FIG. 13, each of the blanks being substantially identical to the blank 150, previously described. It is to be understood, of course, that, although only four blanks are illustrated in FIG. 13, the blanks will continue to repeat along the length of the web 92.

As can be seen in FIG. 13, the blanks 156 and 157 may be turned 180 degrees in the plane of the web 92 with respect to the blanks 154 and 155 in order to facilitate nesting and, thus, minimize the amount of scrap produced. In addition to nesting in the plane of the web 92, the multi-layer design of the blanks also allows nesting to occur in a direction normal to the plane of the web 92, i.e., in the direction of an axis extending out of the page, as viewed in FIG. 13. It can be seen, for example, that the inner panel 212 of the blank 154 will overlap with a portion of the outer panel 424 of the blank 156. In a similar manner, the inner panel 227 of the blank 154 will overlap with a portion of the outer panel 410 of the blank 155 and a portion of the inner panel 233 of the blank 154 will overlap with a portion of the outer panel 412 of the blank 155. The multi-layer design of the blank 150, thus, may allow the blanks to share portions of material (i.e., one blank using one layer of the material and the adjacent blank using the other layer of material) in areas where a single layer of material is adequate. Accordingly, the multi-layer design of the blank may facilitate nesting of the blanks and, thus, aid in minimizing scrap during the manufacturing process.

It is noted that, when the blank 150 (FIG. 5) is manufactured with the production line 10, the inner and outer layers 200, 400 will never actually exist in the state shown in FIGS. 6 and 7, respectively, since, as explained above, some of the lines of disruption illustrated in FIGS. 6 and 7 are not applied by the production line 10 until after the webs of material 86, 96 (and, thus, the layers 400, 200) are adhered together and enter the third disrupting station 70.

It is further noted that the web 92 has been described herein having two blanks formed across its width for descriptive purposes only. As can readily be appreciated by one skilled in the art, the web could alternatively have more than two blanks formed across its width or only one blank occupying substantially the entire width of the web.

Having described the carton blank 150, and an exemplary method of manufacture thereof, an exemplary method of converting the carton blank 150 into a basket carrier, such as the basket carrier 100, FIGS. 1 and 2, will now be described.

With reference to FIG. 4, first, the eleventh and fourteenth inner panels 227, 233 may be folded upwardly (i.e., in a direction out of the page as viewed in FIG. 4) about the axis A-A (i.e., about the inner fold lines 302, 314 and the outer fold line 502) through a rotational angle of 180 degrees causing the inner panels 227, 233 to lie substantially flat against the inner surface 204 of the inner panels 225, 226. As can be appreciated, this folding will cause the outer surface 202 of the portion 354, FIG. 5, to face upwardly as viewed in FIG. 4.

Next, adhesive may be applied to a portion of the outer surface 202 of the portion 354, to the divider tab sections 342, 352, 362, 372 and to the inner panels 230, 232.

The rightmost portion of the blank 150 (as viewed in FIG. 4) may be folded upwardly (i.e., in a direction out of the page as viewed in FIG. 4) about the axis B-B (i.e, about the inner fold lines 296, 298 and the outer fold lines 496, 498) through a rotational angle of 180 degrees causing the inner panels 214, 216 to lie substantially flat against a portion of the inner surface 204 of the inner panels 218, 222 and the inner panels 210, 212 to lie substantially flat against a portion of the inner panels 218, 222 and the inner panels 225, 226. As can be appreciated, this folding will also cause the outer surface 402 of the outer panels 410, 412, 414, 416 and the outer surface 202 of the single layer portion 356, FIG. 5, to face upwardly as viewed in FIG. 4.

As can further be appreciated, the folding described above will also cause the single layer portion 554 to align with and adhere to a portion of the single layer portion 354 and the divider tab sections 342, 352 to adhere to opposite portions of the inner surface 204 of the first inner panel 210 and the divider tab sections 362, 372 to adhere to opposite portions of the inner surface 204 of the second inner panel 212. This folding will also cause central portions of the inner panels 210, 212 (i.e., the portions near the handle openings 234, 236) to adhere to the inner panels 230, 232.

Next, the eighth outer panel 424 may be folded about the axis C-C (i.e., about the outer fold line 531). Specifically, the lower portion of the outer panel 424 (as viewed in FIG. 4) may be folded upwardly about the axis C-C through a rotational angle of 180 degrees. This folding will cause the outer surface 402 of the lower portion of the outer panel 424 to face upwardly (as viewed in FIG. 4). Adhesive may be applied to the inner surface 204 of the sixth inner panel 220 and to the outer surface 202 of the single layer portion 356, FIG. 5.

Thereafter, the blank may be folded about the axis D-D (i.e., about the inner fold lines 324, 326, 290 and the outer fold lines 526, 490). This folding, in turn, will cause the inner surface 204 of the sixth inner panel 220 to adhere to a portion of the outer surface of the outer panel 424.

It is noted that the folding and adhesive application steps described above may be performed in any desired manner. These steps may, for example, be performed in a machine known in the package making industry as a right-angle folder gluer machine. Examples of right-angle folder gluer machines of the type that may be used for this purpose are disclosed, for example, in U.S. patent application Ser. No. 09/877,336 filed Jun. 8, 2001, of Joseph C. Walsh et al. for TRANSFER GLUE SYSTEM AND METHOD FOR A RIGHT ANGLE GLUING MACHINE, which is hereby specifically incorporated by reference for all that is disclosed therein.

It is further noted that, although adhesive may be described above as being applied to particular surfaces of the carton blank 150, the adhesive may, of course, alternately be applied instead to the opposite mating surface or to both surfaces, if desired.

At this point, the carton blank 150 (FIG. 4) has been assembled into a complete, but collapsed carrier 100 (FIG. 2). As can be appreciated, before the carrier 100 can be used to house items, e.g., beverage bottles or cans, the carrier must first be erected or opened into the condition illustrated in FIGS. 2 and 3. A plurality of the carriers 100 may be stacked while in the collapsed condition described above in order to facilitate compact shipping of the carriers to another location, e.g., a bottle or can filling facility. The carriers may, for example, then be opened after arriving at the bottle or can filling facility using conventional equipment. The catch section 238, 438 (e.g., FIGS. 6 and 7, respectively) may be engaged with the notch 408 (e.g., FIG. 7) in order to assist in securing the carrier 100 in the open position illustrated in FIGS. 1 and 2.

Figure 8:
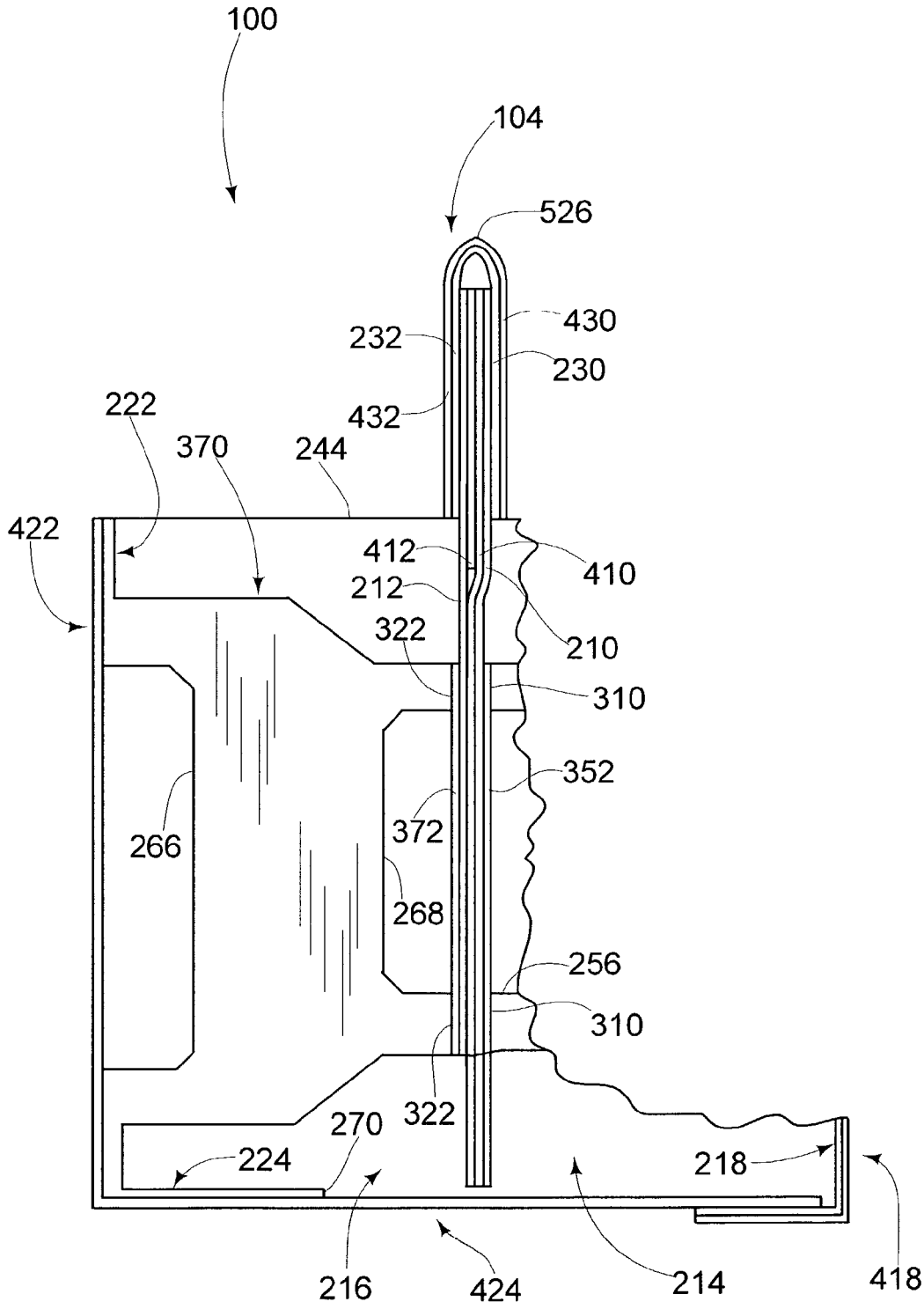
FIG. 8 is a cross-sectional view of the carton of FIGS. 2 and 3, taken along the line 8-8 in FIG. 3.

With reference, for example, to FIGS. 3, 4 and 8, when the carrier 100 is opened, the divider sections 340 and 350 will fold away from the inner panel 218, FIG. 6, about the fold lines 304 and 308, respectively. In a similar manner, the divider sections 360, 370 will fold away from the inner panel 222 about the fold lines 316, 320, respectively. The divider sections serve to separate items being carried within the pockets 110, 112, 114, 116, 118, 120, FIG. 2, of the carrier 100 and, thus, prevent damage to the items that might otherwise occur due to abrasion, impact, etc. The score lines 344, 364, e.g., FIG. 6, may optionally be provided in order to provide additional cushioning to items being carried by the carrier 100.

With reference to FIG. 3, although the divider sections 340, 350, 360, 370 may be formed from a portion of the inner layer 200, FIG. 6, the outer layer 400, FIG. 7, remains intact in the areas of the divider sections and, thus, preserves the integrity of the carton 100. With reference to FIG. 8, it can be seen that, although the divider section 370 is formed from the inner layer 200 (i.e., the inner panel 222), the outer layer 400 (i.e., the outer panel 422) prevents a hole from extending through the sidewall of the carton due to the folding away of the divider panels.

In prior basket carrier designs, divider sections are typically formed from one or more separate and dedicated portions of the blank, e.g., from portions formed in the general area of the panels 210, 212, FIG. 6, and 410, 412, FIG. 7 of the blank 150. As can be appreciated, the multi-layer design of the blank 150, and the resulting carrier 100, allows the divider sections 340, 350, 360, 370 to be formed from existing sidewalls of the carrier. This, in turn, allows other portions of the carton blank, e.g., the panels 210, 212, FIG. 6, and 410, 412, FIG. 7 to be used for other purposes. Referring to FIGS. 6 and 7, the panels 210, 212, 410, 412 may be used, for example, to house the handle defining openings 234, 236, 434 which, in turn, increase the strength of the handle portion opening 106, FIG. 1, in the carrier 100.

As discussed previously, when the blank 150 is assembled into the carrier 100, the portion 554, e.g., FIG. 4, is adhered to the portion 354, e.g., FIG. 5. Accordingly, the portions 354, 554 overlap in this area. As can be appreciated, providing each of the portions 354, 554 as single layer structures reduces the overall thickness of the combined portions 354, 554 when adhered. This reduction in thickness, in turn, allows the collapsed carrier 100 to have an overall thinner profile than would otherwise be possible. The multi-layer design of the blank 150 and the carrier 100, thus, may serve to increase the stacking efficiency of a plurality of the carriers 100 when they are arranged in a stacked configuration, in a manner as discussed above.

As also previously discussed, the outer layer 400 may be a laminated structure having, for example, a paperboard layer as described above and a plastic film layer laminated thereto. The film layer, in turn, may be provided with graphics. Although such a film layer may enhance the appearance and other attributes of a package, the film layer can also complicate the gluing process when the blank 150 is converted into the carrier 100, as described above. Specifically, the existence of a film layer may require the use of more expensive glues and/or more specialized gluing procedures. With reference to FIG. 5, for example, it can be appreciated that omitting the outer layer 400 from the portion 354 allows the inner surface 202 of the inner layer 200 (rather than the outer surface 402 of the outer layer 400) to contact the inner surface 404 of the outer layer 400 when the inner panels 227, 233 are adhered to the outer panels 410, 412 in a manner as described above. Accordingly, it is not necessary to adhere any plastic film that might optionally be used on the outer surface 402 of the outer layer 400. In a similar manner, omitting the outer layer from the portion 356, FIG. 5, allows the outer surface 204 of the inner layer 200 (rather than the outer surface of the outer layer 400) to be adhered to the outer surface 402 of the outer layer 400 when the inner panel 212 is adhered to the outer panel 410 in a manner as described above. Although, in this case, plastic film may exist on one side of the joint (i.e., the outer surface 402 of the outer panel 410), the absence of the outer layer 400 in the portion 356 prevents the need to adhere a plastic film coating directly to another plastic film coated area. Accordingly, the multi-layer design of the blank 150 may, in some instances, simplify the adhering process in at least some areas of the blank 150.

The multi-layer design of the blank 150 may also allow single layer construction to be used in areas where less strength is required. As previously described, with reference to FIG. 4, the portion 556, for example, may be formed having only a single layer. Providing single layer portions in this manner, in areas where less strength is required, reduces the total amount of material necessary to manufacture the carrier 100 and also further increases stacking efficiency, as discussed above, by further reducing the thickness of a collapsed carrier.

It is noted that, although the blank 150 has been described as a two-layer structure, it could readily be formed having more than two layers in order, for example, to facilitate the provision of additional features on the resulting carrier.

Another exemplary type of carton that may be manufactured with the production line 10 described above is a carton 600, as illustrated in FIG. 14.

Figure 15:
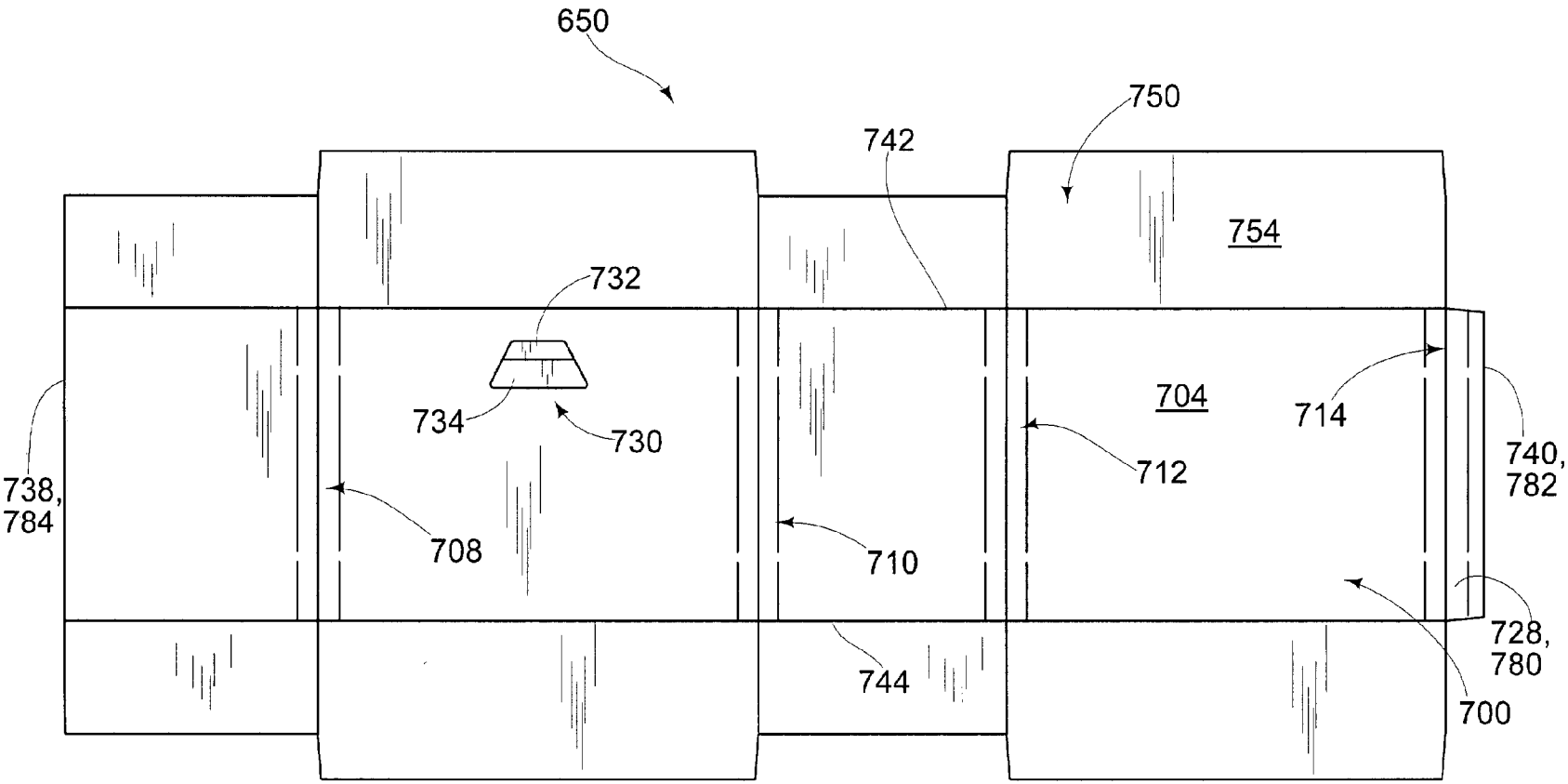
FIG. 15 is a plan view of a blank that may be used in the manufacture of the carton of FIG. 14, viewed from the interior surface thereof.

FIG. 15 illustrates a blank 650 from which the carton 600 may be erected. The blank 650 may be constructed from a plurality of layers of material, e.g., paperboard material. The blank 650 may, for example, be constructed of two layers of material, e.g., an inner layer 700 and an outer layer 750. Inner layer 700 is illustrated individually in FIG. 16. Outer layer 750 is illustrated individually in FIG. 17.

Figure 16:
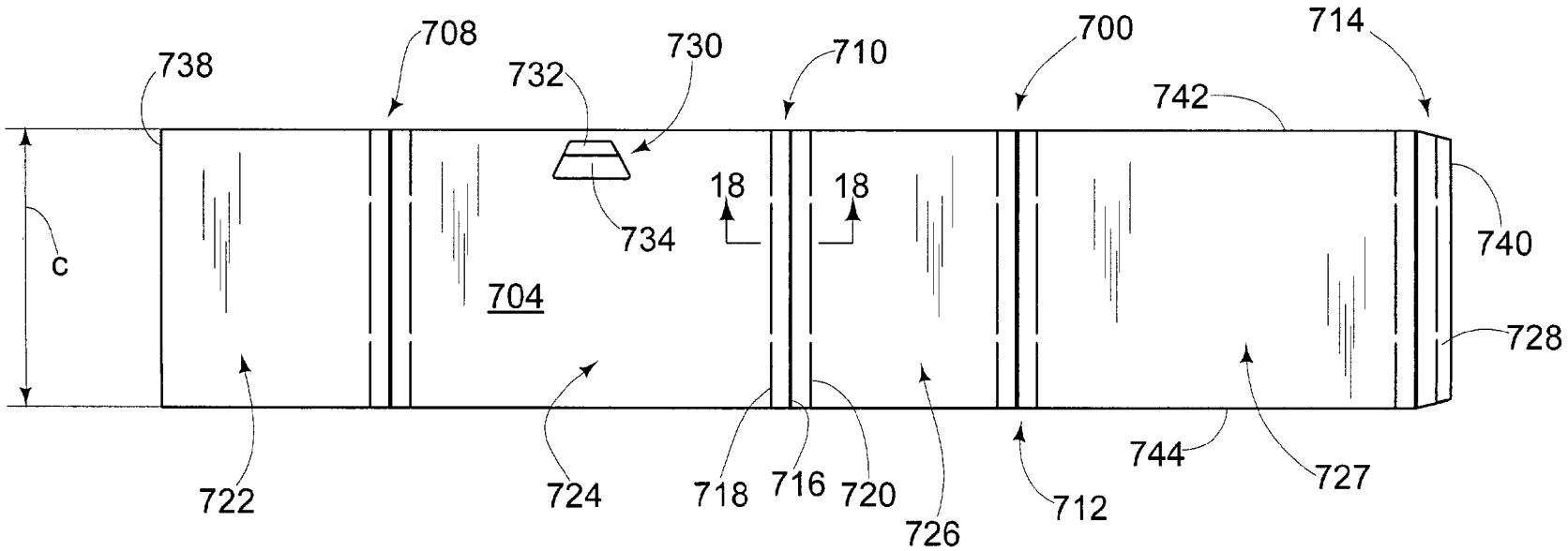
FIG. 16 is a plan view of an inner layer of the blank of FIG. 15, viewed from an interior surface thereof.

Inner layer 700 may, for example, be formed from a relatively rigid paperboard material such as that previously described herein. Referring now to FIG. 16, inner layer 700 may include an inner surface 704 and an oppositely disposed outer surface 702, FIG. 18. With further reference to FIG. 16, inner layer 700 may have a width "c", as shown, extending between the outer edges 742, 744 thereof. Inner layer 700 may further have a plurality of sets of cut lines 708, 710, 712, 714. The set of cut lines 710 will now be described in detail, it being understood that the remaining cut line sets 708, 712 and 714 may be configured in a substantially similar manner.

Figure 18:
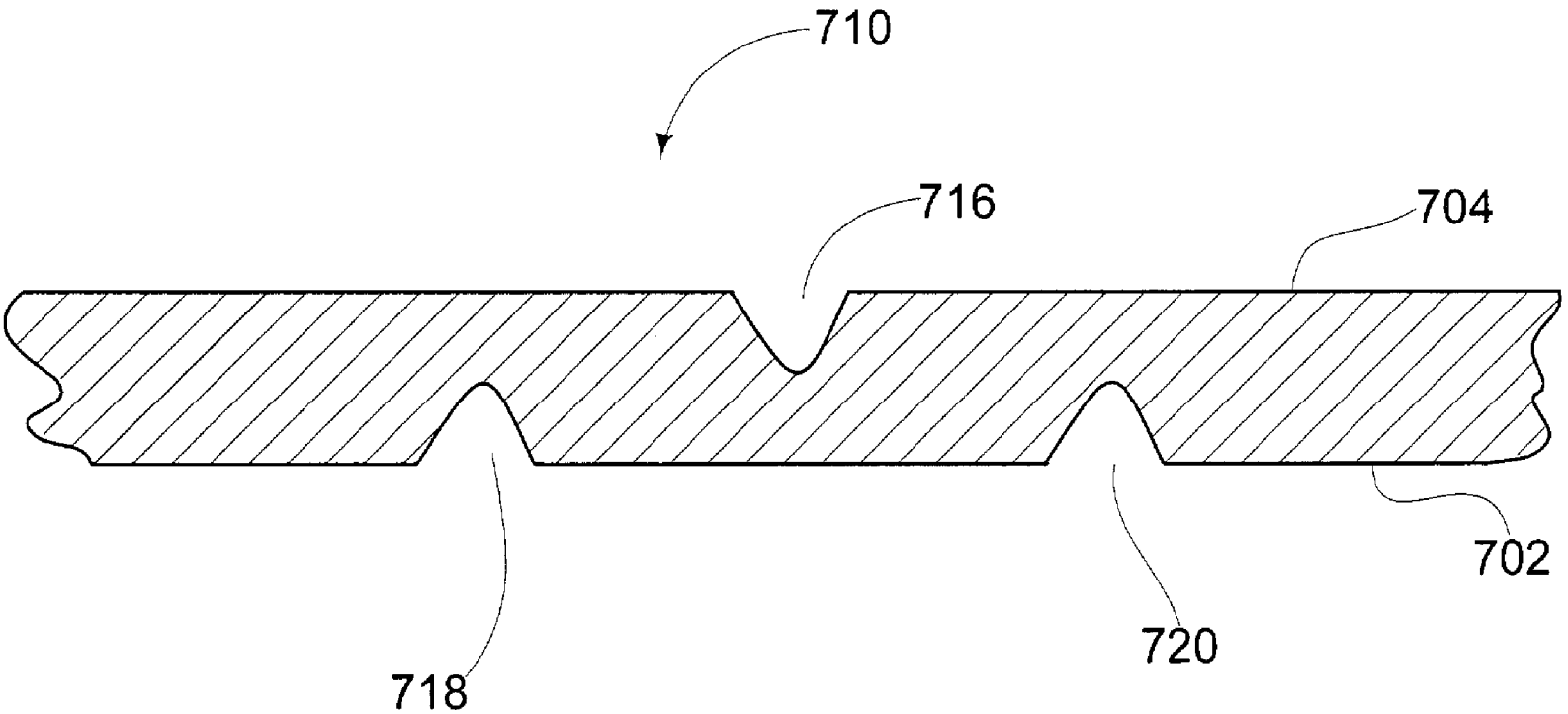
FIG. 18 is a cross-sectional view of the inner layer of FIG. 16, taken along the line 18-18 in FIG. 16.

Referring to FIGS. 16 and 18, the cut line set 710 may include the individual cut lines 716, 718 and 720, as shown. Cut line 716 may extend from the inner surface 704 of the inner layer 700. The cut lines 718, 720, on the other hand, may extend from the outer surface 702 of the inner layer 700. Each of the cut lines 716, 718, 720 may, for example, extend into the inner layer 700 for a distance equal to approximately one half the thickness of the inner layer 700. It should be noted that these cut lines 716, 718 and 720 may be any of a variety of lines of disruption such as, for example, scores.

With further reference to FIG. 16, the cut line sets 708, 710, 712 and 714 divide the inner layer 700 into a first inner side panel 722, a front inner panel 724, a second inner side panel 726, a rear inner panel 727 and an inner glue panel 728. A tab portion 730 may be formed in the front inner panel 724. Tab portion 730 may include a first section 732 and a second section 734.

Figure 17:
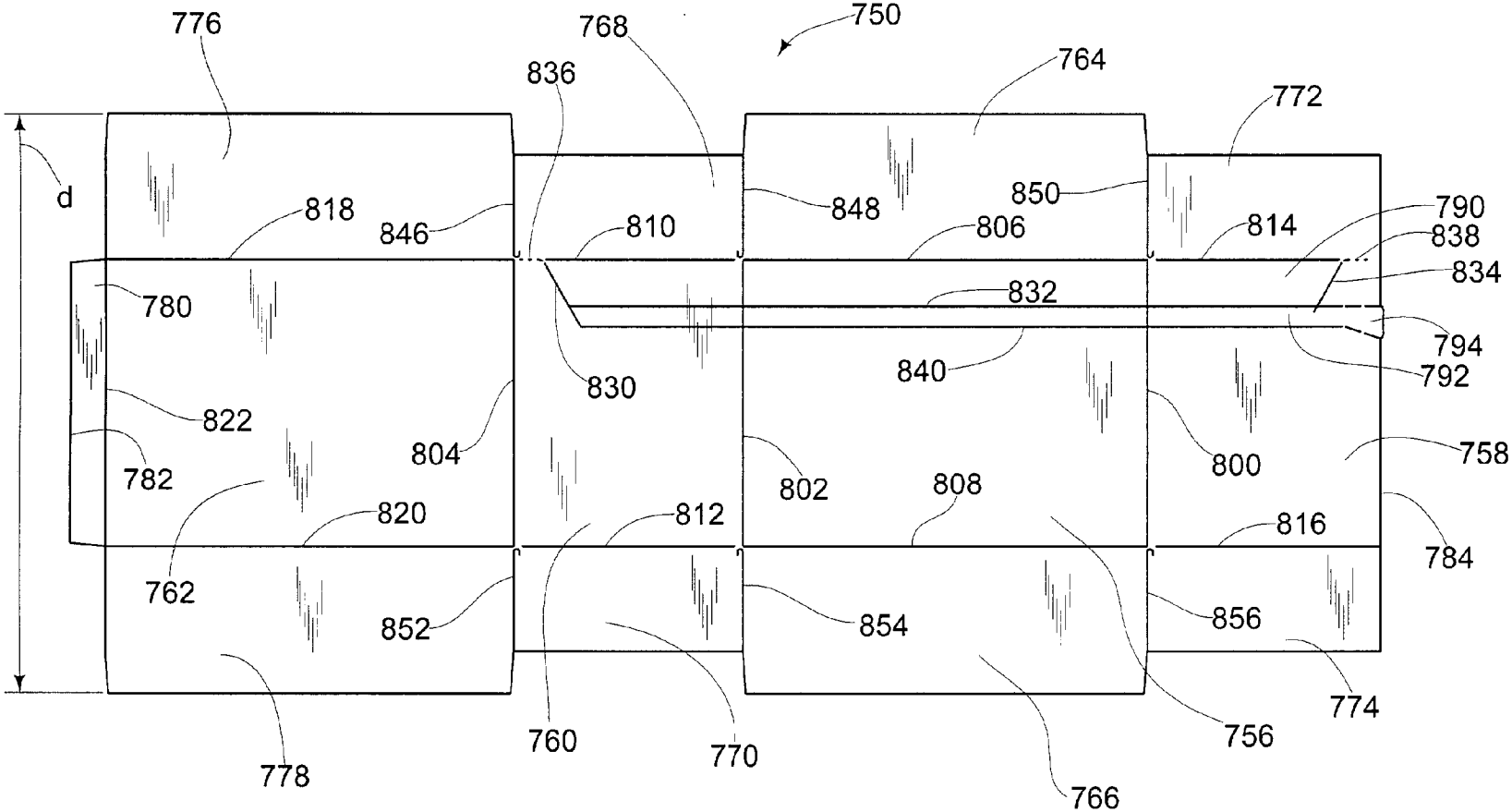
FIG. 17 is a plan view of an outer layer of the blank of FIG. 15, viewed from an exterior surface thereof.

Outer layer 750 may, for example, be formed from a relatively rigid paperboard material such as that previously described herein. With reference to FIGS. 15 and 17, outer layer 750 may include an outer surface 752 (FIG. 14) and an oppositely disposed inner surface 754. The outer surface 752 may include suitable graphics thereon, if desired, since the outer surface 752 of the outer layer 750 will make up at least the majority of the exterior surface of the assembled carton 600, as will be discussed in further detail herein. Such graphics may include text and/or images and may be applied using any conventional means, such as a printing press. Alternatively, outer layer 750 may be a laminated structure having, for example, a paperboard layer as described above and a plastic film layer laminated thereto in a conventional manner. In this case, in a manner as previously described, the film layer may be provided with graphics.

With further reference to FIG. 17, outer layer 750 may include a front panel 756 and opposite side panels 758, 760 attached thereto by fold lines 800, 802, respectively. A rear panel 762 may be attached to the side panel 760 by a fold line 804. A top front panel 764 and a bottom front panel 766 may be attached to the front panel 756 via fold lines 806, 808, respectively. A first top side panel 768 and a first bottom side panel 770 may be attached to the side panel 760 via fold lines 810, 812, respectively. A second top side panel 772 and a second bottom side panel 774 may be attached to the side panel 758 by fold lines 814, 816, respectively. A rear top panel 776, a rear bottom panel 778 and a glue panel 780 may be attached to the rear panel 752 via fold lines 818, 820 and 822, respectively. A flap 790 may be formed in the front panel 756 and the side panels 758, 760, as shown. Specifically, the flap 790 may be bounded by the fold lines 806, 810, 814, and perforated tear lines 830, 832 and 834 as shown. A perforated tear line 836 may extend from the junction of the fold line 810 and the perforated tear line 830 to the fold line 804. In a similar manner, a perforated tear line 838 may extend from the junction of the fold line 814 and the perforated tear line 834 to the cut line 784. A tear strip 792 may be formed adjacent the flap 790, as shown. The tear strip 792 may be bounded by the perforated tear line 832, a portion of the perforated tear line 830, a perforated tear line 840 and a portion of the cut line 784. A finger engageable portion 794 may be formed at one end of the tear strip 792, as shown. Outer layer 750 may have an overall width "d", as shown.

With further reference to FIG. 17, the rear top panel 776 may be separated from the first top side panel 768 by a cut line 846. The first top side panel 768 may be separated from the top front panel 764 by a cut line 848. The top front panel 764 may be separated from the second top side panel 772 by a cut line 850. The rear bottom panel 778 may be separated from the first bottom side panel 770 by a cut line 852. The first bottom side panel 770 may be separated from the bottom front panel 766 by a cut line 854. The bottom front panel 766 may be separated from the second bottom side panel 774 by a cut line 856.

As previously discussed, FIG. 15 illustrates the inner layer 700 and the outer layer 750 assembled into a multi-layer blank 650 with the outer surface 702 (FIG. 18) of the inner layer 700 abutting the inner surface 754 of the outer layer 750. FIG. 15 illustrates the blank 650 as viewed from the inner surface thereof, i.e., the surface that will make up the majority of the interior surface of the carton 600, FIG. 14. As can appreciated, when the inner and outer layers 700, 750 are assembled into the blank 650, the inner layer cut lines 708, 710, 712 and 714 will be aligned with the outer layer fold lines 800, 802, 804 and 822, respectively. As can further be appreciated, the outer edge 742 of the inner layer 700 may be generally aligned with the outer layer fold lines 818, 810, 806 and 814, FIG. 17. In a similar manner, the outer edge 744 of the inner layer 700 may be generally aligned with the outer layer fold lines 820, 812, 808 and 816. Further, the inner layer cut lines 738, 740 will be aligned with the outer layer cut lines 784, 782, respectively.

With continued reference to FIG. 15, to form the carton blank 650, the inner layer 700 and outer layer 750 may be secured to one another by any conventional mechanism. The layers 700, 750 may, for example, be attached using an adhesive such as glue. The layers 700, 750 further may be laminated to one another by applying an adhesive pattern to either the inner surface 754 of the outer layer 750 or to the outer surface 702, FIG. 18, of the inner layer 700 or to both. Such adhesive may, for example, be applied to substantially the entire area of the surfaces discussed with the exception of the areas defined by the flap 790, the tear strip 792 and the areas bounded by the cut lines 708, 710, 712, 714, FIG. 16 (e.g., the area between the lines 718, 720, FIGS. 16 and 18). Although, as discussed above, adhesive may generally be omitted from the area defined by the flap 790, adhesive may be selectively applied in the area of the second section 734 of the tab portion 730, FIG. 16 for reasons that will be discussed herein.

Having described the blank 650, various methods for manufacturing the blank will now be discussed. The blank inner layer 700 and outer layer 750 may, for example, each be made by a conventional blanking process in which the desired lines of disruption, as illustrated in the drawings and discussed above, may be made. Thereafter, the two layers 700, 750 may be laminated together using, for example, a conventional pick and place machine or a folder-gluer machine or the layers may be aligned and laminated by hand.

Alternatively, the blank 650 may be manufactured in a relatively more efficient manner using the production line 10 illustrated in FIG. 1. Specifically, for example, the supply roll 88 may contain the desired material from which the outer layer 750 is formed and the supply roll 98 may contain the desired material from which the inner layer 700 is formed.

With further reference to FIG. 1, the first web of material 86 may have a width equal to the width "d", FIG. 17, of the outer layer 750. The first web of material 86 may be unwound from the supply roll 88 and fed into the first disrupting station 30. In the first disrupting station 30, all of the lines of disruption illustrated in FIG. 17, except for the cut lines 782, 784, may be applied.

The second web of material 96 may have a width equal to the width "c", FIG. 16, of the inner layer 700. The web of material 96 may be unwound from the supply roll 98 and fed into the second disrupting station 40. In the second disrupting station 40, all of the lines of disruption illustrated in FIG. 16, except for the cut lines 738, 740 may be applied. Thereafter, adhesive may be selectively applied to the web of material 96 in the adhesive application station 50. The webs 86 and 96 may then be joined together in the laminating station 60. Thereafter, the combined web of material 92 may enter the third disrupting station 70. The third disrupting station may apply to the combined web 92 the lines of disruption illustrated in FIGS. 16 and 17 that were not previously applied in the stations 30 and 40. Specifically, the third disruption station 70 may apply the cut lines 738, 740, FIG. 16, and the cut lines 782, 784, FIG. 17, thus causing the combined web 92 to be separated into individual carton blanks, such as the blank 650, FIG. 15, in the third disrupting station 70.

It is noted that, when the blank 650 is manufactured with the production line 10, the inner and outer layers 700, 750 will never actually exist in the state shown in FIGS. 16 and 17, respectively, since, as explained above, some of the lines of disruption illustrated in FIGS. 16 and 17 are not applied by the production line 10 until after the webs of material 86, 96 (and, thus, the layers 700, 750) are adhered together and enter the third disrupting station 70.

Figure 14:
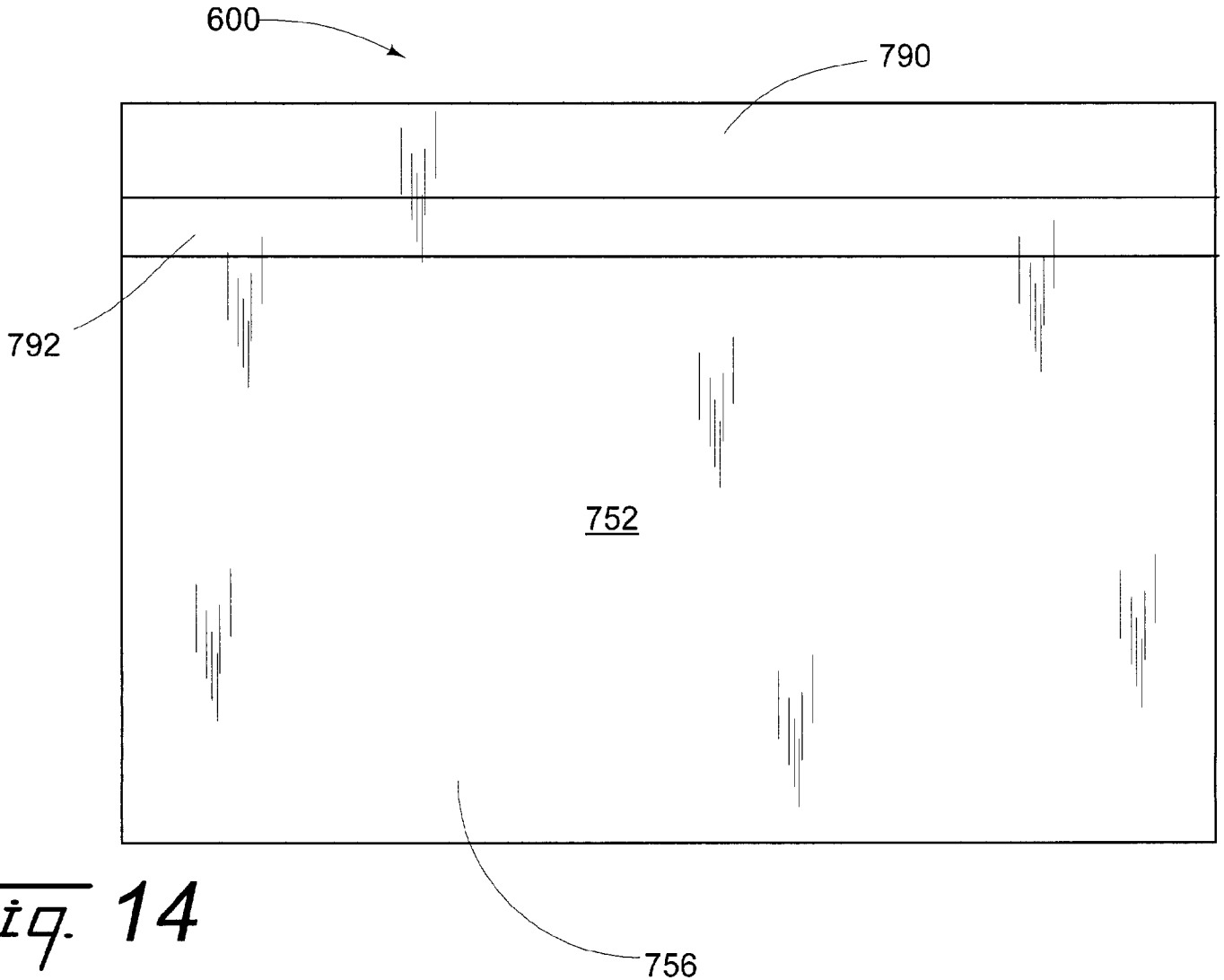
FIG. 14 is a front elevational view of another exemplary embodiment of a carton in a closed condition.

Having described the carton blank 650, and an exemplary method of manufacture thereof, an exemplary method of converting the carton blank 650 into a carton, such as the carton 600, FIG. 14, will now be described.

With reference to FIG. 15, first, the glue panels 728, 780 may be folded upwardly (i.e., in a direction out of the page as viewed in FIG. 15) and adhesive may be applied thereto. The blank 650 may then be folded into a rectangular structure causing the glue panels 728, 780 to adhere to the inner surface 704 of the inner first side panel 722. The outer layer top panels 776, 768, 764, 772, FIG. 17, and the outer layer bottom panels 778, 770, 766, 774 may then be folded and glued in a conventional manner to form a top and a bottom wall, respectively, for the carton 600.

Figure 19:
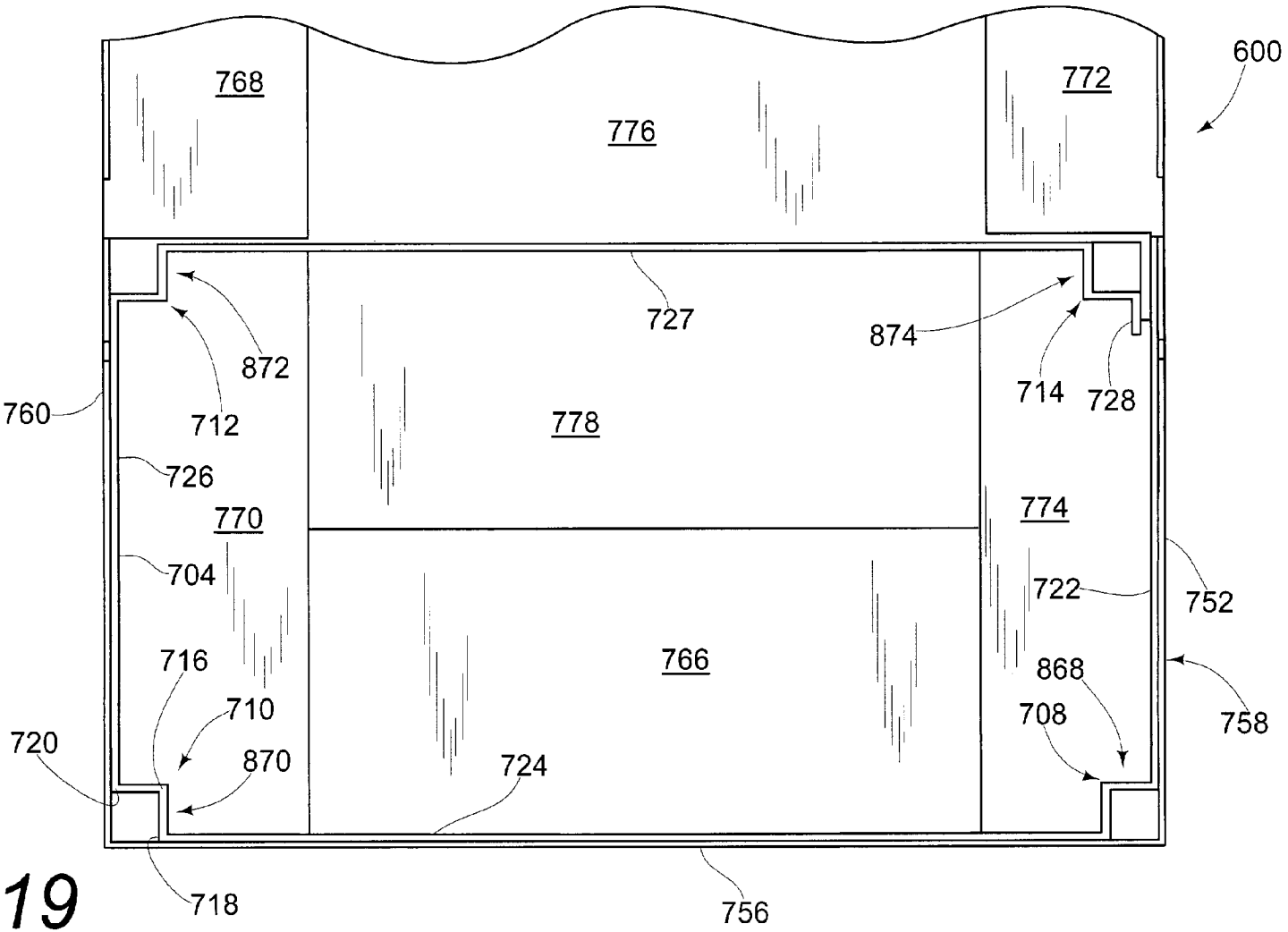
FIG. 19 is top plan view of the carton of FIG. 14 in an open condition.
Figure 20:
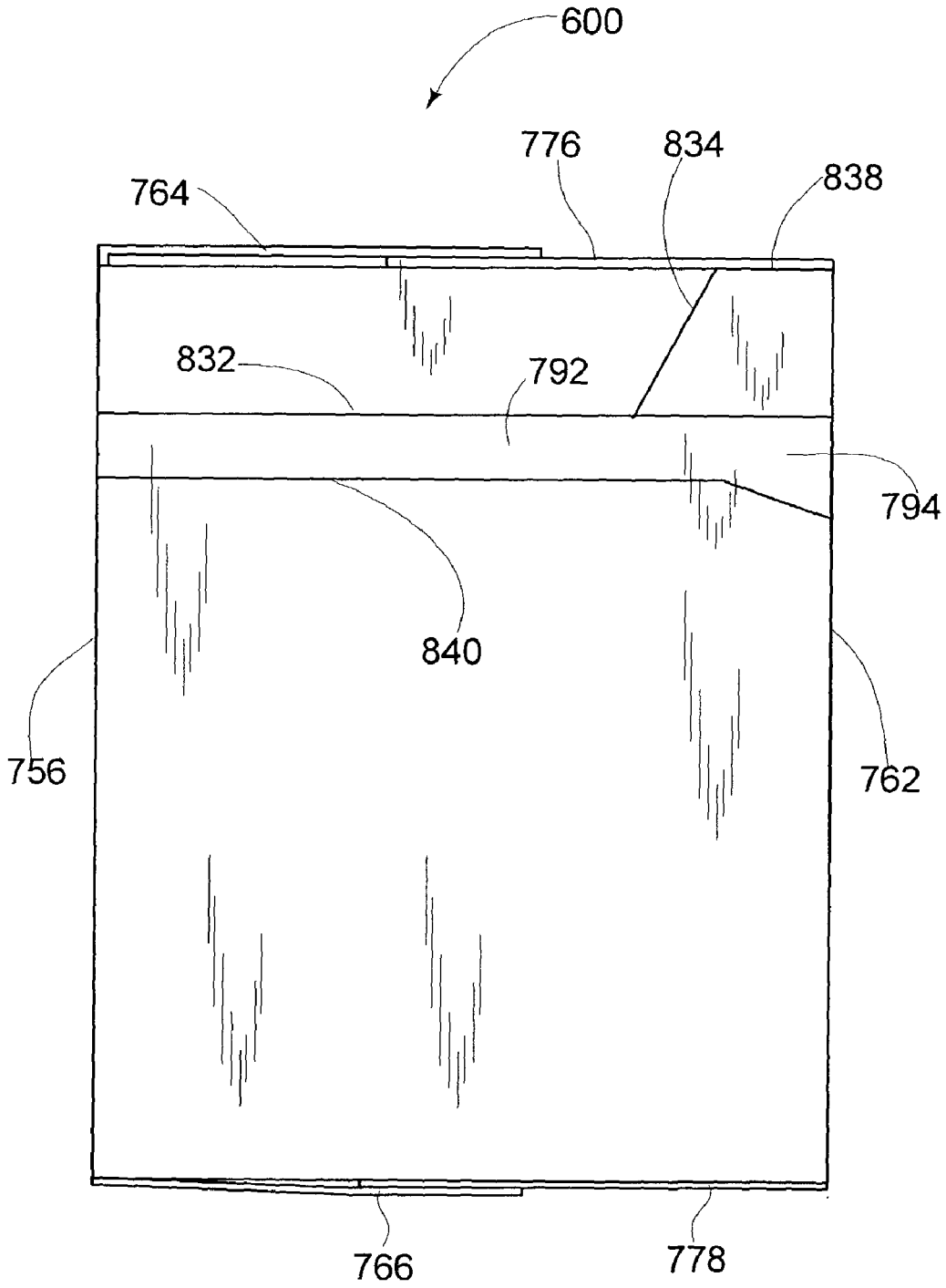
FIG. 20 is a side elevational view of the carton of FIG. 14 as viewed from the right side thereof relative to the illustration in FIG. 14.

With reference again to FIG. 20, the carton 600 may be opened by tearing the tear strip 792 away from the carton 600. The finger engageable tab 794 may be used to facilitate this task. After the tear strip 792 has been removed, the top of the carton 600 may be flipped open, causing the perforated tear strips 834, 838 and 830, 836 (FIG. 17) to tear. FIG. 19 illustrates the carton 650 in its open position. As can be seen, the cut lines 708, 710, 712, 714, previously described cause corner posts 868, 870, 872, 874, respectively, to be formed in the carton 600, thus adding additional strength to the carton. Specifically, each of the corner posts 868, 870, 872 and 874 may include a portion of the outer layer 750 and a portion of the inner layer 700, these portions being spaced from one another to define open areas in each corner post. As can be appreciated, the inner layer 700 will automatically fold away from the outer layer 750 in the corner post areas when the carton blank 650, FIG. 15, is erected into the carton 600, e.g., FIG. 19, as described above.

With reference to FIG. 15, as previously described, the outer surface 702, FIG. 18, of the tab 730 second section 734 may be adhered to the inner surface 754 of the outer layer flap 790, FIG. 17. This arrangement may result in the tab 730 completely separating from the inner layer 700 when the carton 600 is first opened. Thus, a hole will be created in the inner layer 700 having the same general shape and location as the tab 730 in FIGS. 15 and 16. When the carton is subsequently re-closed, the tab portion first section 732 will snap into this hole, thus providing a stay-closed feature on the carton 600.

As previously discussed, the outer and inner layers of the carton 600 and blank 650 may have differing material compositions. The outer and inner layers 750, 700 may further have different thicknesses if desired.

Another exemplary type of carton that may be manufactured with the production line 10 described above is a carton 1000, as illustrated in FIGS. 24 and 25.

Figure 21:
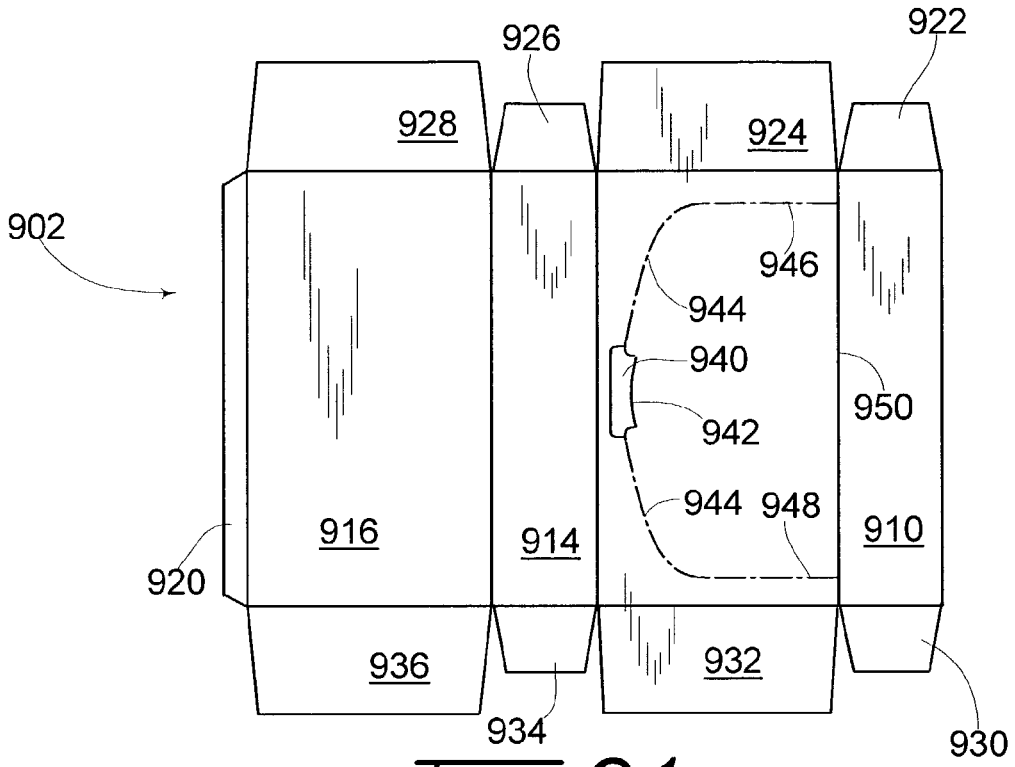
FIG. 21 is a top plan view of another exemplary embodiment of a carton blank.

FIG. 21 illustrates a carton blank 902 from which the carton 1000 may be erected. Referring now to FIG. 21, the carton blank 902 may be formed by securing together an outer layer 904 illustrated in FIG. 22 and an inner layer 906 illustrated in FIG. 23. Since the carton blank 902 and the outer layer 904 may be substantially identical, the same reference numerals will be used in describing each Figure. The carton blank 902 and the outer layer 904 may have cut lines and fold lines that define a plurality of sidewall panels 910, 912, 914 and 916 and a glue panel 920. Adjacent sidewall panels 910, 912, 914 and 916 may be integral and may be joined together by a fold line as is the glue panel 920. Top wall panels 922, 924, 926, 928 may be integral with an associated sidewall panel and may be joined thereto by a fold line. Bottom wall panels 930, 932, 934, 936 may be integral with an associated sidewall panel and may be joined thereto by a fold line.

Figure 22:
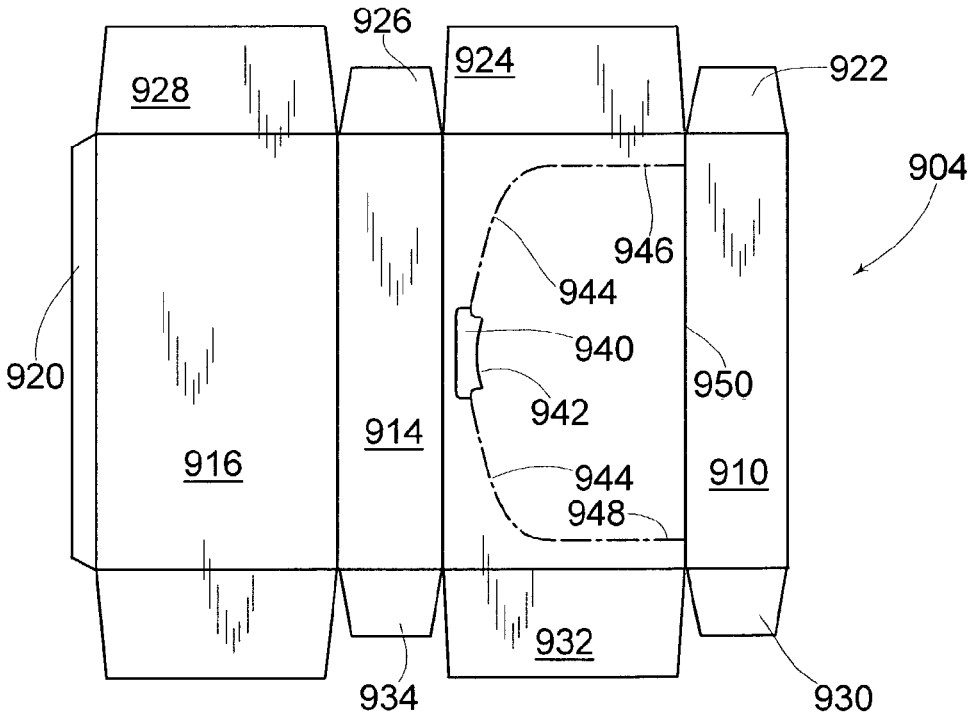
FIG. 22 is a top plan view of an outer layer of the carton blank of FIG. 21.

With continued reference to FIG. 22, the outer layer 904 may have a finger opening 940 formed therein by a continuous cut line 942. A perforated line 944 may extend from each side of the finger opening 940 and may have end portions 946 and 948 that terminate in the fold line 950. It is understood that the configuration formed by the perforated line 944 and the fold line 950 are for illustration purposes only and could be of a different size and location. For instance, the fold line 950 does not have to coincide with the fold line between the adjacent sidewall panels 910 and 912 and the perforated line 944 and the finger opening 940 can be of a different size and location.

Figure 23:
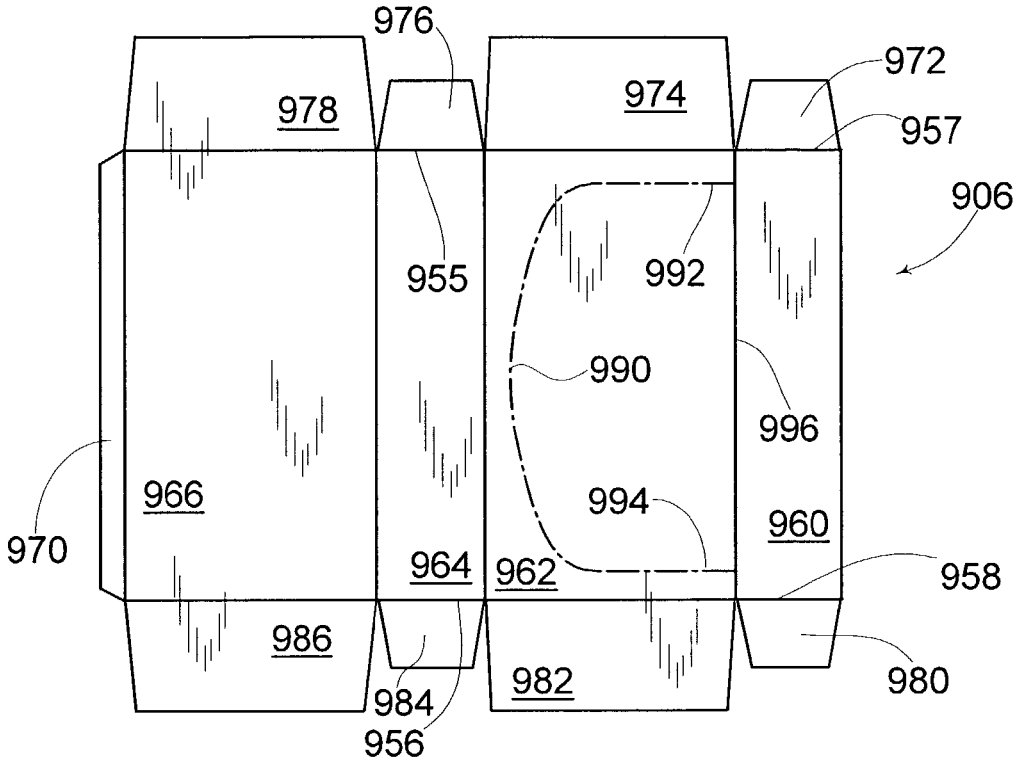
FIG. 23 is a top plan view of an inner layer of the carton blank of FIG. 21.

With reference to FIG. 23, the inner layer 906 may have portions which correspond to those of the outer layer 904 (FIG. 22) and portions which do not correspond. The inner layer 906 may have cut lines and fold lines that define a plurality of sidewall panels 960, 962, 964 and 966 and a glue panel 970. Top wall panels 972, 974, 976 and 978 may be integral with an associated sidewall panel and may be joined thereto by a fold line. Bottom wall panels 980, 982, 984 and 986 may be integral with an associated sidewall panel and may be joined thereto by a fold line. It is understood that the fold lines of the inner layer 906 may, for example, be cut lines extending partially through the thickness of the inner layer 906.

The inner layer 906 may have a perforated line 990 having end portions 992 and 994 that may terminate in the fold line 996 between the sidewall panels 960 and 962. The configuration formed by the perforated line 990 and the fold line 996 corresponds to but is smaller than the configuration formed by the perforated line 944 and the fold line 950. Since the configuration formed by the perforated line 990 and the fold line 996 is smaller than the configuration formed by the perforated line 944 and the fold line 950, a portion of the inner layer 906 is exposed through the finger opening 940 as illustrated in FIG. 21.

Figure 24:
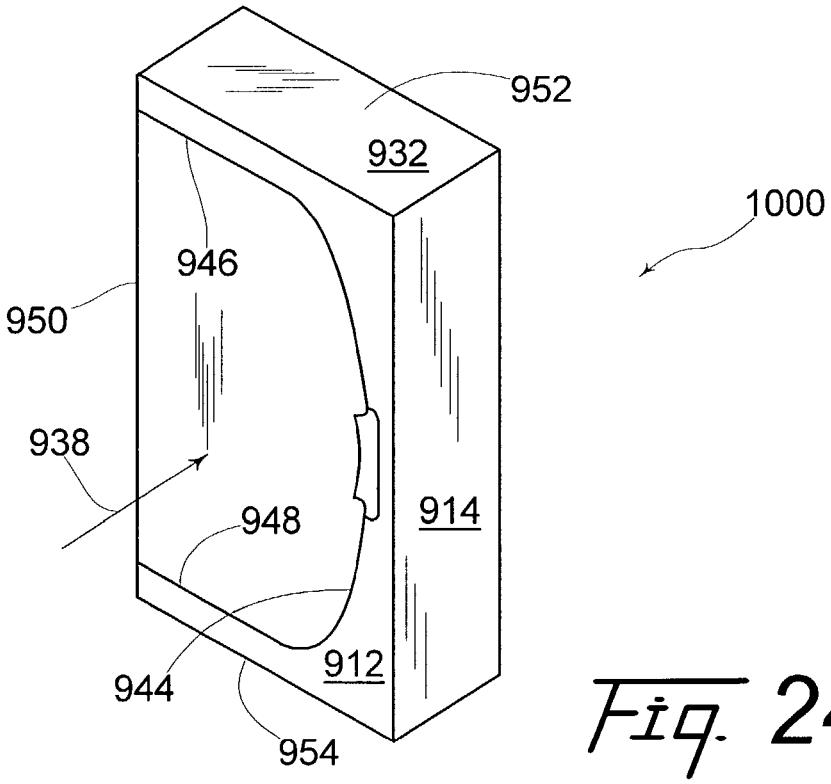
FIG. 24 is a perspective exterior view of a carton formed from the carton blank of FIG. 21.
Figure 25:
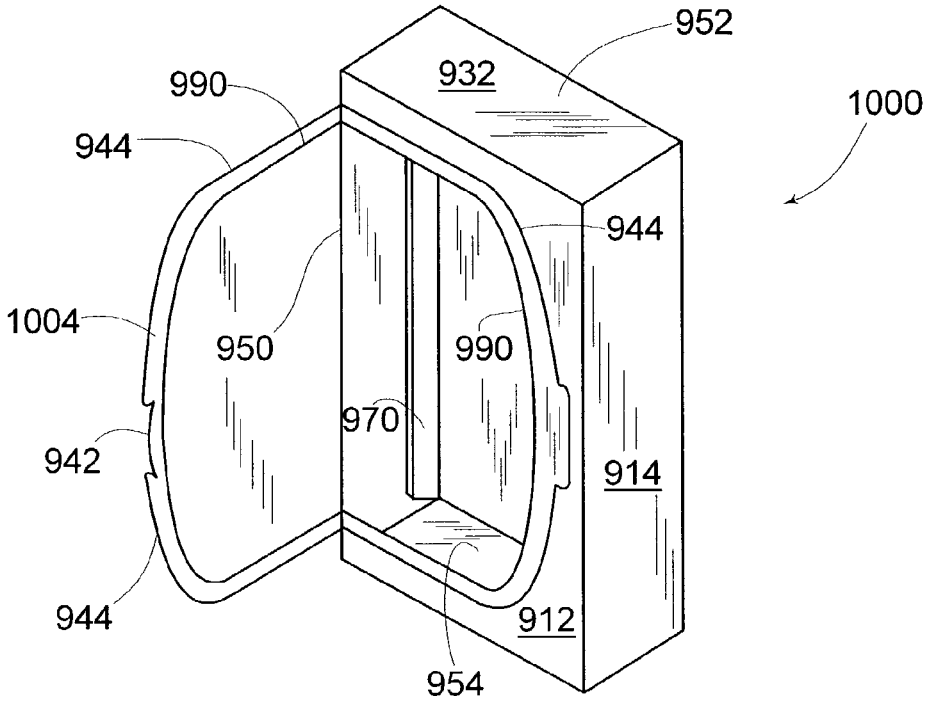
FIG. 25 is a perspective exterior view of the carton of FIG. 24 with an opening formed therein.

FIG. 24 illustrates the carton 1000 formed from the carton blank 902 of FIG. 21 and where corresponding parts have been identified with the same reference numerals. In FIGS. 24 and 25, the bottom panel 932 appears as a top panel. In FIG. 25, an outwardly directed force has been applied to the portion defined by the cut line 942 to sever the perforated lines 944 and 990 to form an opening in the carton 1000. As illustrated in FIG. 25, a portion 1002 of the inner layer 906 and a portion 1004 is exposed since the configuration defined by the perforated line 990 and the fold line 950 is smaller than the configuration defined by the perforated line 944 and the fold line 950. As explained above, the structures in FIGS. 24 and 25 are for illustration purposes only.

Having described the carton blank 902, various methods for manufacturing the blank will now be discussed. The blank inner layer 906 and outer layer 904 may, for example, each be made by a conventional blanking process in which the desired lines of disruption, as illustrated in the drawings and discussed above, may be made. Thereafter, the two layers 904, 906 may be laminated together using, for example, a conventional pick and place machine or a folder-gluer machine or the layers may be aligned and laminated by hand.

Alternatively, the blank 902 may be manufactured in a relatively more efficient manner using the production line 10 illustrated in FIG. 1. Specifically, for example, the supply roll 88 may contain the desired material from which the outer layer 904 is formed and the supply roll 98 may contain the desired material from which the inner layer 906 is formed.

With reference to FIG. 1, the first web of material 86 may be unwound from the supply roll 88 and fed into the first disrupting station 30. In the first disrupting station 30, some of the lines of disruption illustrated in FIG. 22 may be applied.

The web of material 96 may be unwound from the supply roll 98 and fed into the second disrupting station 40. In the second disrupting station 40, some of the lines of disruption illustrated in FIG. 23 may be applied. Thereafter, adhesive may be selectively applied to the web of material 96 in the adhesive application station 50. The webs 86 and 96 may then be joined together in the laminating station 60. Thereafter, the combined web of material 92 may enter the third disrupting station 70. The third disrupting station may apply to the combined web 92 the lines of disruption illustrated in FIGS. 21 and 22 that were not previously applied in the stations 30 and 40 and causing the combined web 92 to be separated into individual carton blanks, such as the blank 902, FIG. 21, in the third disrupting station 70.

It is noted that, when the blank 902 is manufactured with the production line 10, the outer and inner layers 904, 906 may never actually exist in the conditions shown in FIGS. 22 and 23, respectively, since, as explained above, some of the lines of disruption illustrated in FIGS. 22 and 23 are not applied by the production line 10 until after the webs of material 86, 96 (and, thus, the layers 904, 906) are adhered together and enter the third disrupting station 70.

It is noted that the configuration of the carton 1000, as described above, results in additional strength being provided to resist forces applied to the carton in the direction indicated by the arrow 938 in FIG. 24. Such forces may, for example, be applied to the carton as a result of stacking multiple cartons after they have been filled with product to be dispensed therefrom.

Referring, for example, to FIGS. 21 and 25, it can be appreciated that the side panel 952 (e.g., FIG. 25) will be formed from an overlap of the bottom wall panels 932 and 936, FIG. 21. In a similar manner, the side panel 954, FIG. 25, will be formed from an overlap of the top wall panels 924, 928, FIG. 21. Accordingly, the side panels 952, 954 may each have a thickness that is double that of most of the rest of the carton. As can be appreciated, this additional thickness will enhance the ability of the carton 1000 to resist forces applied in the general direction indicated by the arrow 938.

Figure 26:
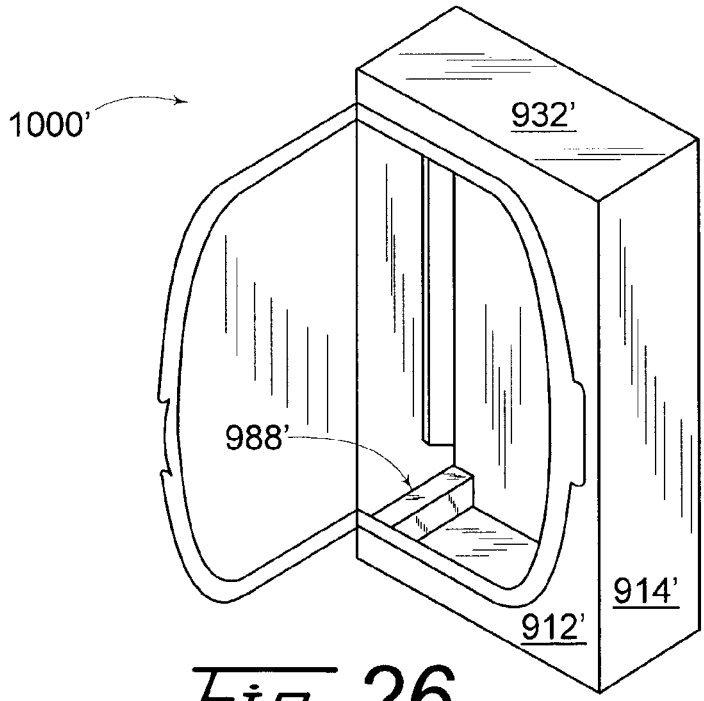
FIG. 26 is a perspective exterior view of an alternative embodiment of the carton of FIGS. 24 and 25.

If even greater strength is desired, the carton may alternatively be configured as illustrated in FIG. 26. FIG. 26 illustrates a modified carton 1000'. Since the carton 1000' is, in many respects, similar to the carton 1000 previously described, like reference numerals (with prime symbols added) have been used in FIG. 26 to denote like features previously described with respect to the carton 1000.

Referring now to FIG. 26, it can be seen that the carton 1000' may be substantially identical to the carton 1000 previously described except that the carton 1000' may be provided with corner posts, such as the corner post 988' illustrated in FIG. 26. These corner posts may be similar to the corner posts 868, 870, 872, 874, FIG. 19, previously described with respect to the carton 600.

To form the corner posts in the carton 1000', the inner layer fold lines 955, 956, 957 and 958, FIG. 23, may be modified to be formed in the same manner as the cut lines 708, 710, 712, 714, previously described with respect to the carton 600 (see, e.g., FIGS. 16, 18 and 19). As can be appreciated, this modification will allow corner posts, such as the corner post 988' illustrated in FIG. 26, to be formed, thus further increasing the ability of the carton 1000' to resist forces applied in the general direction indicated by the arrow 938 in Fig.

Figure 27:
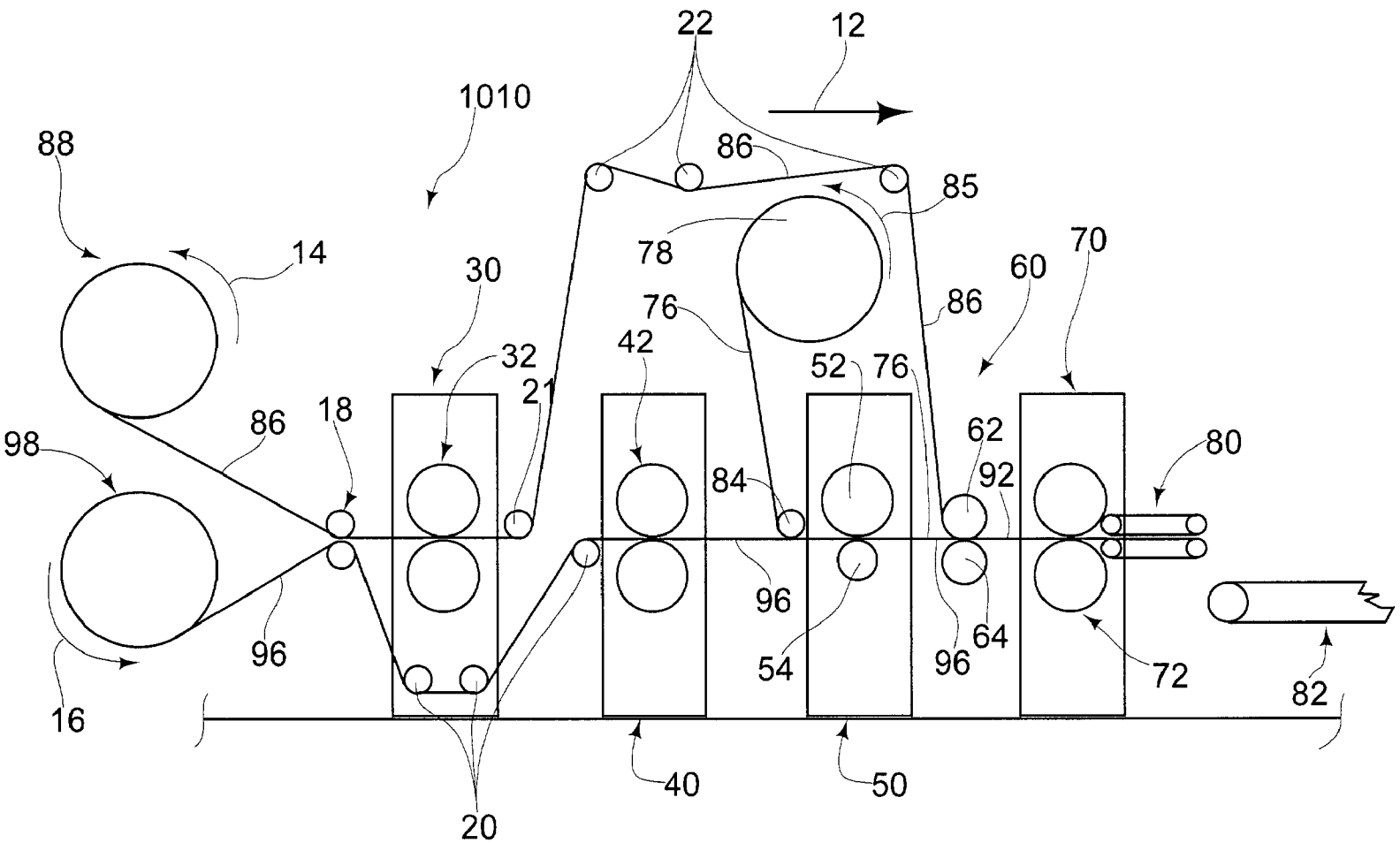
FIG. 27 is a schematic illustration of another exemplary production line.

FIG. 27 illustrates an alternative production line 1010. The production line 1010 may be substantially identical to the production line 10 previously described with respect to FIG. 1 except that, in the production line 1010, a third layer of material is introduced as will be explained in further detail below. Accordingly, the production line 1010 may be used to produce carton blanks formed from a plurality of layers (e.g., three) of material. The same reference numerals are used in FIG. 30 to denote identical features appearing in FIG. 1.

Turning now to FIG. 27, the production line 1010 may be substantially identical to the production line 10 previously described except that a third rotatable supply roll 78 may be provided.

Third supply roll 78 may contain a spirally wound quantity of a third web of material 76. A guide roller 84 may be provided to guide the third web of material 76 into superposed alignment with the second web of material 96 as shown. As can be seen from FIG. 27, the location of the guide rollers 22 may be shifted, relative to the position indicated in FIG. 1, in order to provide clearance for the third rotatable supply roll 78.

The production line 1010 may operate in a substantially identical manner to the production line 10 previously described except for the processing of the third web of material 76. Specifically, the third web of material 76 may move through the production line 1010 in the direction indicated by the arrow 12. The third web of material 76 may be unwound from the supply roll 78 as the supply roll 78 rotates in the direction indicated by the arrow 85 in a similar manner to the first and second webs of material 86 and 96 as previously described.

After leaving the supply roll 78, the third web of material 76 may pass beneath the guide roller 84 such that the third web of material is in contact with or near the second web of material 96. Thereafter, the second web of material 96 and the third web of material 76 may enter the adhesive application station 50 together. In the adhesive application station 50, adhesive may be applied, for example, in a specific pattern to the upper surface (as viewed in FIG. 1) of the second web of material 96 and the upper surface of the third web of material 76. After leaving the adhesive application station 50, the second web of material 96 and third web of material 76 may enter the laminating station 60.

As can appreciated from FIG. 27, the first web of material 86 meets the second web of material 96 and the third web of material 76 at the laminating station 60. Within the laminating station 60, all three webs of material pass between the rollers 62 and 64. Pressure applied by the rollers 62 and 64 facilitates adhesion between the second web of material 96 and the first web of material 86 and between the second web of material 96 and the third web of material 76 (due to the adhesive previously applied to the second web of material 96 and the third web of material 76 in the adhesive application station 50) and results in a combined web of material 92 exiting the laminating station 60.

After exiting the laminating station 60, the combined web of material 92 may enter the third disrupting station 70. Within the third disrupting station 70, the combined web of material 92 is cut into individual carton blanks and at least one additional line of disruption may also be formed in the combined web of material 92.

As can be appreciated, the production line 1010 allows the formation of carton blanks having up to three layers of material. It is noted that the third supply roll 78 is shown located above the adhesive application station 50 in FIG. 27 for schematic illustration purposes only. The third supply roll 78 could be located in various alternate locations, for example, in between the second disrupting station 40 and the adhesive application station 50 or off to one side or the other of the production line 1010 (in this case, the third supply roll 78 may be mounted such that its rotational axis is vertical and the third web of material may undergo a 90 degree turn).

As a further alternative to the production line 1010 illustrated in FIG. 27, a third disrupting station may be provided in order to form one or more lines of disruption in the third web of material 76. This may be desirable, for example, when forming more complex packages that might require one or more lines of disruption in the third web of material 76.

One exemplary type of carton that may be manufactured with the production line 1010 described above is a carton 1020, as illustrated in FIG. 28.

Figure 29:
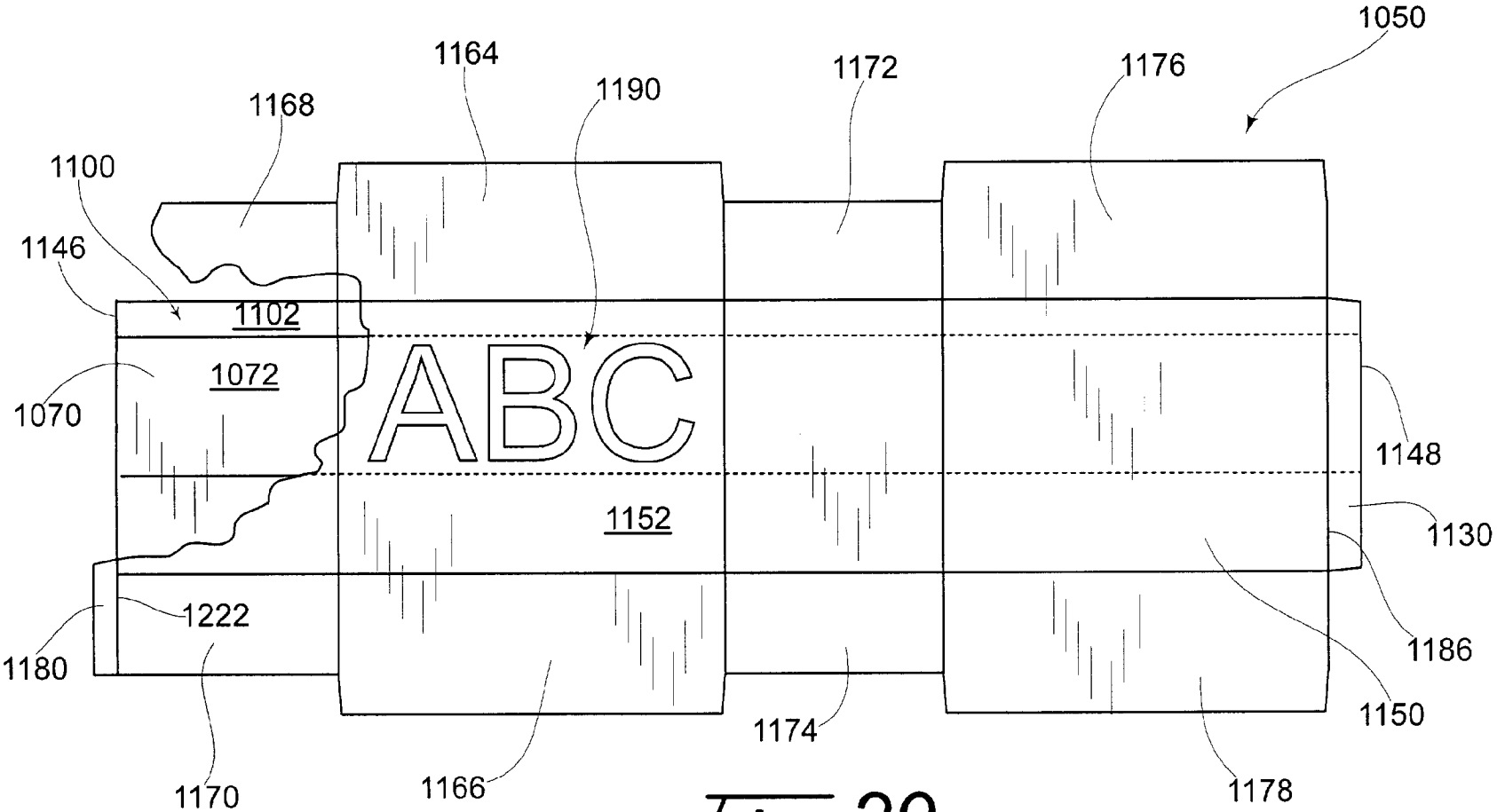
FIG. 29 is a plan view of a blank that may be used in the manufacture of the carton of FIG. 28, viewed from an exterior surface thereof, with a portion of an outer layer thereof partially cut away.

FIG. 29 illustrates a blank 1050 from which the carton 1020 may be erected. The blank 1050 may be constructed from a plurality of layers. The blank 1050 may, for example, be constructed of three layers of material, e.g., an inner layer 1100, an outer layer 1150 and a middle layer 1070. Inner layer 1100 is illustrated individually in FIG. 30. Outer layer 1150 is illustrated individually in FIG. 31.

Figure 30:
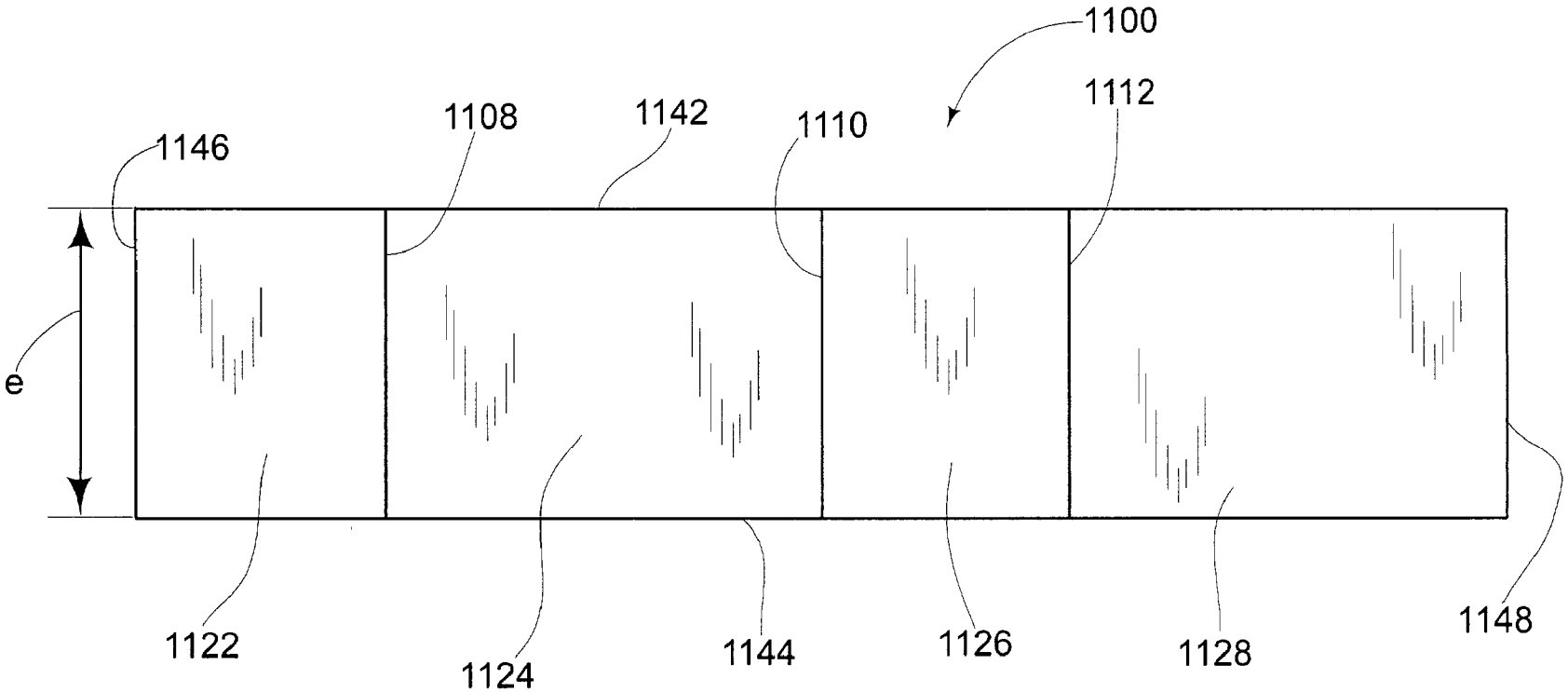
FIG. 30 is a plan view of an inner layer of the blank of FIG. 29, viewed from the exterior surface thereof.

Inner layer 1100 may, for example, be formed from a relatively rigid paperboard material such as that previously described herein. Referring now to FIG. 30, inner layer 1100 may include an outer surface 1102 and an oppositely disposed inner surface, not shown. With further reference to FIG. 30, inner layer 1100 may have a width "e", as shown, extending between the outer edges 1142, 1144 thereof. Inner layer 1100 may further have a plurality of fold lines 1108, 1110, 1112, as shown. With further reference to FIG. 30, the fold lines 1108, 1110 and 1112 divide the inner layer 1100 into a first inner side panel 1122, a front inner panel 1124, a second inner side panel 1126 and a rear inner panel 1128. Inner layer 1100 may further have a pair of oppositely disposed outer edges 1146, 1148.

Figure 31:
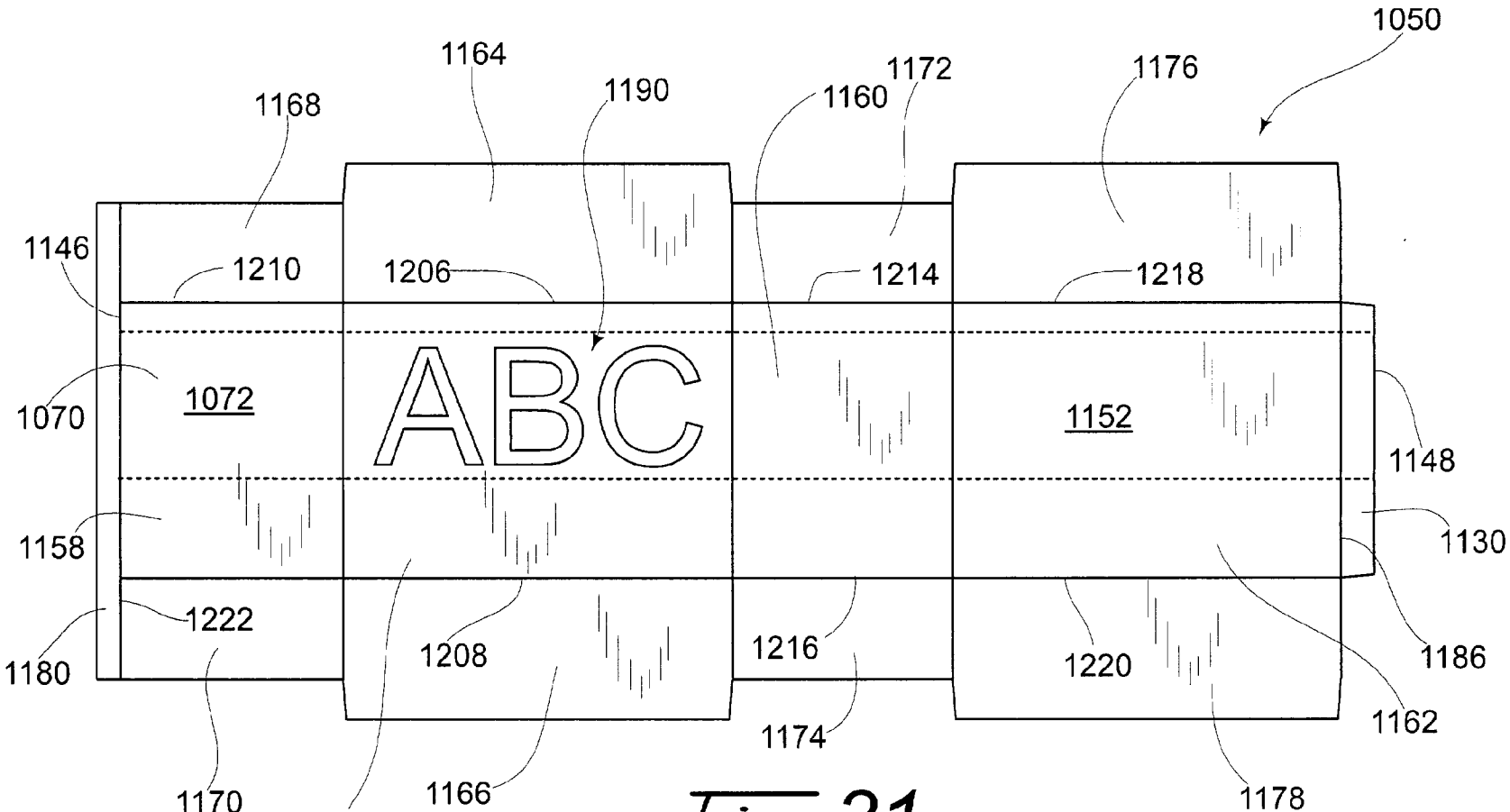
FIG. 31 is a plan view of an outer layer of the blank of FIG. 28, viewed from the exterior surface thereof.

Outer layer 1150 may, for example, be formed from a relatively rigid paperboard material such as that previously described herein. With reference to FIG. 31, outer layer 1150 may include an outer surface 1152 and an oppositely disposed inner surface, not shown. The outer surface 1152 may include suitable graphics thereon, if desired, since the outer surface 1152 of the outer layer 1150 will make up at least the majority of the exterior surface of the assembled carton 1020. Such graphics may include text and/or images and may be applied using any conventional means, such as a printing press. Alternatively, outer layer 1150 may be a laminated structure having, for example, a paperboard layer as described above and a plastic film layer laminated thereto in a conventional manner. In this case, in a manner as previously described, the film layer may be provided with graphics.

With further reference to FIG. 31, outer layer 1150 may include a front panel 1156 and opposite side panels 1158, 1160 attached thereto by fold lines 1200, 1202, respectively. A rear panel 1162 may be attached to the side panel 1160 by a fold line 1204. A top front panel 1164 and a bottom front panel 1166 may be attached to the front panel 1156 via fold lines 1206, 1208, respectively. A first top side panel 1168 and a first bottom side panel 1170 may be attached to the side panel 1158 via fold lines 1210, 1212, respectively. A second top side panel 1172 and a second bottom side panel 1174 may be attached to the side panel 1160 by fold lines 1214, 1216, respectively. A rear top panel 1176 and a rear bottom panel 1178 may be attached to the rear panel 1152 via fold lines 1218, 1220, respectively. A glue flap 1180 may be attached to the side panel 1158 via a fold line 1222. Outer layer 1150 may also include a first edge 1184 and a second edge 1186 as shown.

Outer layer 1150 may include cut-out areas extending completely therethrough, as will now be explained in further detail. Referring to FIG. 31, an exemplary cutout area 1190 is illustrated in the front panel 1156. Although the cutout area is illustrated in FIG. 31 as forming text, it is to be understood that the cutout area or areas could readily be formed in any desired shape for reasons that will be further discussed herein. It is further noted that cutout areas could alternatively or additionally be formed in panels of the outer layer 1150 other than the front panel 1156. The cutout areas, such as the cutout area 1190, may be formed by creating cut lines extending through the outer layer 1150 in the desired pattern.

As previously discussed, FIG. 29 illustrates the inner layer 1100, the middle layer 1070 and the outer layer 1150 assembled into a multi-layer blank 1050. As can appreciated, when the layers are assembled into the blank 1050, the inner layer fold lines 1108, 1110, 1112 (FIG. 30) will be aligned with the outer layer fold lines 1200, 1202, 1204 (FIG. 31), respectively. As can further be appreciated, the outer edge 1142 of the inner layer 1100 will be generally aligned with the outer layer fold lines 1206, 1210, 1214 and 1218, FIG. 31. In a similar manner, the outer edge 1144 of the inner layer 1100, FIG. 30, will be generally aligned with the outer layer fold lines 1208, 1212, 1216 and 1220, FIG. 31. Further, the inner layer edge 1146, FIG. 30, may be generally aligned with the outer layer fold line 1222, FIG. 29, as shown. The inner layer edge 1148 may extend beyond the outer layer edge 1186 creating an inner layer glue flap area 1130, FIG. 29, defined between the edges 1148, 1186.

Figure 28:
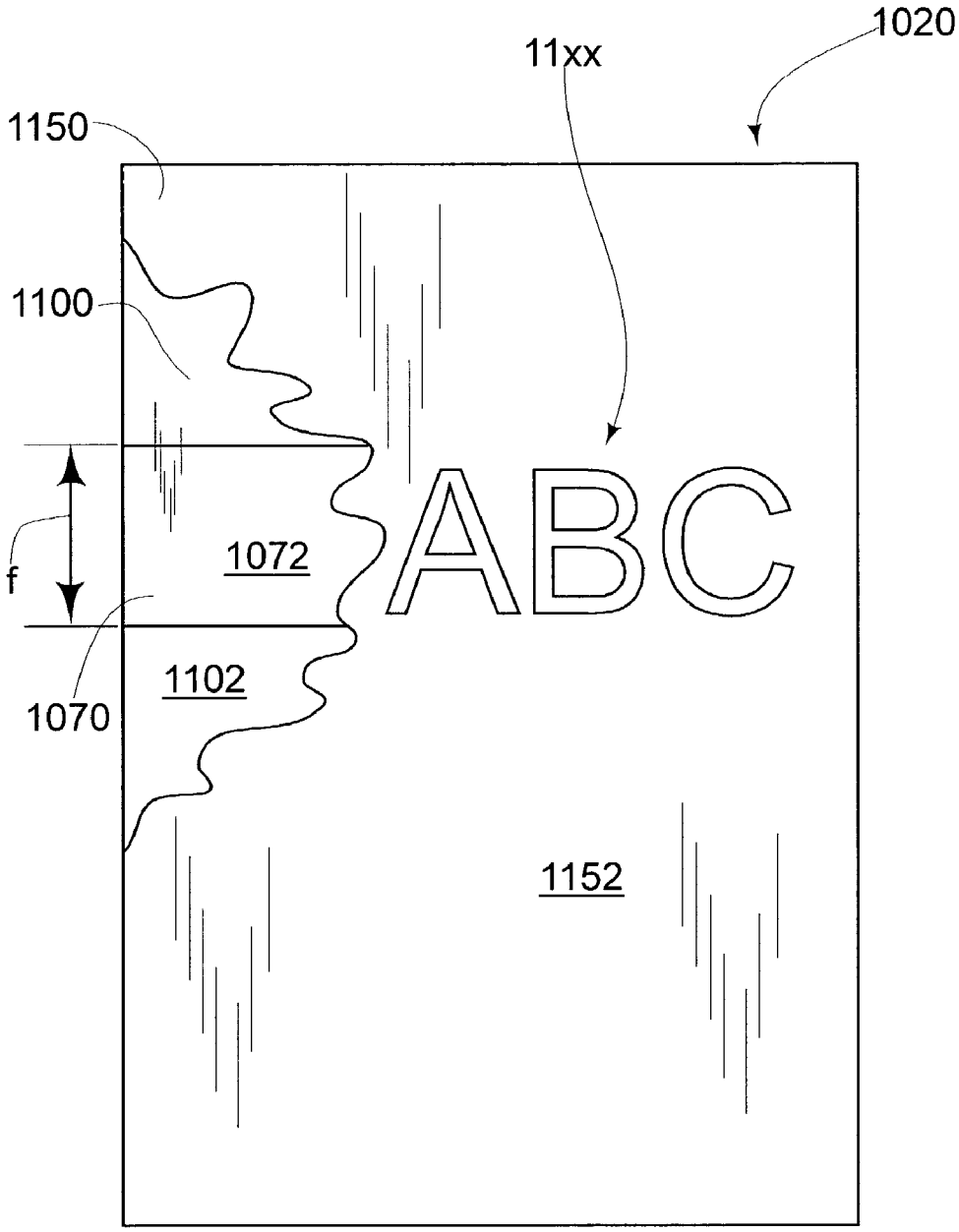
FIG. 28 is a front elevational view of an exemplary carton with a portion of an outer layer thereof partially cut away.

Referring to FIGS. 28 and 29, the middle layer 1070 may have an outer surface 1072 and an oppositely disposed inner surface, not shown. With reference to FIG. 28, middle layer 1070 may, for example, have a width "f" that is less than the width "e", FIG. 30, of the inner layer 1100. As can be appreciated from FIGS. 28 and 29, the middle layer 1070 may be located and oriented such that the middle layer will show through the cutout area 1190, thus enhancing the visual effect of the text or graphics formed by the cutout area 1190. For this purpose, the middle layer 1070 may be formed from a material, such as a paperboard material, having an appealing color. Alternatively, the paperboard material may be printed with a desired color or pattern. As a further alternative, the middle layer 1070 may be formed form a holographic material creating an eye catching appearance for the text or graphics formed by the cutout area 1190. Alternatively, the middle layer 1070 may be formed having virtually any appearance as may be desired for the text or graphics formed by the cutout area 1190.

In summary, the three layer construction of the blank 1150 allows a desired appearance to be achieved for the text or graphics formed by the cutout area 1190 and also creates a three-dimensional effect due to the fact that the middle layer 1070 is recessed behind the outer layer 1150. Since the middle layer 1070 only need be provided where the cutout area 1190 is located, the width "f", FIG. 28, of the middle layer 1070 may be less than the width "e" of the inner layer 1100, thus saving material. Of course, the middle layer may be provided having a greater width (equal to, for example, the width "e" of the inner layer 1100) if desired or if the location and/or size of the cutout area or areas demands.

To form the carton blank 1150, the inner layer 1100, middle layer 1070 and outer layer 1150 may be secured by any conventional mechanism. The middle layer 1070 and inner layer 1100 may, for example, be attached to the outer layer 1150 using an adhesive such as glue.

Having described the blank 1050, various methods for manufacturing the blank will now be discussed. The blank inner layer 1100, middle layer 1070 and outer layer 1150 may, for example, each be made by a conventional blanking process in which the desired lines of disruption, as illustrated in the drawings and discussed above, may be made. Thereafter, the layers may be laminated together using, for example, a conventional pick and place machine or a folder-gluer machine or the layers may be aligned and laminated by hand.

Alternatively, the blank 1150 may be manufactured in a relatively more efficient manner using the production line 1010 illustrated in FIG. 27. Specifically, for example, the supply roll 88 may contain the desired material from which the outer layer 1150 is formed and the supply roll 98 may contain the desired material from which the inner layer 1100 is formed. Further, the supply roll 78 may contain the desired material from which the middle layer 1070 is formed.

The first web of material 96 may have a width substantially equal to the width of the outer layer 1150. The first web of material 86 may be unwound from the supply roll 88 and fed into the first disrupting station 30. In the first disrupting station 30, all of the lines of disruption illustrated in FIG. 31 (including those forming the cutout area 1190), except for the cut lines forming the edges 1184, 1186, may be applied.

The second web of material 96 may have a width substantially equal to the width "e", FIG. 30, of the inner layer 1100. The web of material 96 may be unwound from the supply roll 98 and fed into the second disrupting station 40. In the second disrupting station 40, all of the lines of disruption illustrated in FIG. 30, except for the cut lines forming the edges 1146, 1148, may be applied.

The third web of material 76 may have a width substantially equal to the width "f", FIG. 31, of the middle layer 1070. The third web of material 76 may be unwound from the supply roll 78 and fed around the guide roller 84 thereafter causing the web of material 76 to overlie the second web of material 96.

Thereafter, adhesive may be selectively applied to the web of material 96 and the web of material 76 in the adhesive application station 50. Specifically, an adhesive pattern may, for example, be applied to substantially the entire outer surface 1102 of the inner layer 1100 except for the glue flap area 1130, FIG. 29, and the area where the middle layer 1070 is present. Further the adhesive pattern may, for example, be applied to the substantially the entire outer surface 1072 of the middle layer 1070 except for the areas corresponding to the cutout area 1190, the glue flap 1180 and the glue flap area 1130.

The webs 76, 86 and 96 may then be joined together in the laminating station 60. Thereafter, the combined web of material 92 may enter the third disrupting station 70. In the third disrupting station 70, the cut lines forming the edges 1184, 1186 of the outer layer 1150 may be formed. These cut lines may, for example, be formed using a process known in the industry as "kiss-cutting". To perform such a kiss-cutting process, cuts may be initiated from the outer surface 1152 of the outer layer 1150 and may extend completely through the full thickness of the outer layer. The cuts may, for example, also extend a small way into the overlying inner layer 1100 but not entirely through the inner layer. In this manner, through cuts may be provided in the outer layer without cutting through the inner layer 1100. The cut forming the cut edge 1186, as discussed above, may also extend through the middle layer 1070 forming an edge therein that aligns with the edge 1186.

Further in the third disrupting station 70, the cut lines forming the edges 1146, 1148 of the inner layer 1100 may be formed. These cut lines may, for example, be formed using the "kiss-cutting" process described above. Specifically, cuts may be initiated from the inner surface of the inner layer 1100 and caused to extend completely through the full thickness of the inner layer. The cuts may, for example, also extend a small way into the overlying outer layer 1150 but not entirely through the outer layer. In this manner, through cuts may be provided in the inner layer without cutting through the outer layer 1150. The cut forming the cut edge 1146, as discussed above, may also extend through the middle layer 1070 forming an edge therein that aligns with the edge 1146.

As can be appreciated, the cuts applied by the third disrupting station 70, as described above, will cause the combined web 92 to be separated into individual carton blanks, such as the blank 1050, FIG. 29.

In order to convert the carton blank 1050 into a carton, such as the carton 1020, FIG. 28, the outer layer glue flap 1180, FIG. 29, may be folded downwardly (i.e., in a direction into the page as viewed in FIG. 29). Adhesive may be applied to either the inner surface of the glue flap 1180, the outer surface 1102 of the glue flap area 1130 or to both. The blank 1150 may then be folded into a rectangular structure causing the inner surface of the glue flap 1180 to adhere to the outer surface 1102 of the glue flap area 1130. The outer layer top panels 1164, 1168, 1172, 1174, and the outer layer bottom panels 1166, 1170, 1174, 1178 may then be folded and glued in a conventional manner to form a top and a bottom wall, respectively, for the carton 1020.

Figure 32:
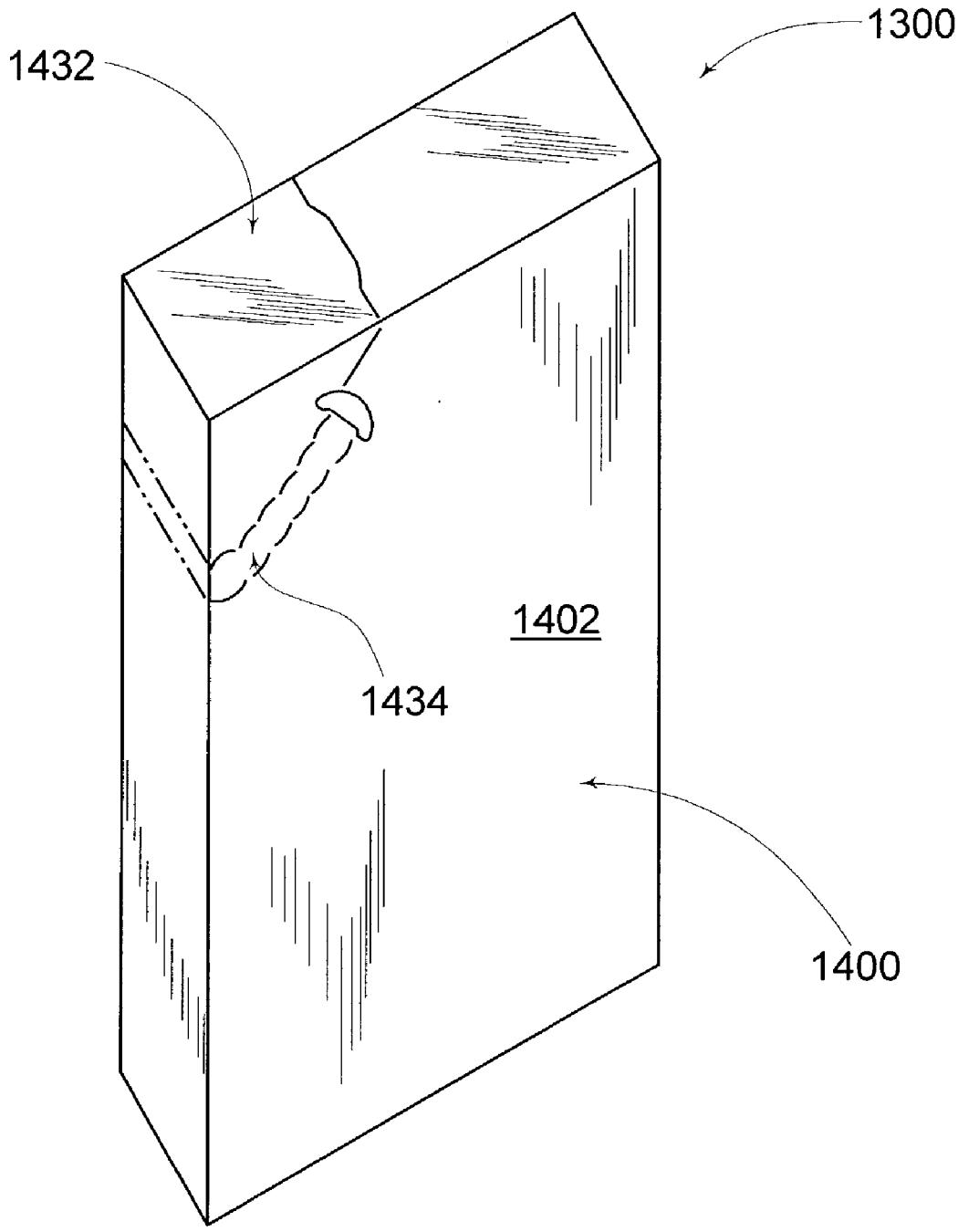
FIG. 32 is a perspective view of an exemplary carton provided with a corner spout illustrated in an unopened condition.
Figure 33:
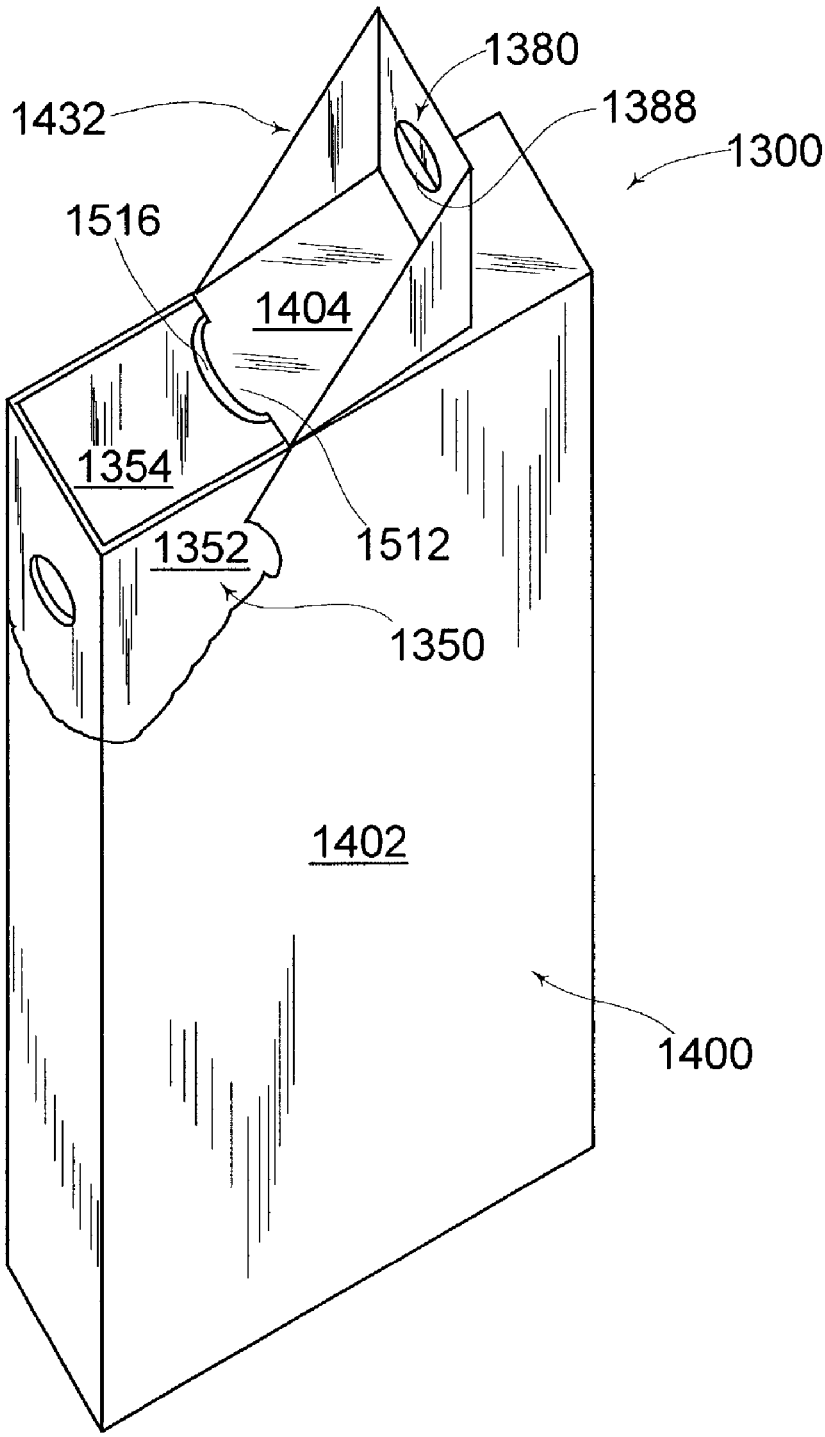
FIG. 33 is a perspective view of the carton of FIG. 32 illustrated in an opened condition.

Another exemplary type of carton that may be manufactured with the production line 10 described above is a carton 1300, as illustrated in FIGS. 32 and 33. FIG. 32 illustrates the carton 1300 in an unopened condition. FIG. 33 illustrates the carton 1300 in an opened condition.

Figure 34:
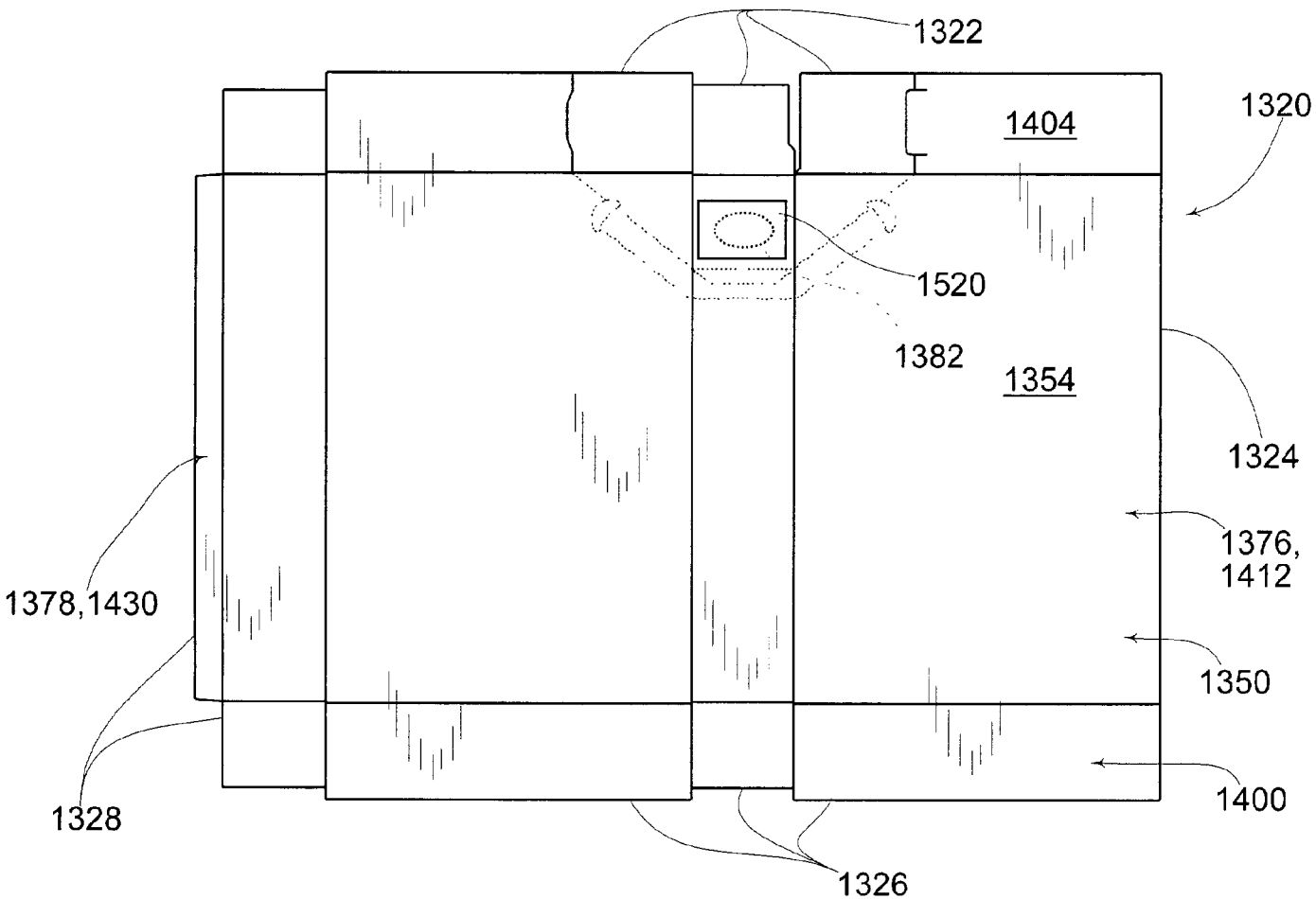
FIG. 34 is a plan view of a blank that may be used in the manufacture of the carton of FIG. 31, viewed from an exterior surface thereof.

FIG. 34 illustrates a blank 1320 from which the carton 1300 may be erected. The blank 1320 may be constructed from a plurality of layers of material, e.g., paperboard material. The blank 1320 may, for example, be constructed of two layers of material, e.g., an inner layer 1350 and an outer layer 1400. Inner layer 1350 is illustrated individually in FIG. 35. Outer layer 1400 is illustrated individually in FIG. 36. Furthermore, the blank 1320 may be bound by a plurality of cut lines 1322, 1324, 1326 and 1328, FIG. 34.

Figure 35:
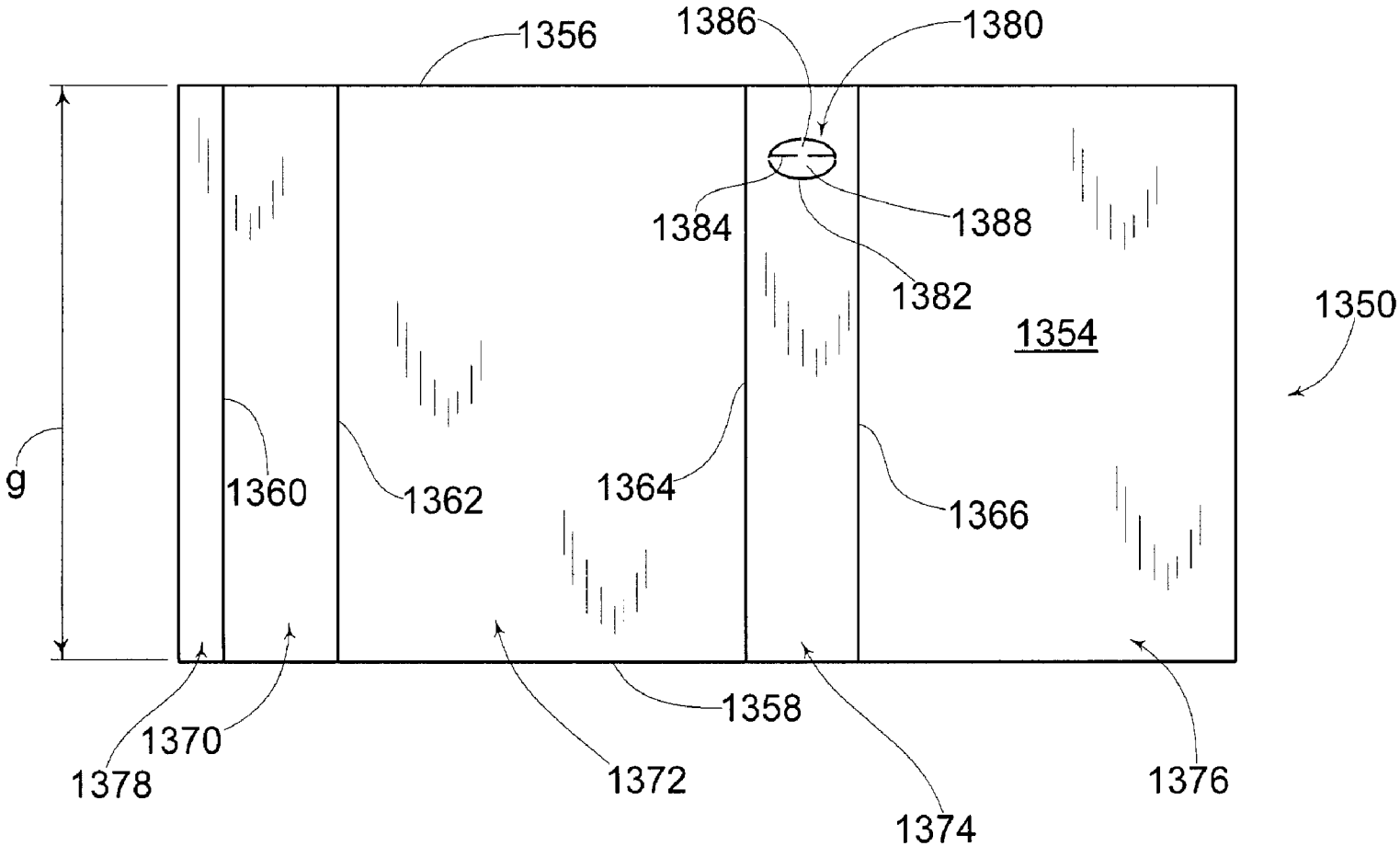
FIG. 35 is a plan view of an inner layer of the blank of FIG. 34, viewed from the exterior surface thereof.

Inner layer 1350 may, for example, be formed from a relatively rigid paperboard material such as that previously described herein. Referring now to FIG. 35, inner layer 1350 may include an inner surface 1354 and an oppositely disposed outer surface 1352, FIG. 33. With further reference to FIG. 35, inner layer 1350 may have a width "g", as shown, extending between the outer edges 1356, 1358 thereof. Inner layer 1350 may further have a plurality of lines of disruption such as the fold lines 1360, 1362, 1364 and 1366.

With further reference to FIG. 35, the fold lines 1360, 1362, 1364 and 1366 divide the inner layer 1350 into a first inner side panel 1370, a front inner panel 1372, a second inner side panel 1374, a rear inner panel 1376 and an inner glue panel 1378. A latch portion 1380 may be formed in the second inner side panel 1374. Latch portion 1380 may include a cut line 1382 and a fold line 1384. The cut line 1382 and fold line 1384 may separate the latch portion 1380 into a first panel 1386 and a second panel 1388.

Figure 36:
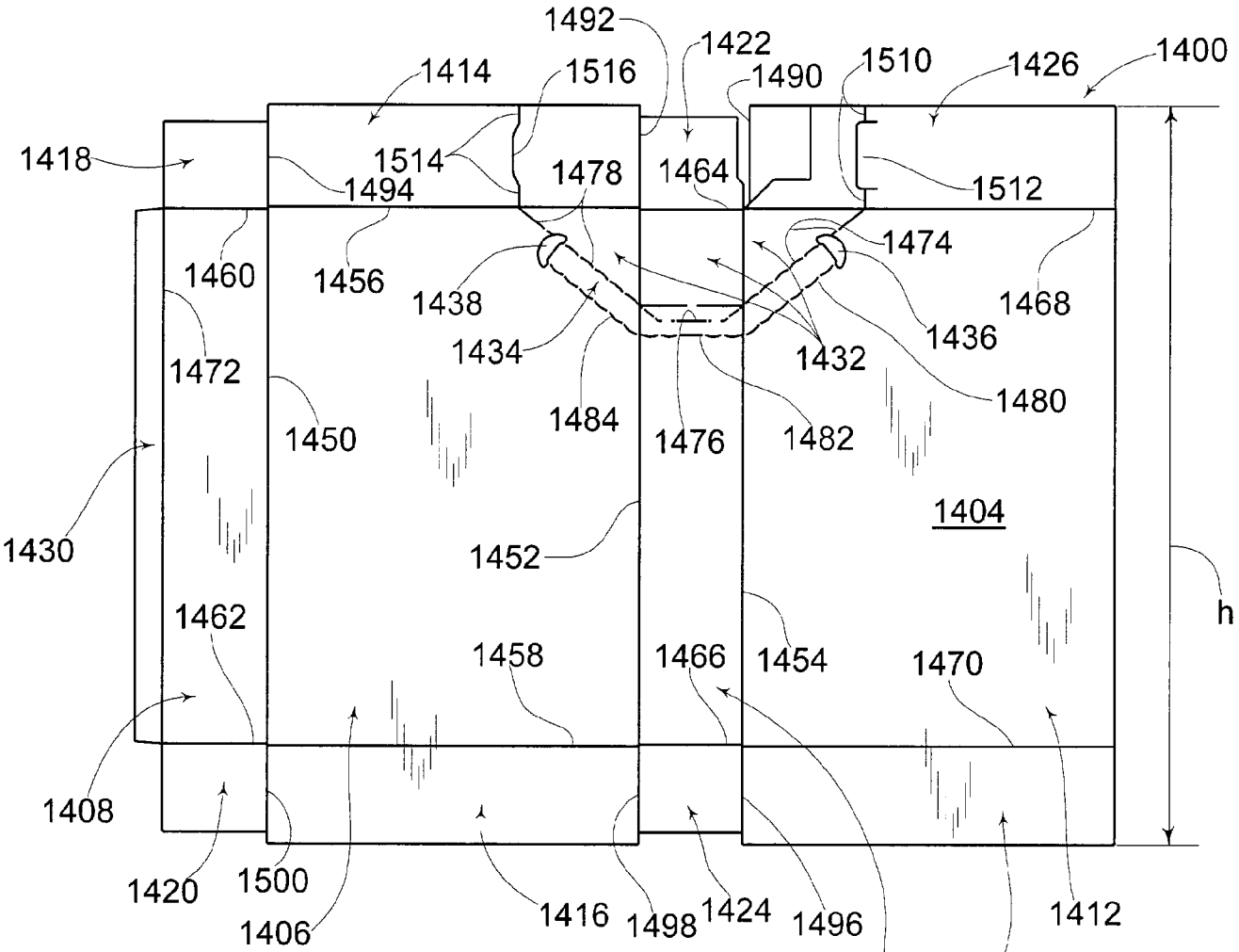
FIG. 36 is a plan view of an outer layer of the blank of FIG. 34, viewed from the exterior surface thereof.

Referring to FIG. 36, outer layer 1400 may, for example, be formed from a relatively rigid paperboard material such as that previously described herein. Outer layer 1400 may include an outer surface 1402, FIG. 33, and an oppositely disposed inner surface 1404, FIG. 34. The outer surface 1402 may include suitable graphics thereon, if desired, since the outer surface 1402 of the outer layer 1400 will make up at least the majority of the exterior surface of the assembled carton 1300, as will be discussed in further detail herein. Such graphics may include text and/or images and may be applied using any conventional means, such as a printing press. Alternatively, outer layer 1400 may be a laminated structure having, for example, a paperboard layer as described above and a plastic film layer laminated thereto in a conventional manner. In this case, in a manner as previously described, the film layer may be provided with graphics.

Referring again to FIG. 36, outer layer 1400 may include a front panel 1406 and opposite side panels 1408, 1410 attached thereto by fold lines 1450, 1452, respectively. A rear panel 1412 may be attached to the side panel 1410 by a fold line 1454. A top front panel 1414 and a bottom front panel 1416 may be attached to the front panel 1406 via fold lines 1456, 1458, respectively. A first top side panel 1418 and a first bottom side panel 1420 may be attached to the side panel 1408 via fold lines 1460, 1462, respectively. A second top side panel 1422 and a second bottom side panel 1424 may be attached to the side panel 1410 by fold lines 1464, 1466, respectively. A rear top panel 1426 and a rear bottom panel 1428 may be attached to the rear panel 1412 via fold lines 1468 and 1470, respectively. A corner 1432 may be formed in the side panel 1410 and the front and rear panels 1406, 1412, as shown. Specifically, the corner 1440 may be bounded by the fold lines 1456, 1464, 1468, and perforated tear lines 1474, 1476 and 1478 as shown. Perforated tear line 1474 may extend from the junction of the fold line 1454 and the perforated tear line 1476 to the fold line 1468. In a similar manner, perforated tear line 1478 may extend from the junction of the fold line 1452 and the perforated tear line 1476 to the fold line 1456. A tear strip 1434 may be formed adjacent the corner 1432, as shown. The tear strip 1434 may be bounded by the perforated tear lines 1474, 1476, 1478, a perforated tear line 1480, a perforated tear line 1482 and a perforated tear line 1484. A pair of finger engageable portions 1436, 1438 may be formed at ends of the tear strip 1434, as shown. Outer layer 1400 may have an overall width "h", as shown.

With further reference to FIG. 36, the rear top panel 1426 may be separated from the first top side panel 1422 by a cut line 1490. The first top side panel 1422 may be separated from the top front panel 1414 by a cut line 1492. The top front panel 1414 may be separated from the second top side panel 1418 by a cut line 1494. The rear bottom panel 1428 may be separated from the first bottom side panel 1424 by a cut line 1496. The first bottom side panel 1424 may be separated from the bottom front panel 1416 by a cut line 1498. The bottom front panel 1416 may be separated from the second bottom side panel 1420 by a cut line 1500. A first corner fold line 1510 and a first corner tab 1512 may be formed in the rear top panel 1426 as shown in FIG. 36. A second corner fold line 1514 and a second corner tab 1516 may be formed in the front top panel 1414 as shown.

As previously discussed, FIG. 34 illustrates the inner layer 1350 and the outer layer 1400 assembled into a multi-layer blank 1320 with the outer surface 1352, FIG. 33, of the inner layer 1350 abutting the inner surface 1404 of the outer layer 1400. FIG. 34 illustrates the blank 1320 as viewed from the inner surface thereof, i.e., the surface that will make up the majority of the interior surface of the carton 1300, FIG. 33. As can appreciated, when the inner and outer layers 1350, 1400 are assembled into the blank 1320, the inner layer fold lines 1360, 1362, 1364 and 1366 will be aligned with the outer layer fold lines 1472, 1450, 1452 and 1454, respectively. As can further be appreciated, the outer edge 1356 of the inner layer 1350 may be generally aligned with the outer layer fold lines 1460, 1456, 1464 and 1468, FIG. 36. In a similar manner, the outer edge 1358 of the inner layer 1350 may be generally aligned with the outer layer fold lines 1462, 1458, 1466 and 1470.

With continued reference to FIG. 34, to form the carton blank 1320, the inner layer 1350 and outer layer 1400 may be secured to one another by any conventional mechanism. The layers 1350, 1400 may, for example, be attached using an adhesive such as glue. The layers 1350, 1400 further may be laminated to one another by applying an adhesive pattern to either the inner surface 1404 of the outer layer 1400 or to the outer surface 1354 of the inner layer 1350 or to both. Such adhesive may, for example, be applied to substantially the entire area of the surfaces discussed with the exception of the areas defined by the corner 1432 and the tear strip 1434. Although, as discussed above, adhesive may generally be omitted from the area defined by the corner 1432, adhesive may be selectively applied in the area of the second panel 1388 of the latch portion 1380, FIG. 35 for reasons that will be discussed herein.

Having described the blank 1320, various methods for manufacturing the blank will now be discussed. The blank inner layer 1350 and outer layer 1400 may, for example, each be made by a conventional blanking process in which the desired lines of disruption, as illustrated in the drawings and discussed above, may be made. Thereafter, the two layers 1350, 1400 may be laminated together using, for example, a conventional pick and place machine or a folder-gluer machine or the layers may be aligned and laminated by hand.

Alternatively, the blank 1350 may be manufactured in a relatively more efficient manner using the production line 10 illustrated in FIG. 1. Specifically, for example, the supply roll 88 may contain the desired material from which the outer layer 1400 is formed and the supply roll 98 may contain the desired material from which the inner layer 1350 is formed.

With further reference to FIG. 1, the first web of material 86 may have a width equal to the width "h", FIG. 36, of the outer layer 1400. The first web of material 86 may be unwound from the supply roll 88 and fed into the first disrupting station 30. In the first disrupting station 30, all of the lines of disruption illustrated in FIG. 36 may be applied.

The second web of material 96 may have a width equal to the width "g", FIG. 35, of the inner layer 1350. The web of material 96 may be unwound from the supply roll 98 and fed into the second disrupting station 40. In the second disrupting station 40, all of the lines of disruption illustrated in FIG. 35 may be applied. Thereafter, adhesive may be selectively applied to the web of material 96 in the adhesive application station 50. The webs 86 and 96 may then be joined together in the laminating station 60. Thereafter, the combined web of material 92 may enter the third disrupting station 70. The third disrupting station may apply to the combined web 92 the lines of disruption illustrated in FIGS. 35 and 36 that were not previously applied in the stations 30 and 40. Specifically, the third disruption station 70 may apply the cut lines 1322, 1324, 1326 and 1328, FIG. 34, thus causing the combined web 92 to be separated into individual carton blanks, such as the blank 1350, FIG. 34, in the third disrupting station 70.

It is noted that, when the blank 1320 is manufactured with the production line 10, the inner and outer layers 1350, 1400 will never actually exist in the state shown in FIGS. 35 and 36, respectively, since, as explained above, some of the lines of disruption illustrated in FIGS. 35 and 36 are not applied by the production line 10 until after the webs of material 86, 96 (and, thus, the layers 1350, 1400) are adhered together and enter the third disrupting station 70.

Having described the carton blank 1320, and an exemplary method of manufacture thereof, an exemplary method of converting the carton blank 1320 into a carton, such as the carton 1300, FIGS. 32 and 33, will now be described.

With reference to FIG. 34, first, the glue panels 1378, 1430 may be folded upwardly (i.e., in a direction out of the page as viewed in FIG. 34) and adhesive may be applied thereto. The blank 1320 may then be folded into a rectangular structure causing the glue panels 1378, 1430 to adhere to the inner surface 1354 of the inner first side panel 1370. The outer layer top panels 1418, 1414, 1422, 1426, FIG. 36, and the outer layer bottom panels 1420, 1416, 1424, 1428 may then be folded and glued in a conventional manner to form a top and a bottom wall, respectively, for the carton 1300.

With reference again to FIGS. 32 and 33, the carton 1300 may be opened by tearing the tear strip 1434 away from the carton 1300. The finger engageable tabs 1436, 1438 (FIG. 36) may be used to facilitate this task. After the tear strip 1434 has been removed, the top of the carton 1300 may be flipped open, causing the perforated tear strips 1474, 1478 (FIG. 36) to tear. FIG. 33 illustrates the carton 1300 in its open position. As can be appreciated, the opening of the corner 1432 may allow contents of the carton 1300 to be readily dispensed.

With reference to FIG. 33, as previously described, the outer surface 1352 of the latch portion 1380 may be adhered to the inner surface 1404 of the outer layer corner 1432. This arrangement may result in the latch portion 1380 completely separating from the inner layer 1350 when the carton 1300 is first opened. Thus, a hole (defined by latch portion cut line 1382) will be created in the inner layer 1350 having the same general shape and location as the latch portion 1380. When the carton 1300 is subsequently re-closed, the latch portion first panel 1386 will snap into this hole, thus providing a stay-closed feature on the carton 1300. Additionally, the carton 1300 may be configured as illustrated in FIG. 33 to provide a stay-open feature. In particular, the first corner fold line 1510 may be aligned with the second corner fold line 1514. When opened as illustrated in FIG. 33, the first corner tab 1512 may interact with the second corner tab 1516 to hold the corner 1432 as shown in FIG. 22. The stay-closed and stay-open features discussed above may, for example, be formed and operate in a substantially similar manner to that disclosed in U.S. Patent Application Publication No. 2002/0060240 A1, which is hereby specifically incorporated by reference for all that is disclosed therein.

With reference to FIG. 34, it should be noted that the hole defined by the cut line 1382 of the latch portion 1380 may be covered by a patch 1520. This patch 1520 may be attached to the inner surface 1354 of the inner layer 1350. This attachment (such as by adhesive) may be configured such that the latch portion 1380 is not adhered to the patch 1520. One method for attaching the patch 1520 may occur with a pick and place machine, or, alternatively by the production line 1010 illustrated in FIG. 27. If manufactured by the production line 1010 of FIG. 27, the patch 1520 may be a strip of material provided by the third supply roll 78.

As previously discussed, the outer and inner layers of the carton 1300 and blank 1320 may have differing material compositions. The inner and outer layers 1350, 1400 may further have different thicknesses if desired.

It should be noted that the stay-closed feature and/or the stay-open feature provided by the latch portion 1380 and the tabs 1512, 1516, respectively can be eliminated if desired. As can readily be appreciated, if the stay-closed feature provided by the latch portion 1380 is not required, then the patch 1520 described above may be omitted.

With reference, for example, to FIGS. 34-36, it can be appreciated that the multi-layer construction of the blank 1320, as described above, allows material to be utilized in a more efficient manner. More specifically, for example, the multi-layer construction allows the carton blank end panels, e.g., top panels 1414, 1426 and bottom panels 1416, 1428, FIG. 36, to be formed from a single layer of material (i.e., the outer layer 1400) while the body panels, e.g, front panel 1406 and rear panel 1412, are formed from a double layer of material (i.e., the outer layer 1400 and inner layer 1350, combined). This is advantageous because more material strength is generally required in the body panels since it is these panels (as opposed to the end panels) that supply the majority of the column strength for the carton 1300 when it is erected, filled and stacked, e.g., for shipment or storage.

It is further noted that the end panels also generally require less material strength (relative to the body panels) because, when the carton 1300 is erected, the end panels overlap one another to at least some extent, thus causing a double layer of material to exist in the end panel areas. In summary, the double layer construction addressed above effectively allows material to be removed from areas where it is not needed (e.g., the end panels) and concentrated in areas where it is needed (e.g., the body panels). The double layer construction, thus, allows less material to be used relative to a conventional single layer design without compromising the performance of the carton.

The double layer construction discussed above is further advantageous in that the movable corner flap 1432, FIG. 33, may be formed from the outer layer 1400 while the backing for the corner flap (i.e., the area covered by the flap 1432 when the carton is closed) may be formed from the inner layer 1350. In prior corner opening type cartons, it is generally necessary to include a separate insert piece to form the backing for the corner flap. Using a separate insert piece in this manner is disadvantageous since it generally requires the use of a relatively slow pick and place type machine to position the insert and adhere it to the carton blank. The use of such separate inserts is further disadvantageous in that additional material is required for the insert piece. This additional material, in turn, adds both cost and bulk (this becomes an issue particularly when carton blanks are stacked for shipment or storage).

Figure 37:
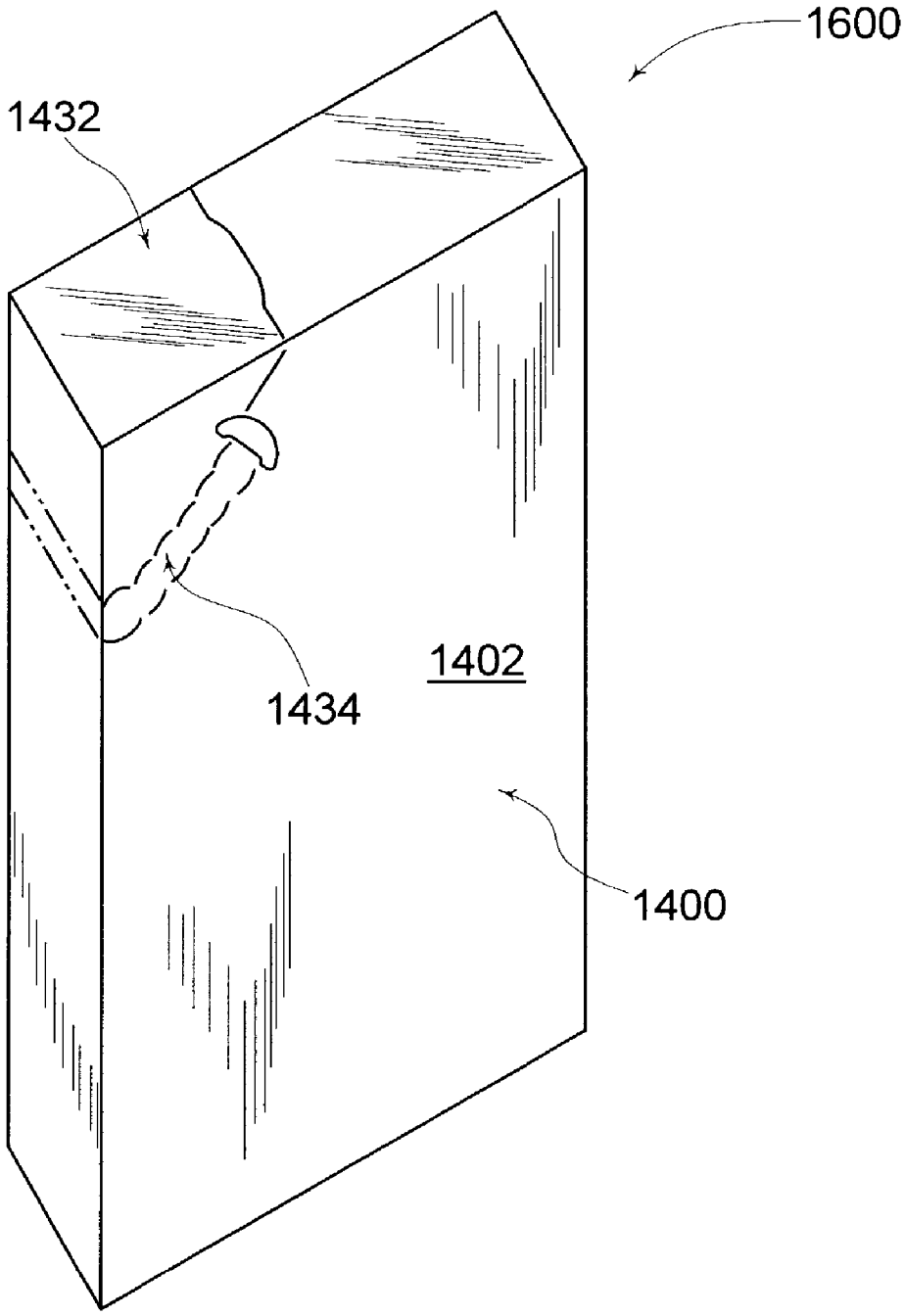
FIG. 37 is a perspective view of another exemplary carton provided with a corner spout illustrated in an unopened condition.
Figure 38:
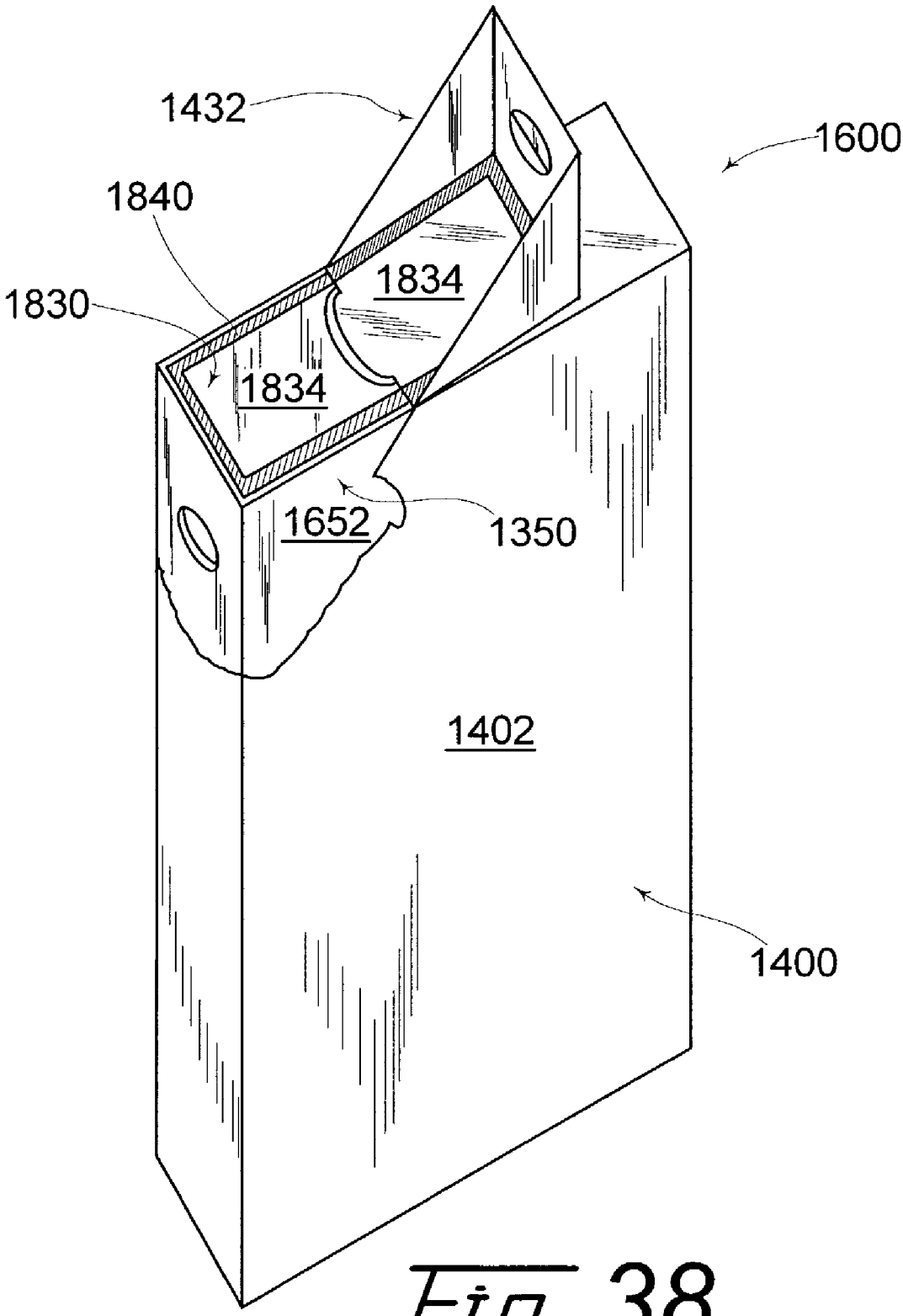
FIG. 38 is a perspective view of the carton of FIG. 37 illustrated in an opened condition.

FIGS. 37 and 38 illustrate an alternative carton 1600 that includes a liner 1830. The liner 1830 may be used, for example, to enhance the barrier properties of the carton and protect its contents, e.g., from moisture. Except as discussed below, the liner 1830 may, for example, be formed and positioned within the carton 1600 in a manner substantially similar to that disclosed in U.S. Patent Application Publication No. US 2002/0060240 A1, previously referenced. It is noted that the liner 1830 is illustrated in FIG. 39 having an exaggerated relative thickness for descriptive purposes only.

Figure 39:
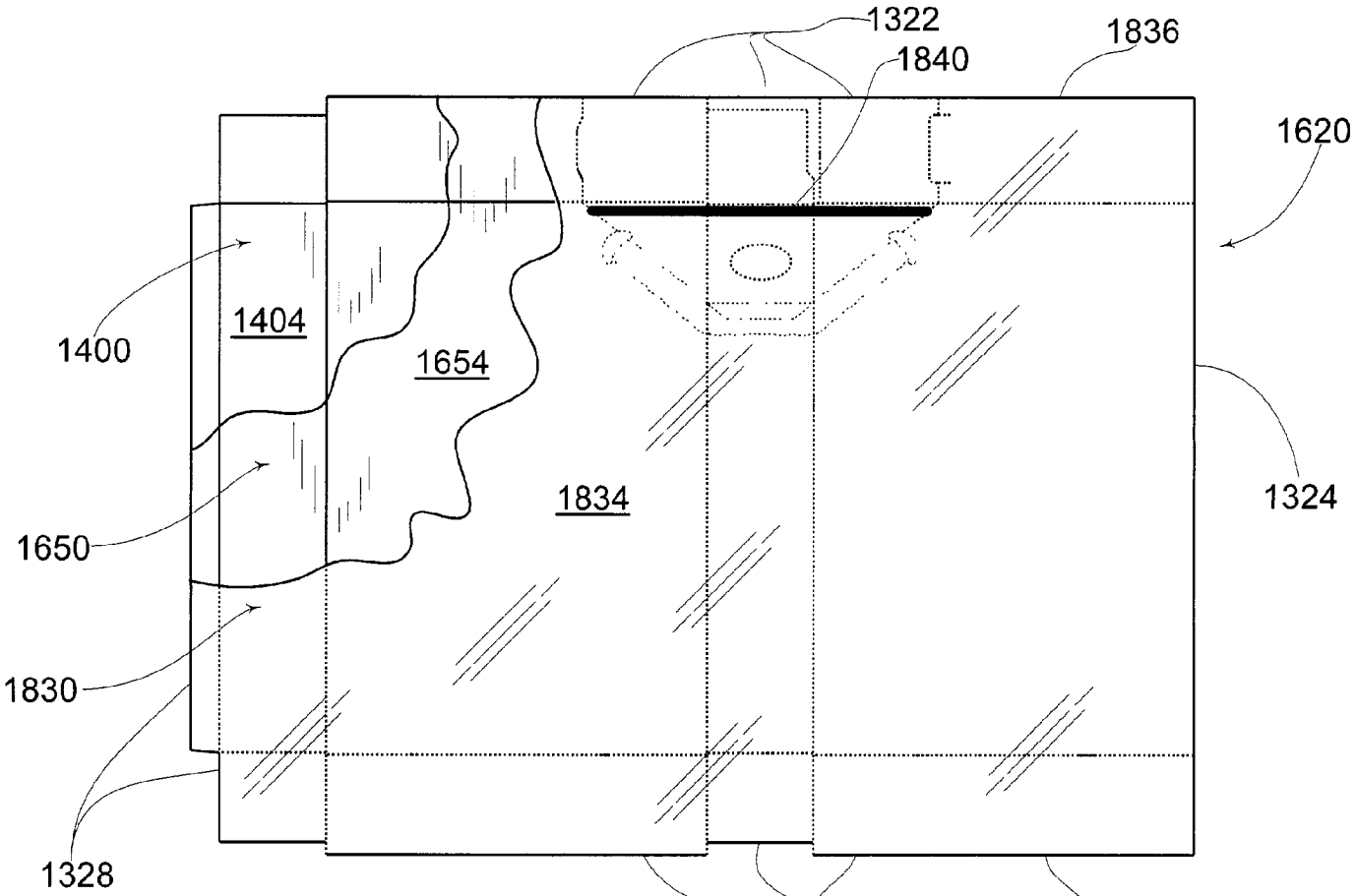
FIG. 39 is a plan view of a blank that may be used in the manufacture of the carton of FIG. 37, viewed from an exterior surface thereof.

FIG. 39 illustrates a carton blank 1620 from which the carton 1600 may be erected as viewed from the inner surface thereof, i.e., the surface that will make up the majority of the interior surface of the carton 1600, FIG. 38. The carton blank 1620 may include an outer layer 1400, an inner layer 1650 and a third layer 1830. The inner layer 1650 is illustrated individually in FIG. 40. The outer layer 1400 may be substantially identical to the outer layer 1440 previously described with respect to FIG. 36. It is noted that, due to the similarities between the outer layer of the cartons 1300 and 1600, like reference numerals have been used for like features, where appropriate, when referring to the carton outer layer 1400.

Figure 40:
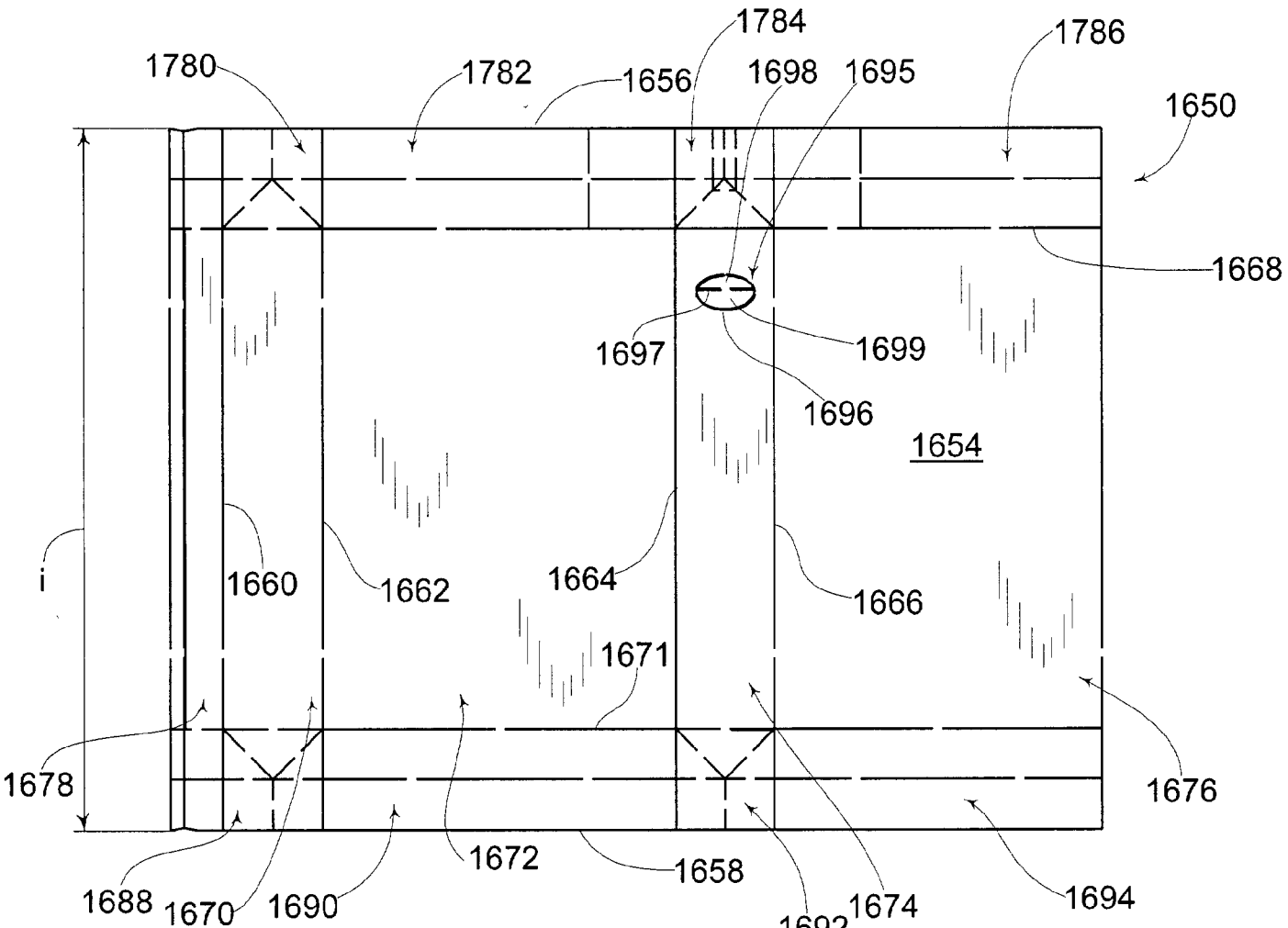
FIG. 40 is a plan view of an inner layer of the blank of FIG. 39, viewed from the exterior surface thereof.

Referring now to FIG. 40, inner layer 1650 may, for example, be formed from a relatively rigid paperboard material such as that previously described herein. Inner layer 1650 may include an inner surface 1654 and an oppositely disposed outer surface 1652, FIG. 38. With further reference to FIG. 40, inner layer 1650 may have a width "i", as shown, extending between the outer edges 1656, 1658 thereof. The width "i" may, for example, be substantially equal to the width "h" of the outer layer 1400, FIG. 36. Inner layer 1650 may further have a plurality of lines of disruption such as the fold lines 1660, 1662, 1664, 1666, 1668 and 1671.

With further reference to FIG. 40, the fold lines 1660, 1662, 1664, 1666, 1668 and 1671 divide the inner layer 1650 into a first inner side panel 1670, a front inner panel 1672, a second inner side panel 1674, a rear inner panel 1676, an inner glue panel 1678, a first inner top side panel 1780, a front inner top panel 1782, second inner top side panel 1784, a rear inner top panel 1786, a first inner bottom side panel 1688, a front inner bottom panel 1690, second inner bottom side pane 1692 and a rear inner bottom panel 1694. A latch portion 1695 may be formed in the second inner side panel 1674. Latch portion 1695 may include a cut line 1696 and a fold line 1697. The cut line 1696 and fold line 1697 may separate the latch portion 1695 into a first panel 1698 and a second panel 1699.

The inner layer 1650 may be adhered to the outer layer 1400 in substantially the same manner as described previously with respect to the embodiment of FIGS. 32-36, it being noted however, that the inner layer top panels 1780, 1782, 1784, 1786 and bottom panels 1688, 1690, 1692, 1694 (which do not exist in the inner layer 1350 of FIGS. 32-36) are not adhered to the outer layer 1400.

Third layer 1830 may, for example, be formed from a relatively flexible and relatively fluid impervious material such as polyethylene, polypropylene, polystyrene, poly vinyl chloride, or their equivalents now know to those skilled in the art or which are later developed. With reference again to FIG. 39, film layer 1830 may include an inner surface 1834 and an oppositely disposed outer surface, not shown. The outer surface and/or the inner surface may include an optional metalization layer to further increase the barrier properties of the film layer 1830. The metalization layer may be provided on a surface of the inner layer by vapor deposition and may, for example, be an aluminum layer. Further, the film layer 1830 may define a first outer edge 1836 and an oppositely disposed second outer edge 1838, FIG. 39.

With continued reference to FIG. 39, the film layer 1830 may be secured to substantially the entire inner surface of the inner layer 1350, except in the area of the latch 1695, FIG. 40, by any conventional mechanism. The layer 1830 may, for example, be attached using an adhesive such as glue. The layer 1830 further may be laminated to the combined layers 1350, 1400 by applying an adhesive pattern to either the inner surface 1354 of the inner layer 1350 or to the outer surface of the layer 1830 or to both.

As can appreciated, when the inner, outer and film layers 1650, 1400 and 1830 are assembled into the blank 1620 in the manner described above, the inner layer 1650 will provide a backing for the relatively thin film layer 1830 in the carton end flap areas (i.e., in the area of the inner layer top panels 1780, 1782, 1784, 1786 and the area of bottom panels 1688, 1690, 1692, 1694, FIG. 40). In this manner, the need for separate backing strips is eliminated, e.g., the backing strips 146, 150 shown in FIG. 2 of U.S. Patent Application Publication No. US 2002/0060240 A1, previously referenced.

In order to facilitate the opening of container 1600, a frangible line 1840 may be formed in the blank 1620. This frangible line 1840 allows the film layer 1830 to be separated upon initial opening of the container 1600. The frangible line 1840 may, for example, be formed by any number of methods. In one exemplary method of creating the frangible line 1840, the layer 1830 may be heat-staked to the inner layer 1350 in a manner similar to that disclosed in U.S. Patent Application Publication No. US 2002/0060240 A1, previously referenced, and U.S. Patent Application Publication No. US 2002/0055429 A1, which is hereby incorporated by reference for all that is disclosed therein. To facilitate such heat staking, the inner layer 1350 may be formed from material suitable for heat staking, such as that disclosed in the immediately aforementioned U.S. Patent Application Publications.

Having described the blank 1620, various methods for manufacturing the blank will now be discussed. The blank inner layer 1350 and outer layer 1400 may, for example, each be made by a conventional blanking process in which the desired lines of disruption, as illustrated in the drawings and discussed above, may be made. Thereafter, the layers 1350, 1400 and 1830 may be laminated together using, for example, a conventional pick and place machine or a folder-gluer machine or the layers may be aligned and laminated by hand.

Figure 41:
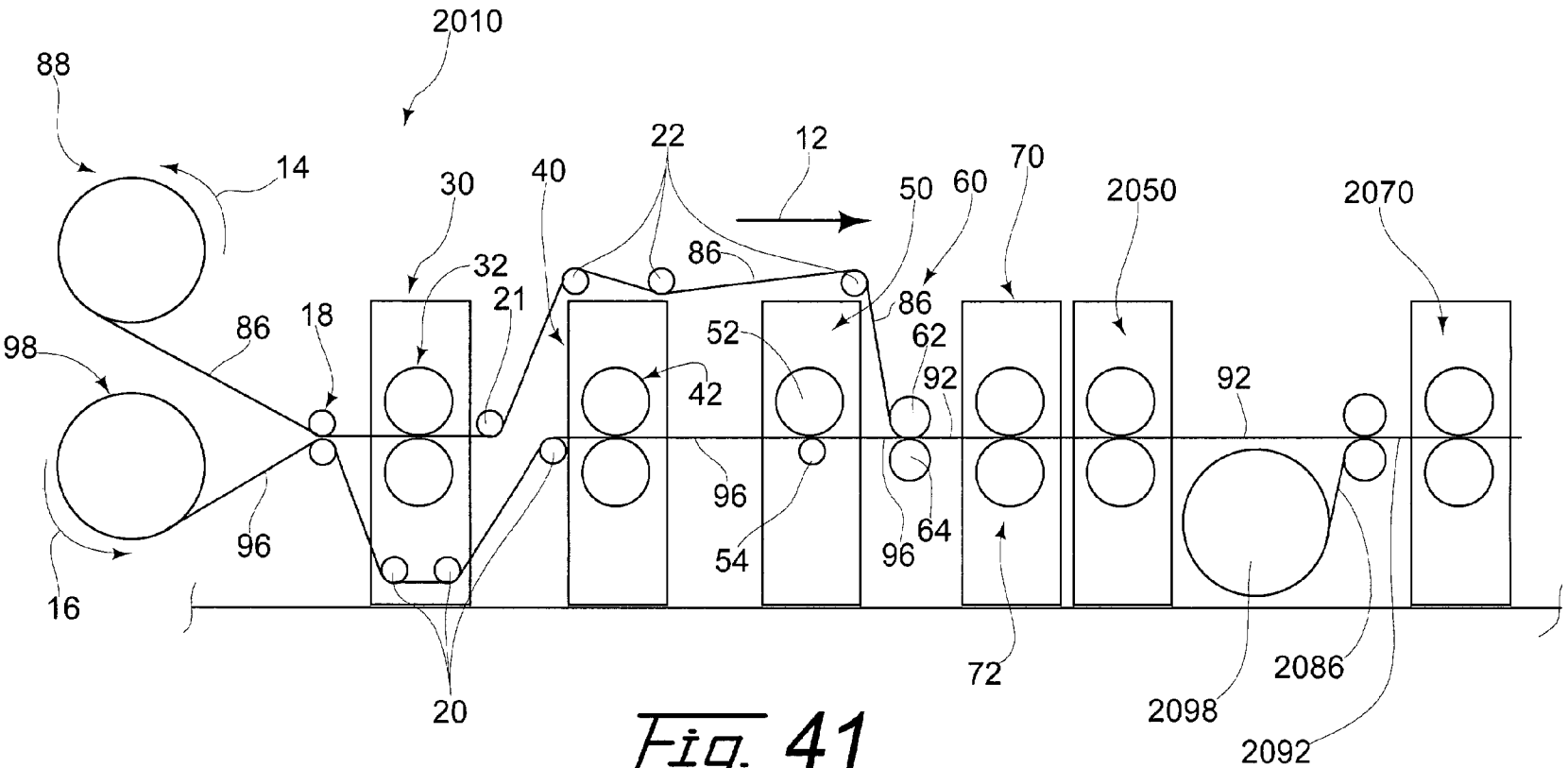
FIG. 41 is a schematic illustration of another exemplary production line.

Alternatively, the blank 1620 may be manufactured in a relatively more efficient manner using a production line 2010 as schematically illustrated in FIG. 41. The production line 2010 may be substantially identical to the production line 10 previously described with respect to FIG. 1 except that, in the production line 2010, a layer of film material is introduced as will be explained in further detail below. The same reference numerals are used in FIG. 41 to denote identical features appearing in FIG. 1.

Turning now to FIG. 41, the production line 2010 may be substantially identical to the production line 10 previously described with respect to FIG. 1 except as discussed below. The production line 2010 may include a second adhesive application station 2050, a third supply roll 2098, a second laminating station 2060 and a fourth disrupting station 2070. Third disrupting station 70 may be reconfigured (relative to FIG. 1) so that it applies lines of disruption, but does not separate the combined web of material 92 into individual carton blanks. Second adhesive application station 2050 may be substantially identical to the adhesive application station 50 except that the second adhesive application station 2050 may be configured to apply adhesive to the lower (as viewed in FIG. 41) surface of the combined web of material 92. Third supply roll 2098 may contain a spirally wound quantity of a third web of material 2086 which may, for example, be the material desired to form the film layer 1830 discussed above. Second laminating station 2060 may be substantially identical to the laminating station 60 previously described and serves to laminate the third web of material 2086 to the combined web of material 92 resulting in a three-layer combined web of material 2092, as shown. Fourth disrupting station 2070 may, for example, be substantially identical to the disrupting stations 30 and 40 previously described but may be configured to merely make the final cuts necessary to separate the combined web of material 2092 into individual carton blanks.

The carton blank 1620 may be formed on the production line 2010 in a manner similar to that described with respect to the carton blank 1320 (FIG. 34) and the production line 10, except that the third layer 1830 may be added via the third supply roll 2098, FIG. 41, and adhered via the second adhesive application station 2050 and the second laminating station 2060 to the combined web of material 92. The third disrupting station 70 may function in a manner identical to that described with respect to the manufacture of the carton blank 1320 except that, when forming the carton blank 1620 on the production line 2010, the third disrupting station 70 does not separate the combined web of material 92 into individual carton blanks. In the production line 2010, such separation is instead accomplished in the fourth disrupting station 2070.

Configured in this manner, the production line 2010 allows the formation of carton blanks, such as the carton blank 1620, without any lines of disruption (other than the final carton blank separation lines) being formed in the film layer 1830. This is advantageous since it is generally undesirable to form lines of disruption in the film layer 1830 as such lines of disruption could compromise the integrity of the film layer and, thus, degrade the barrier properties afforded thereby.

After a carton blank 1620 has been formed on the production line 2010, it may be transferred to a conventional heat staking machine in order to have the frangible heat stake line 1840 applied. As an alternative to using a separate heat staking machine, the heat staking process may provided within the fourth disrupting station 2070, FIG. 41, so that no additional processing of the blank 1620 is required.

Having described the carton blank 1620 and an exemplary method of manufacture thereof, an exemplary method of converting the carton blank 1620 into a carton, such as the carton 1600, FIGS. 37 and 38, will now be described. In general terms, the process of converting the carton blank 1620 into the carton 1600 may be substantially similar to the conversion of carton blank 1320 (FIG. 34) into carton 1300 (FIG. 32); the exception being that the film layer 1830 within the top and bottom portions of the carton is sealed to provide a substantially sealed container (until the container 1600 is opened for initial use by an end user). This process of sealing the film layer 1830 (with the inner layer 1700 attached thereto) may be substantially similar to the process disclosed in U.S. Patent Application Publication No. US 2002/0060240 A1, previously referenced.

As mentioned above, in order to facilitate the formation of the frangible line 1840 in the liner 1830, FIG. 39, the entire inner layer 1350 may be formed from material suitable for heat staking. As an alternative, a smaller insert member formed from such a material may instead be used. Such an insert member may, for example, be similar in shape, composition and position to the insert 120 shown in FIG. 2 of U.S. Patent Application Publication No. US 2002/0060240 A1, previously referenced.

As a further alternative, rather than using an insert member, the inner layer 1350 could be printed with a material that facilitates heat staking.

As a further alternative, the liner could be cut along the line 1840 during formation of the carton blank and a patch then adhered over the cut line to preserve the barrier properties afforded by the liner 1830 until the carton is first opened by an end user. The patch could, for example, be formed from a relatively thin and/or weak material such that the patch will readily tear apart upon initial opening of the carton. The patch may be placed either on the inner or the outer surface of the layer 1830.

Figure 42:
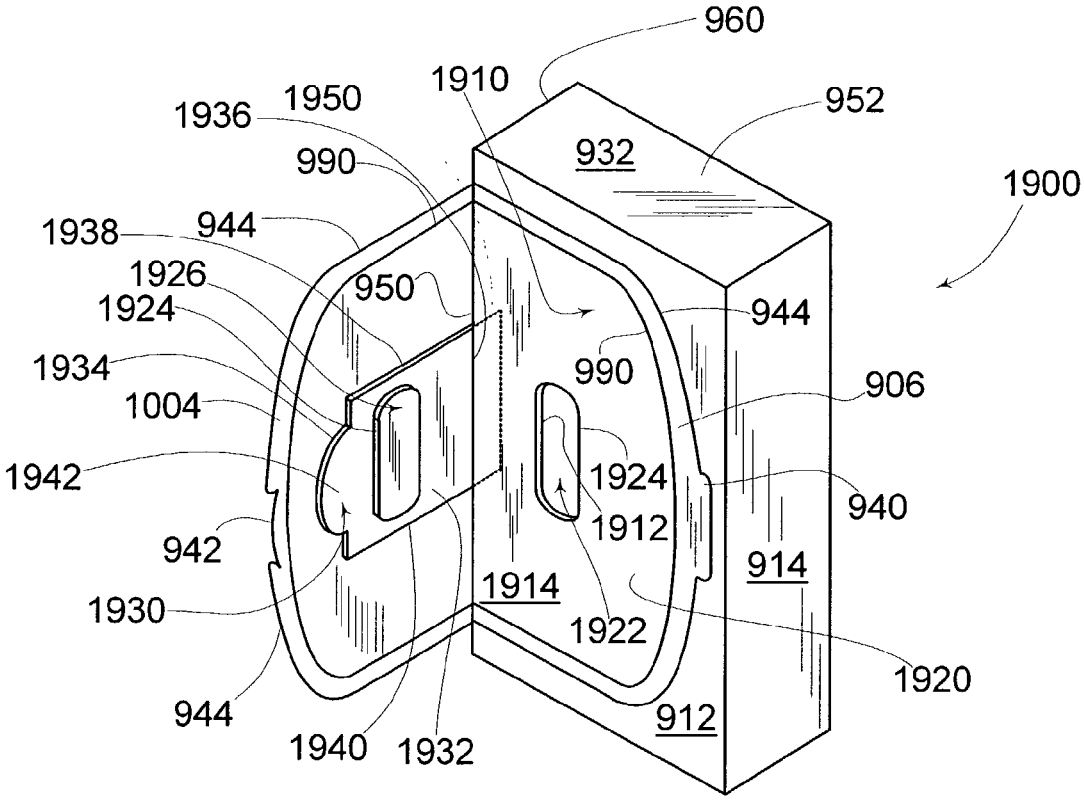
FIG. 42 is a perspective view of another exemplary carton.

FIG. 42 illustrates another type of carton 1900 that may, for example, be manufactured with the production line 2010 of FIG. 41. With reference to FIG. 42, carton 1900 may be substantially similar to carton 1000, as illustrated in FIGS. 24 and 25. Accordingly, like reference numerals have been used to refer to like features. The carton 1900, however, differs from the carton illustrated in FIGS. 24 and 25 in that the carton 1900 is provided with a liner 1910.

Liner 1910 may be useful for providing barrier properties (particularly liquid impervious properties) in a similar manner to the embodiment described with respect to FIGS. 37-40. Liquid impervious containers are used for storing moist or moisture sensitive products such as, for example, moistened wipes. The liner 1910 may be provided with an inner surface 1912 and an oppositely disposed outer surface 1914. The outer surface 1914 of the liner 1910 may be adhered to sidewall panel 912. The liner 1910 may be further provided with an exposed panel 1920 defined by the inner layer perforated line 990 and the fold line 950.

In order to gain access to items contained within the carton 1900, the liner 1910 may be provided with an opening 1922. The opening 1922 may be defined by a cut line 1924 positioned within the exposed panel 1920 such that it extends between the outer surface 1914 and the inner surface 1912. A patch 1926 defined by the cut line 1924 of the opening 1922 may be removed from the opening 1922 in a process that will be described later herein.

The container 1900 may be further provided with a carrier panel 1930. The carrier panel 1930 may be provided with a first surface 1932 and an oppositely disposed second surface 1934. Furthermore, the carrier panel 1930 may be provided with a fold line 1936, a first edge 1938, a second edge 1940 and a tab edge 1942. The fold line 1936 and fold edges 1938, 1940 and 1942 define the external boundary of the carrier panel 1930. The container 1900 may be provided with a hinge base panel 1950. The hinge base panel 1950 may be defined by the fold line 1936 as shown in FIG. 42. In one exemplary embodiment, the hinge base panel 1950 may be integrally formed with the carrier panel 1930. The hinge base panel 1950 may be adhesively captured between the liner 1910 and the sidewall panel 960. Furthermore, these panels 1930 and 1950 may be adhesively captured during the manufacturing processes previously described herein (either during a pick-and-place operation or as a separate roll similar to roll 2098 illustrated in FIG. 41).

For reasons that will be discussed later herein, the carrier panel 1930 may have adhesive applied thereto. The first surface 1932 of the carrier panel 1930 may have a first type of adhesive applied thereto. The second surface 1934 of the carrier panel 1930 may have a second type of adhesive applied thereto. The first and second types of adhesive may be identical, or, alternatively, one may be less tenacious relative to the other.

Having described one exemplary embodiment of the container 1900, the process of using this container will now be discussed. At the outset, container 1900 may be in an unopened condition (substantially similar to the unopened condition of container 1000 illustrated in FIG. 24). In this unopened condition, container 1900 may be configured such that patch 1926 is located within opening 1922. The carrier panel 1930 may be positioned such that the first surface 1932 thereof is adhesively attached to the patch 1926 and the outer surface 1914 of the liner 1910. Furthermore, the carrier panel 1930 may also be positioned such that the second surface 1934 thereof is adhesively attached to the sidewall panel 1912.

When a user desires to open container 1900 for the first time, the users finger may act upon the finger opening 940 to cause rotation of the first panel 912 about the fold line 950. This rotation of the first panel 912 about the fold line 950 may cause the carrier panel 1930 to rotate about the fold line 1936. Patch 1936 may be adhesively adhered to the first surface 1932 of the carrier panel 1930. Therefore, the opening 1922 may be created when the container 1900 is opened for the first time.

After the user removes items (e.g. moistened wipes) from the container 1900, the sidewall panel 912 may be returned to the closed position. In this closed position, the first type of adhesive disposed on the first surface 1932 of the carrier panel 1930 may attach to the outer surface 1914 of the liner 1910 to provide a seal around the opening 1922. This container 1900 may be opened and closed repeatedly without causing the contents of the container to dry out.

Figure 44:
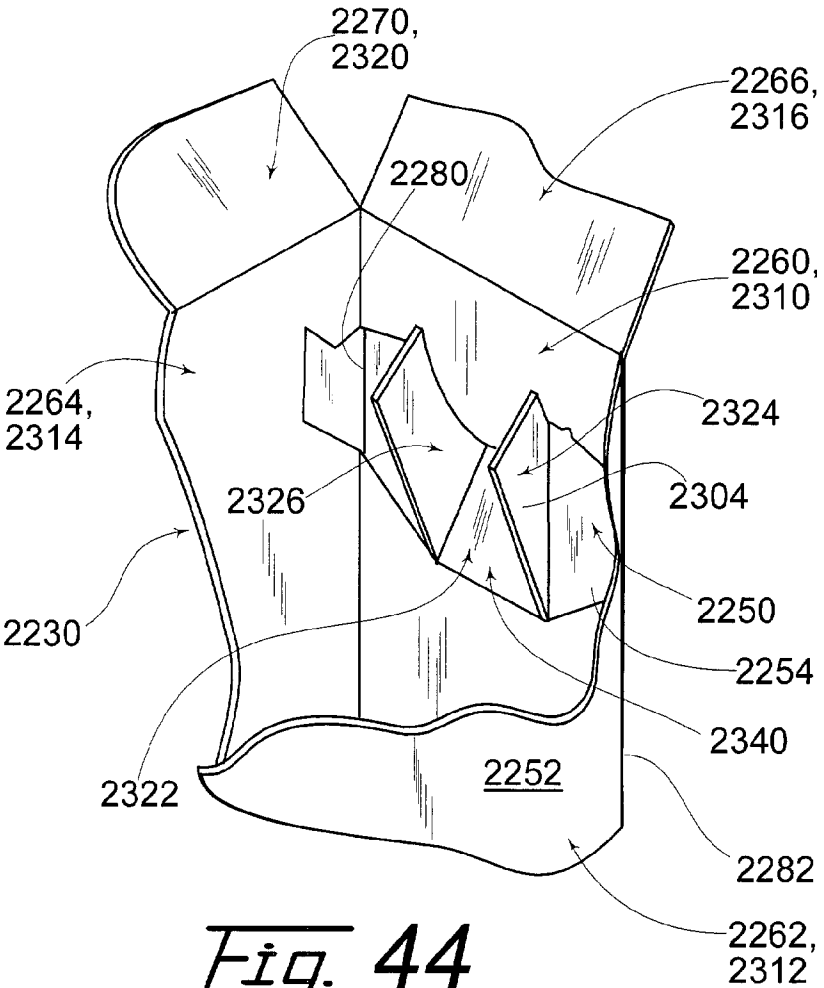
FIG. 44 is a perspective view of the carton of FIG. 43 illustrated in an opened condition; this perspective view is from an internal portion of the carton.
Figure 43:
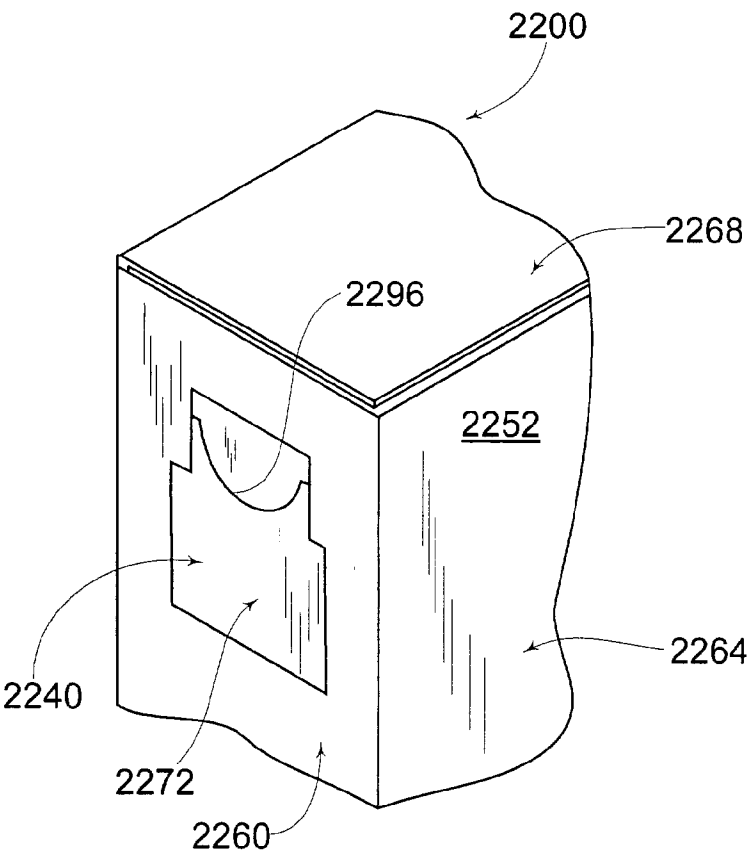
FIG. 43 is a perspective view of another exemplary carton provided with a pour spout illustrated in an unopened condition.
Figure 46:
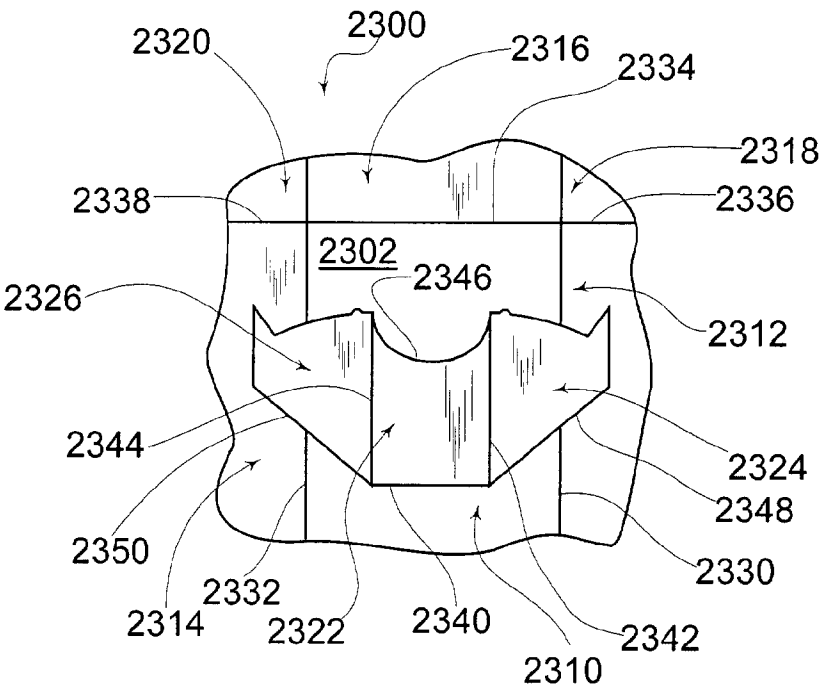
FIG. 46 is a plan view of an inner layer of the blank that may be used in the manufacture of the carton of FIG. 4, viewed from an interior surface thereof.

FIGS. 43 and 44 illustrate an alternative carton 2200 that may be manufactured from a blank 2230 (shown in a partially folded state in FIG. 44) having a pour spout 2240 formed therein. The blank 2230 may include an outer layer 2250 and an inner layer 2300. The outer layer 2250 is illustrated in FIG. 45 and the inner layer 2300 is illustrated in FIG. 46.

Figure 45:
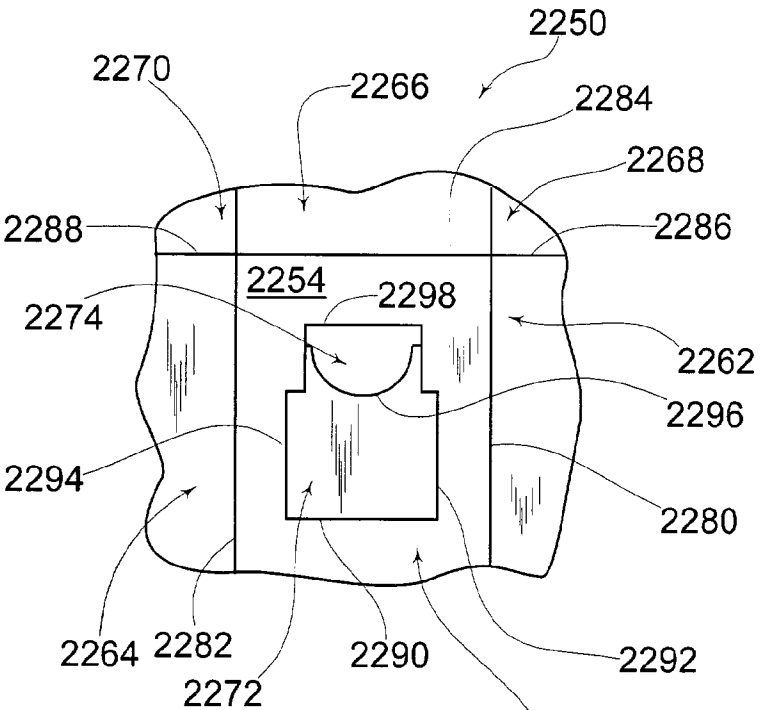
FIG. 45 is a plan view of an outer layer of a blank that may be used in the manufacture of the carton of FIG. 43, viewed from an inner surface thereof.

Referring to FIG. 45, the outer layer 2250 may, for example, be formed from a relatively rigid paperboard material such as that previously described herein. The outer layer 2250 may include an outer surface 2252, FIG. 43, and an oppositely disposed inner surface 2254. The outer surface 2252 may include suitable graphics thereon, if desired, since the outer surface 2252 of the outer layer 2250 will make up at least the majority of the exterior surface of the assembled carton 2200. Such graphics may include text and/or images and may be applied using any conventional means, such as a printing press. Alternatively, outer layer 2250 may be a laminated structure having, for example, a paperboard layer as described above and a plastic film layer laminated thereto in a conventional manner. In this case, in a manner as previously described, the film layer may be provided with graphics.

With further reference to FIG. 45, outer layer 2250 may include a side panel 2260 and opposite front and back panels 2262, 2264 attached thereto by fold lines 2280, 2282, respectively.

A top side panel 2266 may be attached to the side panel 2260 by a fold line 2284. A top front panel 2268 may be attached to the front panel 2262 by a fold line 2286. A top back panel 2270 may be attached to the back panel 2264 by a fold line 2288.

The outer layer 2250 may be further provided with features of the pour spout 2240. The outer layer 2250 may be provided with a spout panel 2272 attached to the side panel 2260 via a fold line 2290. The spout panel 2272 may be defined by the fold line 2290, a pair of cut lines 2292, 2294 and a finger tab line 2296 as illustrated in FIG. 45. The outer layer 2250 may be further provided with a finger panel 2274 attached to the side panel 2260 via a fold line 2298. The finger panel 2274 may be defined by the finger tab line 2296, the cut lines 2292, 2294 and the fold line 2298 as illustrated in FIG. 45.

Inner layer 2300 may, for example, be formed from a relatively rigid paperboard material such as that previously described herein. Referring now to FIG. 46, inner layer 2300 may include an inner surface 2302 and an oppositely disposed outer surface 2304, FIG. 44. Inner layer 2300 may include a side panel 2310 and opposite front and back panels 2312, 2314 attached thereto by fold lines 2330, 2332, respectively. A top side panel 2316 may be attached to the side panel 2310 by a fold line 2334. A top front panel 2318 may be attached to the front panel 2312 by a fold line 2336. A top back panel 2320 may be attached to the back panel 2314 by a fold line 2338.

The inner layer 2300 may be further provided with features of the pour spout 2240. The inner layer 2300 may be provided with a spout panel 2322 attached to the side panel 2310 via a fold line 2340. More specifically, the inner layer 2300 may be further provided with a pair of spout sides 2324, 2326 attached to the spout panel 2322 via fold lines 2342, 2344, respectively. The spout panel 2322 may be defined by the fold lines 2340, 2342, 2344 and a finger tab line 2346. The spout side 2324 may be defined by a cut line 2348 extending between opposite ends of the fold line 2342. The spout side 2324 may be defined by a cut line 2350 extending between opposite ends of the fold line 2344.

The inner layer 2300 and the outer layer 2250 may be assembled into the multi-layer blank 2230 with the outer surface 2304 of the inner layer 2300 abutting the inner surface 2254 of the outer layer 2250. As can be appreciated, when the layers 2250, 2300 are assembled into the blank 2230, the inner layer fold lines 2334, 2332, 2330, 2340 will be aligned with the outer layer fold lines 2284, 2282, 2280, 2290, respectively. The layers 2250, 2300 may be secured to one another by any conventional mechanism. The layers 2250, 2300 may, for example, be attached using an adhesive such as glue. The layers 2250, 2300 further may be laminated to one another by applying an adhesive pattern to either the inner surface 2254 of the outer layer 2250 or to the outer surface 2304 of the of the inner layer 2300 or to both. Such adhesive may, for example, be applied to substantially the entire area of the surfaces discussed with the exception of the areas defined by the spout sides 2324, 2326.

Having described the blank 2230, various methods for manufacturing the blank will now be described. The layers 2250, 2300 of the blank 2230 may be made by a conventional blanking process in which the desired lines of disruptions, illustrated in the drawings and discussed above, may be made. Thereafter the layers 2250, 2300 may be laminated together using, for example, a conventional pick and place machine or a folder-gluer machine or the layers may be aligned and laminated by hand. Alternatively, the blank 2230 may be manufactured in a relatively more efficient manner using the production line 10 illustrated in FIG. 1. Specifically, for example, the supply roll 88 may contain the desired material from which the outer layer 2250 is formed and the supply roll 98 may contain the desired material from which the inner layer 2300 is formed. The manufacturing process is substantially similar to other manufacturing processes previously described herein. Having described the carton 2200, the blank 2230 and the layers thereof, the process of using the carton 2200 and the pour spout 2340 will now be provided. In general terms, the pour spout 2340 may be opened to convert the carton from a closed container illustrated in FIG. 43 to the opened carton illustrated in FIG. 44. With reference to FIG. 43, to open the carton 2200, a user may place a finger on the finger tab line 2296 and apply pressure thereto. By applying pressure to the finger tab line 2296, the spout panel 2272 may separate from the finger panel 2274. This separation may also result in the inner layer spout panel 2322 separating from the inner side panel 2310. The user may then 'curl' a finger such that it becomes adjacent to the inner surface 2302 of the inner layer 2300 and thereafter apply force to open the pour spout 2340 as illustrated in FIG. 44. Once the pour spout 2340 is opened, contents of the carton 2200 may be dispensed therefrom.

While illustrative and presently preferred embodiments have been described in detail herein, it is to be understood that the inventive concepts may be otherwise variously embodied and employed and that the appended claims are intended to be construed to include such variations except insofar as limited by the prior art.

What is claimed is:

1. A method of forming carton blanks comprising:

(a) providing a moving first web of material moving along a direction of travel;

(b) providing a moving second web of material moving along the direction of travel;

(c) repeatedly forming a first pattern of lines of disruption in the first web, the first pattern including at least one section therein which is entirely defined relative to the remainder of the first web by at least one line of disruption, at least a portion of the at least one line of disruption extending nonparallel with the direction of travel;

(d) repeatedly forming a second pattern of lines of disruption in the second web;

(e) applying adhesive to at least one of the first and second webs in a predetermined pattern which includes a non-adhesive area corresponding to at least all of each at least one section;

(f) following steps (a) through (e), adhering the first and second webs of material together in face-to-face contact while they are substantially flat to form a combined web that is substantially flat moving along a direction of travel, with each first pattern of lines of disruption overlying a second pattern of lines of disruption such that each at least one section included in the first pattern of lines of disruption in the first web is not adhered to the second web; and (g) separating the combined web into carton blanks, at least a portion of each carton blank comprising two layers of material, with one of the first patterns of lines of disruption in the first layer and one of the second patterns of lines of disruption in the second layer, wherein the at least one section is capable of folding away from the second layer and capable of folding relative to the remainder of the first layer.

2. The method of claim 1, wherein the lines of disruption formed in the first and second webs each comprise at least one of a cut, a score, a tear line, a crease, a perforation, or a fold line.

3. The method of claim 2, wherein the first and second patterns of lines of disruption each comprise at least two of a cut, a score, a tear line, a crease, a perforation, or a fold line.

4. The method of claim 1, wherein separating each carton blank from the combined web comprises cutting the combined web transverse to its direction of travel.

5. The method of claim 4, wherein the lines of disruption formed in the first and second webs each comprise at least one of a cut, a score, a tear line, a crease, a perforation, or a fold line.

6. The method of claim 5, wherein in the combined web, at least a portion of the lines of disruption in the first pattern of lines of disruption is misaligned with at least a portion of the lines of disruption in the second pattern of lines of disruption.

7. The method of claim 1, further comprising:

unrolling a third web of paperboard from a roll; and adhering the third web of paperboard to at least one of the first and second webs.

8. The method of claim 1, wherein the first and second webs of material comprise paperboard.

9. The method of claim 1, wherein:

providing a first web of material comprises unrolling a roll of the first material; and providing a second web of material comprises unrolling a roll of the second material.

10. The method of claim 9, wherein in the combined web, at least a portion of the lines of disruption in the first pattern of lines of disruption is misaligned with at least a portion of the lines of disruption in the second pattern of lines of disruption.

11. The method of claim 1, wherein at least one additional line of disruption is applied to the combined web.

12. The method of claim 1, including the step of erecting the carton blanks to form cartons, wherein in each carton the at least one section folds away from the second layer and relative to the remainder of the first layer.

13. The method of claim 1, wherein the at least one section is defined by the at least one line of disruption and at least a second line of disruption.

14. The method of claim 13, wherein the second line of disruption is a fold line and the at least one line of disruption is a cut line which extends to both ends of the fold line.

15. The method of claim 13, wherein the lines of disruption defining the section are a pair of fold lines and a pair of cut lines.

16. The method of claim 13, wherein the at least one line of disruption and the second line of disruption extend across the first web from one edge of the first web to the other.

17. The method of claim 16, wherein the at least one line of disruption and the second line of disruption are substantially parallel.

18. The method of claim 1, wherein the portion of the at least one line of disruption extending nonparallel with the direction of travel is a cut line.

19. A method of forming carton blanks comprising:

providing a moving first web of material moving along a direction of travel;

providing a moving second web of material moving along the direction of travel;

prior to adhering the first web and the second web together, repeatedly forming at least one first pattern of lines of disruption in the first web, the at least one first pattern including at least one line of disruption entirely defining at least one section relative to the remainder of the first web, at least a portion of the at least one line of disruption extending nonparallel with the direction of travel;

prior to adhering the first web and the second web together, repeatedly forming at least one second pattern of lines of disruption in the second web;

applying adhesive to at least one of the first and second webs in a predetermined pattern which includes a non-adhesive area corresponding to at least all of each at least one section;

adhering the first and second webs of material together in face-to-face contact while they are substantially flat to form a combined web that is substantially flat moving along a direction of travel, with a first pattern of lines of disruption of the at least one first pattern of lines of disruption overlying a second pattern of lines of disruption of the at least one second pattern of lines of disruption, such that each said at least one section included in the at least one first pattern of lines of disruption in the first web is not adhered to the second web; and separating the combined web into carton blanks, at least a portion of each carton blank comprising two layers of material, with one of the at least one first patterns of lines of disruption in the first layer and one of the at least one second patterns of lines of disruption in the second layer, wherein the at least one section is capable of folding away from the second layer and capable of folding relative to the remainder of the first layer.

20. A method of forming carton blanks comprising:

providing a moving first web of material moving along a direction of travel;

providing a moving second web of material moving along the direction of travel;

repeatedly forming at least one first pattern of lines of disruption in the first web, the at least one first pattern including at least one line of disruption entirely defining at least one section relative to the remainder of the first web, at least a portion of the at least one line of disruption extending nonparallel with the direction of travel;

repeatedly forming at least one second pattern of lines of disruption in the second web;

applying adhesive to at least one of the first and second webs in a predetermined pattern which includes a non-adhesive area corresponding to substantially all of each at least one section, the first web having said at least one first pattern of lines of disruption repeatedly formed therein, and the second web having said at least one second pattern of lines of disruption repeatedly formed therein;

adhering the first and second webs of material together in face-to-face contact while they are substantially flat to form a combined web that is substantially flat moving along a direction of travel, with a first pattern of lines of disruption of the at least one first pattern of lines of disruption overlying a second pattern of lines of disruption of the at least one second pattern of lines of disruption, such that each said at least one section included in the at least one first pattern of lines of disruption in the first web is not adhered to the second web; and separating the combined web into carton blanks, at least a portion of each carton blank comprising two layers of material, with one of the at least one first patterns of lines of disruption in the first layer and one of the at least one second patterns of lines of disruption in the second layer, wherein the at least one section is capable of folding away from the second layer and capable of folding relative to the remainder of the first layer.

21. A method of forming carton blanks comprising:

providing a moving first web of material moving along a direction of travel;

providing a moving second web of material moving along the direction of travel;

repeatedly forming at least one first pattern of lines of disruption in the first web, the at least one first pattern including at least one section therein which is defined entirely by at least one line of disruption, at least a portion of the at least one line of disruption extending nonparallel with the direction of travel;

repeatedly forming at least one second pattern of lines of disruption in the second web;

thereafter, applying adhesive to at least one of the first and second webs in a predetermined pattern which includes a non-adhesive area corresponding to each at least one section in the first web;

thereafter, adhering the first and second webs of material together in face-to-face contact while they are substantially flat to form a combined web that is substantially flat moving along a direction of travel, with each of the at least one first patterns of lines of disruption overlying a respective one of the at least one second patterns of lines of disruption, such that each at least one section included in the at least one first pattern of lines of disruption in the first web is not adhered to the second web; and separating the combined web into carton blanks, at least a portion of each carton blank comprising two layers of material, with one of the at least one first patterns of lines of disruption in the first layer and one of the at least one second patterns of lines of disruption in the second layer, wherein the at least one section is capable of folding away from the second layer and capable of folding relative to the remainder of the first layer.

22. The method of claim 21, wherein each said at least one section is entirely defined by a plurality of lines of disruption.

23. The method of claim 22, wherein the plurality of lines of disruption comprises a fold line and a cut line which extends to both ends of the fold line.

24. The method of claim 22, wherein the plurality of lines of disruption comprises a pair of fold lines and a pair of cut lines.

25. The method of claim 12, wherein the at least one line of disruption is a fold line, and the at least one section folds about the fold line.

26. The method of claim 25, wherein the at least one section is also defined by at least one cut line.

27. The method of claim 17, wherein a third line of disruption is positioned between and substantially parallel to the pair of lines of disruption.

28. The method of claim 16, wherein the at least one line of disruption and the second line of disruption are cut lines.

* * * * *